US007161077B1

(12) United States Patent
Fry et al.

(10) Patent No.: US 7,161,077 B1
(45) Date of Patent: Jan. 9, 2007

(54) GRADUALLY PROGRESSIVE BORE BB-FLAT, CC, E-FLAT, F, OR B-FLAT VALVED MUSICAL WIND INSTRUMENT AND VALVED B-FLAT/F INVERTED DOUBLE MUSICAL WIND INSTRUMENT

(76) Inventors: Robert C. Fry, 15714 Polk Cir., Omaha, NE (US) 68135; William H. Sprague, Jr., 5755 Hilltop St., Papillion, NE (US) 68133; Craig L. Fuller, 5201 Cass St., Omaha, NE (US) 68132

( * ) Notice: Subject to any disclaimer, the term of this patent is extended or adjusted under 35 U.S.C. 154(b) by 511 days.

(21) Appl. No.: 10/625,215

(22) Filed: Jul. 22, 2003

Related U.S. Application Data

(60) Provisional application No. 60/397,453, filed on Jul. 22, 2002.

(51) Int. Cl.
*G10D 7/10* (2006.01)

(52) U.S. Cl. ..... 84/387 R; 84/395

(58) Field of Classification Search ..... 84/387 R, 84/395, 388, 389, 392, 393, 380 R
See application file for complete search history.

(56) References Cited

U.S. PATENT DOCUMENTS 3,973,464 A * 8/1976 Novy ..... 84/392
4,860,629 A * 8/1989 Del Giudice ..... 84/395
5,435,222 A * 7/1995 Leonard ..... 84/396

* cited by examiner

*Primary Examiner*—Lincoln Donovan
*Assistant Examiner*—Jianchun Qin
(74) *Attorney, Agent, or Firm*—Suiter Swantz pc llo

(57) ABSTRACT

The present invention is for valved musical wind instruments in the musical keys of BB-flat, CC, E-flat, and F with progressive cylindrical mid-section bore or gradual conical mid-section bore expansion or a combination, not to exceed 0.85 inch bore within the first 65% of instrument length and bell throat diameters not to exceed 3 inches measured 10 inches from the bell flare, in which bass trombone tone qualities prevail. Progressive mid-section bore is novel, enhances responsiveness, and enables "early" valve placement options. A 4-valve B-flat bass valve trombone, B-flat cimbasso, or B-flat Tu-Bone is claimed, and may have a single constant cylindrical mid-section bore, or progressive cylindrical mid-section bore or gradual conical mid-section bore expansion or a combination. A valved B-flat bass inverted full double trombone, cimbasso, or Tu-Bone is claimed, as well as a "compensated" version and a full double euphonium. Invention valves may be any piston or rotary valves.

18 Claims, 58 Drawing Sheets

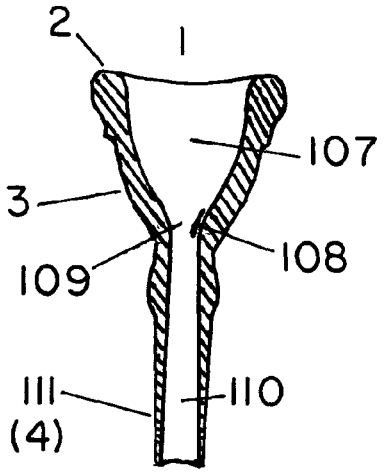
FIG. 2
(prior art)
FIG. 3A
(prior art)
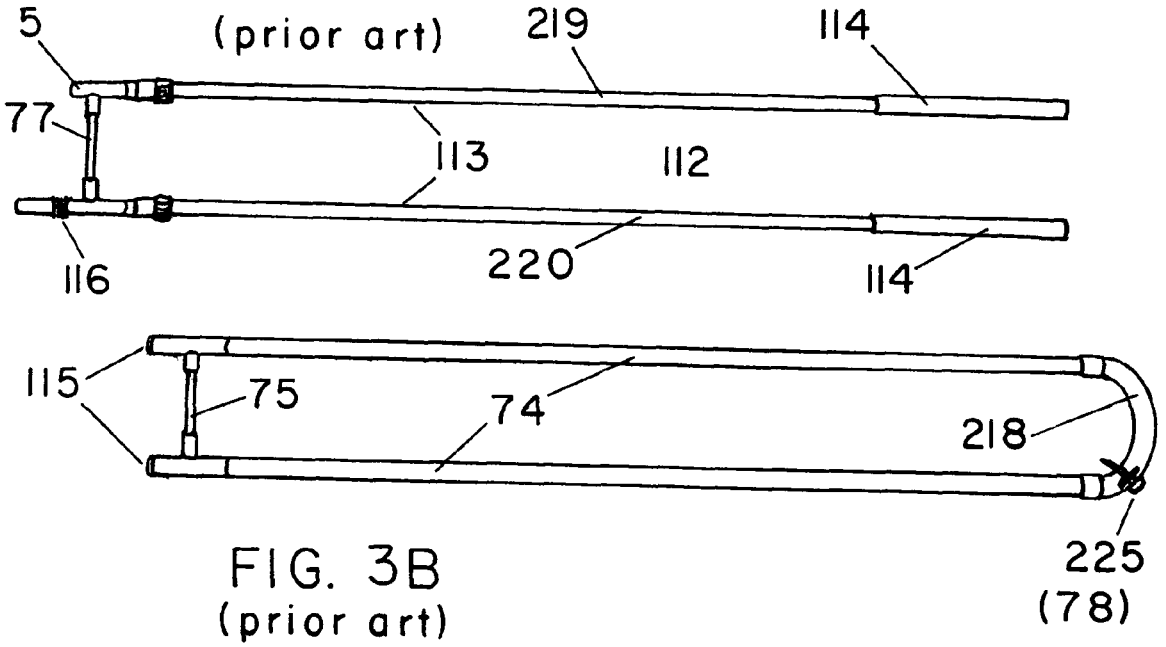
FIG. 3B
(prior art)

GRADUALLY PROGRESSIVE BORE BB-FLAT, CC, E-FLAT, F, OR B-FLAT VALVED MUSICAL WIND INSTRUMENT AND VALVED B-FLAT/F INVERTED DOUBLE MUSICAL WIND INSTRUMENT

CROSS REFERENCE TO RELATED APPLICATION

The present application claims priority under 35 USC § 119 to U.S. Provisional Application No. 60/397,453 filed on Jul. 22, 2002. Said U.S. Provisional Application No. 60/397,453 is hereby incorporated by reference.

FIELD OF THE INVENTION

This invention relates to low brass musical wind instruments, and in particular to bass and contrabass valved trombones, cimbassos, or Tu-Bones in the musical keys of B-flat, BB-flat, CC, F, E-flat and a combination musical key of B-flat/F, as well as B-flat valve trombones and euphoniums. Instead of a telescoping hand slide, the invention bass and contrabass trombones have at least three valves to facilitate chromatic pitch alteration. The primary inventions may be classified as B-flat valve trombones, B-flat bass valve trombones and BB-flat or CC contrabass valve trombones, or they may alternatively be classified as B-flat, BB-flat, CC, F, or E-flat cimbassos. The primary bass and contrabass valve trombone and cimbasso inventions are also given the inventors' preferred classification of "Tu-Bone" in this patent application. The at least three valves enable musical performance on the invention by tuba players using tuba mouthpieces and tuba embouchures in preferred bass and contrabass range embodiments; hence the preferred invention classification name of "Tu-Bone" which is a contraction of the classification names "Tuba" and "Trombone", and which reflects that the invention contains elements and characteristics of both tuba and trombone, but sounds like a powerful bass trombone.

The preferred invention Tu-Bone embodiments provide tuba players new playing opportunities, especially in the realm of jazz, by allowing them to sound like powerful bass trombonists and thereby further allowing them to replace conventional bass slide trombonists in the bass trombone (fourth or fifth) chair of jazz bands, "big bands", or stage bands. The invention especially addresses a heretofore unmet and particularly pressing need in the music programs of junior high (middle) schools, high schools, and even many colleges by enabling student tuba players (tubists) to sound like powerful bass trombonists with a minimum of effort while employing the "familiar" student tuba musical keys of B-flat or BB-flat, so a minimum of re-learning is required, and by further enabling the student tubists to replace weaker student bass trombonists in school jazz bands. A majority of school jazz bands either have no bass trombonist or typically have only a weak student bass trombonist who cannot play loudly, is generally "drowned out" by other instruments, and often cannot be heard by an audience. School jazz bands will be able to improve the sound of their brass section and in particular their trombone section by adding or substituting the invention B-flat or BB-flat Tu-Bone which may be played much more easily and powerfully by a student tuba player than is generally the case with most student bass trombonists performing on bass slide trombones. The invention Tu-bone thus gives school jazz bands a much solider and more readily heard bass sound in their brass section, and specifically in their trombone section, than is normally possible with trombone students playing conventional bass slide trombones. In the hands of student tuba players, the invention Tu-Bone enables more powerful (louder) playing volumes when desired, and overall improved audience enjoyment of school jazz band performance, as well as providing a unique music education opportunity to school band directors who may now offer student tuba players a jazz environment to play in.

Student tuba players normally have no opportunity to play in a school jazz band, because conventional tubas do not "blend" well tonally with a jazz trombone section and are normally excluded from the jazz band. However, the invention Tu-Bone blends very well tonally with jazz trombone sections and will provide playing opportunities in school jazz bands for student tuba players, thereby enhancing music education in the schools. Additional applications of the invention CC Tu-Bone, and the invention improved F and E-flat Tu-Bones may be found in operatic pit orchestras and recording studios, but the most widespread application for the B-flat and BB-flat Tu-Bone invention is anticipated to be replacement of the bass slide trombone in school jazz bands, the replacement generally being made by both Tu-Bone and by student tuba player (as a Tu-Bone "doubler") replacing a weak student bass slide trombonist.

Certain three-valve B-flat embodiments of the invention may find additional application as improved valve tenor trombones and marching trombones, and improved four-valve euphoniums are also within the scope of certain invention embodiments.

BACKGROUND OF THE INVENTION

Descriptions of prior art trombones in general and B-flat bass slide trombones in particular are provided, for example, in the "The Art of Trombone Playing", copyright 1963 (Summy Birchard, Evanston, Ill.) by E. Kleinhammer.

FIG. 1A represents a prior art B-flat tenor trombone including a mouthpiece (1,2,3) with stem (4), sometimes also referred to as a shank (4) fitted into a receiver (5) which is coupled to a variable length telescoping hand slide section (74), which is further coupled to a bell section comprising tube (18), tubular tuning slide bow (20), braces (25, 26, 27), tubular bell throat (23), and bell flare (24). FIG. 1B represents a prior art piston valve B-flat tenor trombone in which there are three piston valves (46–48) and three secondary length extension tubing loops (32, 35, 37). FIG. 1C shows the piston valve tenor trombone from an angle where the tubing loops (32, 35, 37) are more visible. FIG. 1D is a three valve B-flat "marching" trombone which is coiled in the manner of a trumpet, but is pitched in 108 inch B-flat and exhibits bores, a bell flare diameter, and tone qualities characteristic of a small bore tenor trombone. FIG. 2 shows details of a trombone mouthpiece, including a rim (2) against which a performer's lips are pressed, a cup (107) which receives a stream of vibrating air projected through a thin vibrating slit aperture formed between a center segment of the performer's lips, and a throat (108), thru-bore (109), and tapered backbore (110) through which the stream of vibrating air is projected as it enters the variable length telescoping hand slide section (74) shown earlier in FIG. 1A or as the vibrating air stream enters the stationary U-tube (74) and valve section (74A) shown in FIGS. 1B–C. The total tubing length, including bell throat (23) and bell flare (24) of a FIG. 1A B-flat tenor slide trombone is approximately 108 inches with the telescoping hand slide fully compressed to its shortest length (first slide position), the 108 inch length dimension determining the basic fundamental musical pitch or "key" of the trombones to be B-flat. Perspective in FIGS. 1A–B is from the trombone side proximal to player's head and looking back from a viewer position slightly forward of the right side of player's head and somewhat above the player's lips which are placed (1) at mouthpiece rim (2).

FIGS. 3A and 3B illustrate the disassembled component parts of a variable length telescoping hand slide section from the tenor trombone of FIG. 1A. An inner slide section (112) is illustrated in FIG. 3A comprising two essentially straight, substantially cylindrical inner slide tubes (113) held precisely parallel to one another by rigid brace (77) at a certain center to center offset distance. An outer slide section is further illustrated (FIG. 3B) comprising two essentially straight, substantially cylindrical outer slide tubes (74) held precisely parallel to one another by rigid brace (75) and curved tubular "crook" (218), forming a U-tube. The two outer slide tubes (74) are offset from one another by a center to center distance essentially equal to the certain center to center offset distance of the inner slide tubes (113) of the inner slide section (112), and the outer slide tubes (74) exhibit an inside diameter which is larger than the outside diameter of the indicated slightly enlarged o.d. stockings (114) of the inner slide section (112), the inside diameter of the outer slide tubes (74) being larger than the o.d. stockings (114) of the inner slide section (112) by a diameter increment in a range of 0.001 inch to 0.010 inch, and commonly being larger by a diameter increment of 0.007 inch to 0.008 inch, such that the outer slide section U-tube (FIG. 3B) may be slid freely onto the inner slide section (FIG. 3A), such that inner slide stockings (114) and tubes 113 are fully or partially inserted into the open ends (115) of outer slide section tubes (74).

The degree of the full or partial insertion of the inner slide tubes (113, 114) into the outer slide tubes (115, 74) yields an overall telescoping hand slide assembly length which may be varied to produce musical pitch alteration by a performer who holds inner slide brace (77) stationary in one hand and manipulates outer slide brace (75) to alter the degree of the full or partial insertion of the inner slide section into the outer slide section. Essentially, the inner slide section remains stationary during musical performance, and the outer slide section is telescopically slid by hand manipulation of the outer slide brace (75) to effect the desired musical pitch change according to pitch change requirements of a musical composition or musical improvisation being performed. The curved slide crook (218) indicated in FIG. 3B connects the remote ends of tubes (74) so that vibrating air is transmitted throughout the variable length, telescoping hand slide U-tube assembly, and the 0.007 inch to 0.008 inch diameter increment between the inside diameter or bore of the outer slide tubes (74) and the outside diameter of the inner slide stockings (114) is sufficient to maintain a non-leaking sliding air seal along the length of the inner slide stockings (114) regardless of the degree to which the telescoping length of the variable length telescoping hand slide assembly is adjusted by the performer. It should be noted that the length of the variable length telescoping hand slide assembly is such that the performer's arm is not long enough to accidentally push the outer slide section off the ends of the inner slide stockings (114) in performance, though the performer must remember not to "let go" of the brace (75) lest the outer slide section, in fact, fall off the ends of the inner slide stockings of its own accord, rendering the instrument temporarily inoperable, if not permanently damaged. Typically, only young beginning trombone students make this particular mistake.

Typically, a light oil, or a sparingly applied lubricant cream-and-water, or other lubricant and water mixture is applied to at least stockings (114) before assembling the outer slide section onto the inner slide section, and the water lubricant component of the cream or other lubricant and water lubricant may be periodically replenished by the performer by spraying the water lubricant onto exposed sections of the inner slide section tubes (113), when the outer slide section is telescopically extended partially or near to the fullest extension length possible with the outer slide assembly, without removing the outer slide assembly from the inner slide assembly, the water lubricant replenishment being performed prior to performance, during performance intermission, between performance numbers, or during "rest" periods when the bass trombone performer is not performing, and the replenished water lubricant excess automatically running down from exposed tubes (113) to hidden stockings (114) when the outer slide section is slid back and forth with the trombone slide being held with the crook (218) at a point lower than the brace (75).

A spring loaded excess water-and-spit emptying port (225) often called a "water key" or "spit key" or "spit valve" is normally provided on the crook (218) in FIG. 3B, and this allows periodic emptying of accumulated water and spit during musical "rest" periods, to avoid any unpleasant "gurgling" or "cracking" sounds which may otherwise detract from the quality of a musical performance.

One feature which distinguishes B-flat bass slide trombones from B-flat tenor slide trombones is that the inside diameter of inner slide tubes (113) is typically larger for the B-flat bass trombones than for the B-flat tenor trombones. The B-flat tenor trombones typically have inner slide tubes (113) with inside diameters or bores ranging from 0.470 inch to 0.547 inch, with typical inner slide tube bores of certain models of the B-flat tenor trombone having common values of approximately 0.470 inch, 0.481 inch, 0.490 inch, 0.500 inch, 0.508 inch, 0.509 inch, 0.525 inch, and 0.547 inch, defining a series of small bore (0.470–0.509 inch) tenor trombones, a medium bore (0.525 inch) tenor trombone, a large bore (0.547 inch) tenor trombone, and a few dual bore tenor trombones using two different bores selected from the above typical values such as 0.481/0.490 inch, 0.500/0.508, 0.508/0.525 inch, and 0.525/0.547 inch dual bores, as well as one additional large dual inner bore (0.547/0.562 inch) tenor trombone slide. This series of bores and dual bores offers a range of available tenor trombone tone qualities (timber or tamber) which are often described as being "brighter", "lighter", "brassier", "thinner", and more "brilliant" for the smaller bores and described as "darker", "heavier", "broader", "fuller", "warmer", and more "sonorous" for the larger bores. The smaller bore tenor trombones are typically used for "lead" (first) trombone playing in jazz bands and jazz combos, whereas the larger bore tenor trombones are more typically used by the first and second chair trombonists of symphony orchestras, classical brass quintets, wind ensembles, concert bands, and for classical tenor trombone solo works. A distinguishing feature of the B-flat bass slide trombones is therefore a larger yet inner slide tube bore of typically 0.562 inch or 0.565 inch in both inner slide tubes, which provides a substantially "darker", "heavier", "fuller", "deeper bass", and more "sonorous" yet tone quality desired in lower octave playing by fourth or fifth trombonists in jazz bands, and by $3^{rd}$ trombonists in wind ensembles, concert bands, and symphony orchestras, and by all performers of classical bass trombone solo works. Additional B-flat bass slide trombone prior art includes several models of dual bore variable length telescoping hand slide assembly, in which a first encountered inner slide tube (219) bore is 0.562 inch and a second encountered inner slide tube (220) bore is 0.578 inch, such as the model B62-78 dual bore B-flat bass trombone slide of S.E. Shires Co., Hopedale, Mass., U.S.A, which may be designated as a 0.562/0.578 inch dual bore slide. A smaller variant would be the S.E. Shires TB47-62 (0.547/0.562 inch) dual bore slide or the 0.547/0.567 inch dual bore slide currently manufactured by Thein, Bremen Germany. The S.E. Shires TB47-62 (0.547/0.562 inch) dual bore slide is used either for the smallest size of bass trombone, or it may be used for the largest size of orchestral tenor trombone. In this case, the factor determining whether the trombone is classified as a tenor trombone or a bass trombone is determined by the below described valve section bore and below described bell sizes, with smaller valve section bores and smaller bell sizes defining a large dual bore orchestral tenor trombone, and the larger valve section bores and larger bell sizes defining a small dual bore bass trombone.

The telescoping hand slide assembly is the primary, most frequently manually manipulated pitch altering means which musicians use to alter the pitch of the trombone from its fundamental B-flat pitch in order to deliver a full chromatic scale of pitches available in half step musical increments over the approximate 4 to 5 octave range of accessible trombone pitches. Trombonists also alter pitch by deliberately varying and controlling lip vibrational frequencies with which they modulate the air stream projected into the trombone, but this is a human function rather than an equipment function, and it only produces a series of discrete, quantified overtones and partials which do not cover all tones on the chromatic scale. A combination of controlled variation in lip vibrational frequency (choice of overtone) and controlled manipulation of the telescoping hand slide assembly is the primary means which trombonists use to alter the pitch of the trombone to deliver a full chromatic scale of pitches in musical half-step increments over the full 4 to 5 octave pitch range of the trombone.

FIGS. 1B and 1C show different views of a small bore, B-flat valve trombone (often simply referred to as a "valve trombone"), in which the long pipes (74) are fixed (non-moving, non-telescoping), no inner slide tubes exist, and pitches are lowered by depressing various combinations of three piston valves (46, 47, 48), to which extra tubing "loops" (37, 32, 35) are attached to each valve. Engaging one or more of the three piston valves (46–48) diverts air from the main path (5, 74, 74A, 35B, 32B, 18) into one or more of the three secondary length extension tubing loops (32, 35, 37), each of which (if selected) adds length to the main 108 inch B-flat air path and then returns the diverted air to continue in the main path or on to the next loop, if selected. Hook 135 is for the "little" finger to help stabilized the hand and also to help hold the valve trombone up.

FIG. 3C is an enlarged, exploded view of one piston valve. Key 120 and mating slot (121) ensure that the valve piston (122) may only be assembled into housing (123) in the indicated zero-degree orientation. The other two non-functional orientations shown (90 degree L and 90 degree R) are simply for reader inspection, in different views, of the hole pattern existing through the piston body (122). When the valve is assembled, by inserting the spring (124) and piston (122) into housing (123) with key (120) engaging slot (121), and tightening threaded cap (125) onto thread (126), the piston (122) is held at the top of the housing by spring (124), until the performer depresses key pad (127).

If key pad (127) is not depressed, then angled through-bore (128) of the piston body (122) is the only active piston passage, and it connects pipe (129) directly to (130), which is the main Bb air path of the trombone. In this configuration, any valve tubing loop connected to tubes (131, 132) will be excluded from the resonant path, and the pitch will not be altered from Bb.

If key (127) is fully depressed, piston passages (133, 134) become active. Passage (134) internally connects tube (129) to tube (132). Passage (133) internally connects tube (131) to tube (130). If an external tubing loop (135) is also connected from tube (132) to tube (131), as indicated by a dashed tube outline (135) in FIG. 3C, then this extra loop will be added "in series" to the main air path, such that vibrating air will enter the valve at (129), exit at (132), travel through loop (135), re-enter the valve at (131), and exit again to the main path at (130).

It should be noted that only one configuration of piston valve is shown in FIG. 3C. Other configurations may include external tubes departing at different angles than shown, mirror images of the valve shown, raising or lowering the bore patterns along the height of piston body (122) and external ports along the height of the valve casing (123), use of other bore patterns altogether, to achieve desired routing, and use of additional bores to effect an alternate tuning "compensation path" (not shown here; see FIG. 14C and a later section on compensated euphoniums and see also www.dwerden.com/comp/compensation.asp for 4-valve euphonium "compensation path"). The valve of FIG. 3C, is just one example of a variety of possible valve configurations. In addition, the entire valve and housing may be rotated from the position shown in the figure.

Referring back to FIG. 1B, Valve (46) differs from FIG. 3C in that the entire 1B (46) valve is rotated 135 degrees clockwise (about an axis "normal" to the figure plane) from FIG. 3C, and the piston passages and housing tubes are located closer to the bottom of the piston stroke. FIG. 1B Valve (47) is also rotated 135 degrees CW and it is further a "mirror image" of the valve in FIG. 3C. FIG. 1B Valve (48) is like valve (46), except that it is rotated 180 degrees about its own axis.

In FIGS. 1B and 1C, fully depressing valve key (47) alone, adds loop (35) to the main resonant air path, lowering the pitch from the B-flat fundamental to an "A". Depressing valve key (46) alone, adds a longer loop (32) to the main path, lowering the pitch further to "A-flat". Depressing valve key (48) alone, adds the longest single loop (37) to the main path and lowers the pitch to "G". To reach G-flat, valve keys (47, 48) would be simultaneously depressed, adding both loops (35 and 37) to the main path. By directing the sound through an extra coiled tubing length, or including various combinations of 1, 2, or 3 of the loops placed "in series" with the basic B-flat tubing by depressing appropriate valve keys, and through use of a variety of lip vibration overtones as mentioned earlier, a full range of chromatic tones, equivalent to the earlier telescoping slide of FIGS. 1A, 3A and 3B, may be produced by the valve trombone. Only the continuous slide "glissando" sound (or trombone "smear") cannot be reproduced by the valve trombone.

Valve trombones were commonly used in the $19^{th}$ century, but the advent of the slide trombone has largely replaced the valve trombone, owing to lighter weight, reduction in cost, and most importantly the tone quality and accuracy of pitch possible with the well-tuned slide trombone in the hands of a skilled performer, and also to a reduction in "tortuosity" and internal valve obstruction of the air path with the slide trombone. The valve interconnect tubing loops (32, 35, 37) used to lower pitches of the small bore valve trombone in FIGS. 1B and 1C and internal valve piston passages give rise to a tortuous path, with "tight bends" and sudden directional changes which increase blowing back-pressure within the B-flat tenor valve trombone, and make it more "stuffy" to blow and perform on, thereby adversely affecting tone quality and particularly in the lower performing octaves. The slide trombone exhibits a less tortuous air path and is thereby "freer blowing", less stuffy, more responsive, and easier to produce a pleasing tone quality at the same bore, particularly in the lower octaves.

A trombone slide is however more awkward to move, and valve trombonists can often execute technically difficult passages more rapidly in medium range and higher octaves, due to the ease of depressing the valve keys while moving only one to three fingers within a short stroke distance, versus moving the slide up to 18 inches or more with the whole hand, wrist, arm, and shoulder all participating in the motion to some extent. In spite of this awkwardness of slide motion, the vast majority of today's trombonists overcome the slide motion awkwardness with intense practice, and are actually slide trombonists, with only a very few jazz artists such as the exceptionally gifted Rob McConnell ("Boss Brass") performing beautifully on the Bb tenor valve trombone. It is important to this patent for the reader to understand and recognize that the prior art 108 inch B-flat valve trombone was only ever produced or described in the "small bore" (0.470 inch–0.500 inch) 3-valve tenor trombone format. B-flat valve trombones are sometimes used in school jazz bands by "extra" trumpet and baritone players in situations where slide trombonists are too few in number to "fill the ranks".

Prior art also includes 108 inch three valve B-flat tenor marching trombones as shown in FIG. 1D. These are functionally the same as the three valve tenor trombone of FIGS. 1B and 1C, except that the tubing is coiled differently to make the marching trombone more compact. It is also small bore like the valve trombone and has never been described or produced in prior art with larger bores or with more than three valves to access the bass range from low E-flat to low B.

Modern B-flat piston valve trombones and marching valve trombones are tenor trombones and no recorded attempts have been made to produce them as bass trombones because their tubing and valve bore is too small (typically 0.470–0.525 inch bore) to allow responsive bass range playing, and especially because the use of only three valves precludes any access to the important bass range from low E-flat to low B-natural. Four valve, 108 inch (B-flat) valve trombones or marching trombones have not been described or produced in the realm of prior art. Prior art 108 inch B-flat bass trombones have all employed a telescoping hand slide rather than valves for primary pitch alteration.

Another feature distinguishing B-flat bass slide trombones from B-flat tenor trombones is the diameter of bell flare (24, see FIG. 1A) which ranges from about 7 inches to 8.5 inches for different models of the B-flat tenor trombone, and which ranges from about 9½ inches to 10½ inches in today's the B-flat bass trombones. Some earlier B-flat bass trombones have been made with even larger bell flares, but the larger bell flares are no longer commonly used.

Regardless of whether telescoping hand slides or three valved slideless trombones are considered, the above described primary means of pitch alteration actually do not cover all pitches between the extreme lowest pitch and the extreme highest pitch possible with the 108 inch B-flat trombone, because neither the tubing loops of a three valve trombone, nor the trombonist's arm and telescoping hand slide assembly are long enough to add tubing lengths necessary for performance of the range low E-flat to low B-natural, which is often referred to as the "missing" range or the "pedal gap" range of tenor valve trombones or tenor slide trombones. The missing pedal gap range still persists today for all 108 inch B-flat valve trombones and B-flat marching (valve) trombones.

To fill in the "missing" pedal-gap range for 108 inch B-flat slide trombones, and also to facilitate alternate slide positions in the main B-flat range, the alternate positions occasionally being useful in simplifying and shortening certain slide change motions of certain "difficult" musical passages which exhibit fast tempos and have "difficult" or extreme hand slide position changes in the normal performing range and which are particularly difficult to execute at fast musical tempos, one auxiliary rotary valve is often added to medium and large bore tenor slide trombones, and at least one and often two auxiliary rotary valves are normally added to the bass slide trombone. These added auxiliary valves are typically operated by the left hand while the telescoping hand slide is operated by the right hand. The valves used to facilitate insertion of one or two length extension tubing loops to lower the fundamental musical pitch of the instrument from the key of B-flat to F, G-flat, or D, and alternatively from B-flat to F, G, or E-flat, depending on the length of tubing loops inserted.

Auxiliary rotary air valves for slide trombones are therefore useful mechanisms that direct the air flow from the mouthpiece through either a main air passage or a secondary tubing loop which alters the total instrument air path length and effects a corresponding change in musical key. Descriptions of prior designs of auxiliary rotary air valves for slide trombones in general and B-flat bass slide trombones in particular are provided, for example, in the "The Art of Trombone Playing", copyright 1963 (Summy Birchard, Evanston, Ill.) by E. Kleinhammer. Additional background information on prior art B-flat bass trombone valves and valve sections, which describe rotary valve configurations with relatively unobstructed valve air flow, may be found, for example, in the U.S. Pat. Nos. 5,686,678, 4,112,806, 4,127,052, 4,213,371, 4,299,156, 4,469,002, 4,905,564 of Greenhoe and of O. E. Thayer, respectively.

FIG. 4A shows that either B-flat tenor or B-flat bass slide trombones may have an alternative length extended air path comprising tubes (86–88) which may be added as a loop in series to the main B-flat air path via engagement of auxiliary rotary valve (85) which, when engaged via left thumb trigger lever and linkage (84)—see also FIGS. 4B–D (items 181–187, and 200–202 for a more detailed example of an F thumb trigger and rotary valve linkage) interrupts the main B-flat air path at tube (82) in FIG. 4A and diverts the vibrating air flow to tube 86, proceeding to tubular bow (87) and then tubing bend (88) and the vibrating air flow is then restored by the valve (85) back to the main air path at tube (83), proceeding on to tubular tuning slide bow (20) and hollow bell throat (23) and tubular bell flare (24) from which musical tones are finally projected to the listening audience. Left thumb actuation (84, 181) engages the valve (85, 170) producing the diversion of the vibrating air stream through the alternative length extension tubing loop (86–88, or 172–175) and increases the total air path length of the trombone, altering the fundamental musical key of the trombone to, most commonly, the musical key of F, and less commonly the musical key of E, depending on the length of the alternative length extension tubing loop (86–88, or 172–175). If the length of the alternative length extension tubing loop (86–88, or 172–175) is approximately 36 inches, then the total air path length with thumb trigger (84, 181)

depressed to engage the valve (85, 170) and add the alternative length extension tubing loop in series to the main 108 inch air path becomes a total of approximately 144 inches which corresponds to the musical key of F. When the thumb trigger (84, 181) is released, spring 201 restores the linkage (181–187) and the valve (85, 170) to its disengaged state, and the alternative length extension tubing loop (86–88, or 172–175) is bypassed with the vibrating air stream proceeding directly from main path tube section (82 or 171) to section (83 or 176) without traversing the alternative extension tubing loop (86, 87, 88, or 172, 173, 174, 175), and the overall path length in this instance is restored to the approximate 108 inch main path length, with the fundamental musical key of the FIGS. 4A–D prior art trombone being restored to B-flat.

It should be noted that the indicated B-flat total air path length of approximately 108 inches and the indicated alternative key of F total air path length of approximately 144 inches is with the variable length telescoping hand slide assembly (74, 75) in a fully compressed state, exhibiting shortest possible length corresponding to what is termed by trombone players as "slide position number 1" or "first position". Chromatic pitch alteration within the fundamental B-flat configuration or the valve actuated alternative key of F configuration to produce music in any pitch on the chromatic scale and within performing range of the trombone is further accomplished by moving the right hand operated outer hand slide assembly (74, 75) in selected increments over an approximate 18 inch range of linear assembly motion which yields an approximate 36 inch range of air path extension, in combination with engagement or disengagement of the valve (85, 170) via the left thumb trigger (84, 181). The "missing" or "pedal gap" range from low E-flat to low B-natural is thereby filled in, and a variety of alternate hand slide positions in the main performing range is further created by use of this valve section, which enhances ease of performance and facilitates execution of technically more difficult musical passages in certain musical works by reducing the required motion of the hand slide in certain instances.

The above discussion of FIGS. 4A–D applies to selected models of medium and large bore B-flat tenor slide trombone, and to essentially all models of B-flat bass slide trombone. However, another distinguishing feature of B-flat bass slide trombones (versus B-flat tenor slide trombones with the indicated "F-attachment") is that the B-flat prior art bass slide trombones will generally have a larger internal inner hand slide tube (113) and valve section bore such as 0.562 inch, 0.565 inch, 0.582 inch, 0.594 inch, 0.603 inch, and at most 0.625 inch bore for the valve (85, 170) and the alternative key of F tubing loop (86–88, or 172–175) in various brands and models of the prior art B-flat bass slide trombone, whereas these bores are relatively smaller for the B-flat tenor slide trombones employing F-attachment.

FIGS. 5A–D illustrate another distinguishing feature which an increasing number of models of B-flat bass slide trombone employ, the distinguishing feature being addition of a second valve (97 or 169) and a second alternative length extension tubing loop (99, 103, 100, 104, 101, or 177–179) which is shorter in length, being approximately 28 inches in length and converting the bass slide trombone to the key of G-flat when independently activated alone using left middle finger trigger (94; see especially FIGS. 5B–D, items 188–199 for a more detailed example of a left middle finger trigger and G-flat rotary valve linkage), or converts the bass slide trombone to the key of D when activated simultaneously with the first valve (85, 170) in FIGS. 5A–D. When both the FIGS. 5A–D valves (85, 97, or 170, 169) are simultaneously activated using both of the triggers (84, 95, or 181, 188) and attached rotary valve linkages, then both of the alternative path tubing loops (86–88 and 99, 103, 100, 104, 101, or 172–175 and 177–179) are placed in series with one another and in series with the main path tubing (82, 98, and 102 or 171, 176, and 180) to lengthen the overall air path such that the musical key is altered to either the key of D or the key of E-flat, depending on whether the length of the second alternative length extension tubing loop (99, 103, 100, 104, 101, or 177–179) is approximately 28 inches, corresponding to the key of G-flat, or the length extension tubing loop is shorter yet being approximately 20 inches long, and corresponding to the key of G, respectively. Only bass slide trombones are made with the two rotary valves. Tenor slide trombones have either no valve or just the one F-valve. Double valve bass slide trombones create a second set of alternative telescoping hand slide positions throughout the performing range, with the second set of alternative slide positions being particularly useful in lower octave playing, beginning for example with a low D (below the bass clef staff and progressing downward in half step increments to low B-natural or pedal B-flat (first B-flat below the bass clef staff). Additional double valve utility may be found from double pedal D (DD) to double pedal B-flat (BB-flat), although this range is rarely performed.

FIG. 6A illustrates the internal design, rotary linkage (184) connection (185), rotary stop (215), and cork or rubber stop pads (226) of the most commonly employed type of prior art rotary valve (85 and/or 97 in FIGS. 4A, 5A) shown in a bottom exploded FIG. 6A view. Rotary stop pads (226) engage rotary stop (215) at the ends of rotary travel of the valve and define two rotary operating positions in which the valve is either engaged or disengaged from an alternate external length extension tubing loop path. Rotary stop (215) of FIG. 6A is the same as rotary stops 186 and 198 in FIGS. 4C–D and 5C–D, however the FIG. 6A rotary stop pads (226) have been omitted for purposes of viewing clarity of other features in FIGS. 4B–D and 5B–D. The trombones of FIGS. 4B–D and 5B–D however typically have rotary stop pads (226) as in FIG. 6A, even though they are not shown in FIGS. 4B–D and 5B–D.

FIG. 6A also shows the rotor (147), cutaway air passages (148, 149), rotor spindles (227), spindle bushings (231, 232), thrust bearing (230), end plate (228) and performer neck guard cover (229). It should be noted that the most commonly employed prior art rotor (147) design in FIG. 6A provides an air path or air paths (rotor cutaways 148, 149 bounded by valve casing (151) cylindrical side wall (150)) which is/are only partially round, so a cross sectional shape mismatch occurs between the rotor air passages and the external round valve ports and tubing (221, 222) connections (See also round tubing connections 82, 86, 88, 98, 99, 101, and 102 in FIGS. 4A and 5A and round tube connections 171, 172, 175, 176, 177, 179, and 180 in FIGS. 4B–D and 5B–D). The cross sectional shape mismatch creates an approximate 30% air flow obstruction (148, 149) through the FIG. 6A most commonly used prior art valve rotor (147), regardless of whether the rotor position or the rotor positions are set for the main B-flat air path alone, or for the alternate F, G-flat, or D air paths. In the normal prior art B-flat bass trombone valve bores of 0.594 inch, or less, the 30% air flow obstruction is known to create back pressure, reduce performance responsiveness, and suppress certain desirable bass frequency overtones, creating the impression of "stuffiness" in the playing and the sound quality. The prior art FIG. 6A valve "stuffiness" is only overcome by the greatest of bass slide trombone performer skill, training, and effort, and is generally only overcome by the most accomplished of the performers, such that less accomplished performers do not sound nearly as good, and the less accomplished performers may feel frustrated in their low octave performing ability.

For the reasons of air flow obstruction and the performance stuffiness of the conventional prior rotary valve designs, many bass slide trombonists have for many years simply avoided using "independent" double valve bass trombones such as illustrated in FIGS. 5A–D, because the air flow obstruction and the performance stuffiness problems are twice as bad with two in-line independent valves as in FIGS. 5A–D, even in the key of B-flat when the FIGS. 5A–D valves (85, 97) are not engaged and the alternative F and the alternative G-flat length extension tubing loops (86–88 and 99, 103, 100, 104, 101) are completely bypassed, and many bass slide trombonists have therefore elected instead to use only a single valve bass slide trombone or a "dependent" double valve bass slide trombone in which the two valves are of the "dependent" double valve bass slide trombone, is not in the air path and the dependent path is not even accessible to an air flow until a first of the two valves of the dependent double valve bass slide trombone is engaged, such that only when the first valve is engaged does the second dependent valve receive any air flow, the prior art dependent double valve scenario having advantage over the prior art independent double valve system in that the extra stuffiness due to two valves is only encountered with both valves engaged in the dependent system, whereas both valves contribute to stuffiness problems all the time with the independent in-line double valve bass slide trombone. The dependent double valve B-flat bass slide trombone has, however, only two alternative fundamental keys, such as F and D or F and E-flat, whereas the FIGS. 5A–D independent double valve B-flat bass slide trombone may have three available keys, such as F, G-flat and D, or F, G, and E-flat, giving performers a greater range of available alternative slide positions to enhance ease of performance with fast moving, technically difficult musical passages.

More recent prior art rotary valve designs by, for example, Thayer (U.S. Pat. Nos. 4,112,806, 4,127,052, 4,213,371, 4,299,156, 4,469,002, 4,905,564), Greenhoe (U.S. Pat. No. 5,686,678), the standard rotary valves of the S.E. Shires Co. (Hopedale, Mass., USA), and of Rene Hagmann (Geneve, CH) have alleviated the cross sectional shape mismatch between the FIG. 6 rotor (148, 149) and the external tubing connections (221, 222) such that back pressure has been reduced to varying degrees, but not completely eliminated in the B-flat bass slide trombones based on the prior art valve designs, prior art valve bores, and prior art slide bores. In U.S. Pat. Nos. 4,112,806, 4,299,156, and 4,469,002 to Thayer, for example, the rotary valve is used as positioned along the air flow path of a slide trombone, where the rotary valve serves to direct the air through either the main air conduit or to divert air into a secondary length extension tubing loop and thus back into the main air conduit and to the instrument bell. The rotary air valve is positioned in the air flow path with the valve apertures and conduits positioned generally parallel to the axis of rotation of the valve rotor. Also, the air flowing through a rotor conduit positioned along the axis of rotor rotation must turn radially and axially through the rotor before reaching the main bore.

More recent prior art rotary valve designs such as the "generic" curved tunnel design are shown in FIGS. 6B–C, which has elements of both Greenhoe and S.E. Shires designs. FIG. 6B shows two curved tunnels (148, 149) each directed back into the plane of the drawing with rotary linkage (184, 185, 215) positioning rotor (147) in the engaged second of two operating positions, such that one end (each) of both curved tunnels (148, 149) are visible. FIG. 6C shows the FIG. 6B valve with rotary linkage (184, 185, 215) positioning rotor (147) in the disengaged first of two operating positions such that both ends (149, 303) of the same curved tunnel (and only one tunnel) are visible. The curved tunnel FIGS. 6B–C valves are closer to "intact duct" valves and are substantially improved over the FIG. 6A straight tunnel prior art rotary valve design, and have reduced but not completely eliminated the need and the tendency for bass slide trombonists to limit themselves to single valve or dependent double valve bass slide trombones, such that sales and performance of the independent double valve bass slide trombone are gaining on the single valve bass slide trombone and are overshadowing sales of the dependent double valve bass slide trombone.

To begin detailed illustration of the operation of rotary valves in selecting between a main air path and a secondary length extension tubing loop path, FIG. 7A is a cutaway side view of a single F-valve section from FIGS. 4A–D. (See entry port 171, valve 170, exit port 176, and external length extension tubing loop 172–175 in FIGS. 4B–D, which is an external perspective view of the valve section represented in the cutaway side view of FIG. 7A.) The rotor (147) of FIG. 7A valve (170) is the type of rotor shown earlier in FIG. 6A. FIG. 7A shows the valve (170) in its disengaged first of two operating positions, in which vibrating air enters from the main instrument path (82) at port (171) and then simply skips directly through rotor passage 149, as indicated by the passage (149) arrow and exits the valve directly at 176 to continue in the main instrument path (83, 98), having completely bypassed external secondary length extension tubing loop (172–175) in this disengaged first of two valve operating positions.

FIG. 7B is the same as FIG. 7A, except that the valve has been "engaged" by rotating rotor 147 by 90 degrees counter clockwise in this non-limiting example. (Actually a clockwise rotation is also common, but not required, and a counterclockwise rotation is illustrative in this case, solely for the purpose of maintaining the same air passage numbers which were utilized in FIG. 6A, however a clockwise 90 degree rotation would serve the same air flow effect and is also commonly used in practice—this is not an important point). With the valve rotor (147) in the FIG. 7B illustrated engaged second of two rotary operating positions, main path air entering at 81 and 171 is diverted by rotor passage 148 to secondary length extension tubing loop 172–175. Air traversing this loop in the directions indicated by the FIG. 7B arrows re-enters the valve rotor at 175 and rotor passage 149 restores it to the main path flow at 176, 83, and 98.

FIG. 8A is the same as FIG. 7A, except that the FIG. 8A rotor (147) is an improved curved tunnel rotor of the type illustrated in FIGS. 6B and 6C. Rotor internal air passages (148, 149) are more clearly seen as curved tunnels in FIG. 8A. (FIGS. 6B–C also indicate that these curved tunnels (148, 149) are essentially round or only slightly elliptical in their cross-sectional aspect.)

FIG. 8B is the same as FIG. 7B, except that FIG. 8B rotor (147) is an improved rotor of the type illustrated in FIG. 6B. Rotor internal air passages (148, 149) are seen as curved tunnels in FIG. 8B. (FIGS. 6B–C also indicates that these curved tunnels (148, 149) are essentially round in their cross-sectional aspect.) FIG. 9A is the same as FIG. 8A, except that external secondary length extension tubing loop 172–175 is routed differently. It is connected the same, but the loop is simply bent in a different curve, which has no impact on musical key or pitch, especially considering that there is no air in the loop with the FIGS. 9A and 8A valves bypassing this loop altogether and proceeding directly from 171 to 176. Also shown in FIG. 9A is a second valve (169) such as would be employed in FIGS. 5A–D, however the secondary length extension tubing loop (172–175) routing has been altered in FIG. 9A to relieve mechanical interference between this loop and the second valve (169) tubing (177, 179). The secondary length extension loop (172–175) in FIG. 9A is bypassed and receives no air with valve 170 in its illustrated disengaged first of two rotary operating positions, as illustrated by the air flow arrows in the figure. Secondary length extension tubing connections (177, 179) to the second valve (169) have been omitted from the figure for simplicity of inspection of the rest of the figure. The second valve (169) is also shown in its disengaged first of two operating positions.

FIG. 9B is the same as FIG. 9A, except that the first valve rotor (147) has been rotated 90 degrees to divert air into and through the secondary extension tubing loop (172–175) with the valve in its engaged second of two rotary operating positions, as indicated by the air flow arrows in the figure. Such was also the valve operating and air flow condition in FIGS. 7B and 8B. Secondary length extension tubing connections (177, 179) to the second valve (169) have been omitted from the figure for simplicity of inspection of the rest of the figure. The second valve (169) is still shown in its disengaged first operating position.

FIG. 10A is the same as FIG. 9A, with addition of a second external secondary length extension tubing loop (177–179) attached to the second valve (169). Note that both valves (170, 169) are in their disengaged first of two rotary operating positions, such that air enters at 82 and skips directly through from 171 to 176 to 180 and bypasses both secondary length extension loops entirely, as indicated by the air flow directional arrows in the figure. In this case both valves are disengaged, both length extension tubing loops are bypassed, and the fundamental bass slide trombone key remains B-flat.

FIG. 10B is the same as 10A, except that only the first valve (170) has been rotated 90 degrees to its engaged second of two rotary operating positions. The second valve (169) remains in its disengaged first rotary operating condition. In this configuration the air flow direction arrows indicate that air is diverted from the entering main path (82, 171) through the first length extension tubing loop (172–175), which is typically approximately 36 inches long and is called the F loop or F length extension path, but air leaving the first valve (170) at 176 is not diverted by the second (disengaged valve (169), so it bypasses the second length extension tubing loop (177–179—called the G-flat loop for loop lengths of approximately 28 inches, or alternatively it is called the G loop for lengths of approximately 20 inches) in this case and simply skips directly from 176 to 180 and exits the valve to the main path continuation at 102. In this configuration, the bass slide trombone has been converted to the fundamental musical key of F.

FIG. 10C is the same as 10A, except that the second valve (169) has been engaged (second operating position) to divert main path air through the second external secondary length extension tubing loop (G-flat or G-loop, 177–179) as indicated by the air flow direction arrows. In this case the F-loop has been bypassed, but the G-flat (or G) loop has been activated, and the bass slide trombone has been converted to the fundamental musical key of G-flat or G (depending on loop 177–179 length).

FIG. 10D is the same as 10C, except that both valves (170, 169) are engaged (both in the engaged second rotary operating position) such that air is diverted through both the F loop and the G-flat (or G) loop, combining the two loop lengths and converting the bass slide trombone to the musical key of D or E-flat (depending on loop 177–179 length being either approximately 28 inches, or approximately 20 inches, respectively).

Although in the past 100 years, advances have been seen in B-flat bass slide trombone design and performance characteristics, B-flat bass slide trombones have basic bore characteristics requiring significantly larger mouthpieces than tenor trombones. The combination of bass trombone bore and mouthpiece dimensions is so radically different from tenor trombone, that a majority of junior high (middle school), high school and even many college student trombonists do not successfully make the transition from tenor trombone to bass trombone, with a sound that can be heard in large jazz bands. There are exceptions of course, but the majority of students simply do not form the proper embouchure, or develop the necessary embouchure strength, flexibility, and breath control to play loudly and fluently throughout the performing range on a bass trombone. It must also be said that a proper bass trombone embouchure (positioning and tensioning (pursing) of the lips in a certain way to form a lip slit aperture of certain surprisingly small dimensions, supported by the requisite surrounding facial muscular tone, surrounding muscular rigidity, and surrounding muscular directional positioning in such a way as to firmly support a proper bass trombone lip slit aperture which however remains small, soft, pliable, and flexible at its center, as well as positioning of the jaw to eliminate overbite and create a certain precise, reproducible opening space between the teeth, and positioning and action of the tongue) is generally radically different from the tenor trombone embouchure which is typically taught to most young students when they first learn to play. The typical tenor trombone embouchure taught in most school music programs will simply not yield loud, fluent bass trombone playing throughout the performing range, despite the students' best efforts. It is generally too "smiley", has insufficient and poorly directed surrounding facial muscle support, yields a lip slit aperture which is too large, has the jaw too far open, and is often plagued by overbite. Though it is certainly possible to teach a correct bass trombone embouchure, the reality is that this embouchure is not widely known by school band directors and instructors, and it is in fact generally known only to a surprisingly small number of trombone teachers, who typically happen to be excellent bass trombonists themselves, or once were bass trombonists. Since these particular specialty teachers are in the small minority, and the correct bass trombone embouchure is nearly impossible to adequately describe in printed words, the majority of trombone students never receive proper bass trombone instruction and never learn a bass trombone embouchure or a degree of breath control that will enable them to play loud and fluent bass trombone throughout its performing range. The vast majority of school jazz bands therefore do not have a bass trombonist who can be heard by audiences while the rest of the band is playing. Only a very few student bass trombonists either "stumble" on the right embouchure by "luck" while they experiment, or are lucky enough to have an unusual teacher who is a good bass trombonist and can systematically help the student develop the right embouchure set, embouchure strength, flexibility, and breath control to play bass trombone sufficiently loudly to be heard throughout the performing range, within a school jazz band. Even these few are likely to have learned this on their own or from a specialty private teacher, rather than the school band director, and they eventually graduate from the school without passing their knowledge on to another student, thus leaving behind a position in the band which may not be filled again with another strong student bass trombone player for years. This situation has improved only slightly in the past 100 years, so there remains a need to improve the loudness and fluency of bass trombone playing in school jazz bands nearly everywhere that they exist.

There remains also a need for more complete elimination of the air flow back-pressure and the performance stuffiness associated with prior art combinations of B-flat bass slide trombone valves, valve bores, and slide bores, and there also remains a desire for yet greater improvement in low octave performance responsiveness, greater improvement in low octave bass frequency response in B-flat bass trombones, and a desire for bass trombone-like instruments with louder more fluent playing capability for student musicians, with or without the valve or valves engaged.

Normally, louder playing may be achieved in the bass range with a larger bore brass instrument employing a larger mouthpiece such as the tuba illustrated in FIG. 11A, and with tuba players who have an embouchure development and breath control trained for and better suited to this larger mouthpiece and larger instrument bore than trombonists who are only accustomed to and properly trained for smaller mouthpieces and smaller instrument bores. Owing to a substantial conical bore expansion over most of its length, the tuba has greater amplifying power, and is much easier to play than bass trombone, which is of smaller bore and maintains an essentially constant cylindrical bore over a middle section of air path following an initial tapered lead pipe comprising approximately the first 8% of instrument length. The middle essentially constant cylindrical bore section of trombones typically comprises approximately 56% of total instrument main air path length. The tuba embouchure is also much easier to form and there is vastly improved understanding of (and familiarity with) the tuba embouchure by school band instructors, in general. Tubas and student tuba players are generally capable of more consistently providing the extra playing loudness required in the bass range of a jazz band brass section. However, a radical and pervasive conical bore expansion progresses over approximately 88% of the length of the tuba (see FIG. 11B, which is a rotary valve BB-flat tuba with valve tubing and linkages removed for uncluttered inspection of the main 216 inch BB-flat path and its conical bore expansion which begins in the lead pipe (5, 6) and is only briefly interrupted by a short section of valves (46–49) and valve interconnect tubing before resuming at 8 and being only briefly interrupted once more for the tuning slide (29) before continuing at 9 and proceeding to expand continually thereafter to the large bell flare (24). The very large tuba bell throat (20, 23) dimensions measuring, for example, approximately 7 inches in diameter at a point 10 inches back from the bell flare (24) end of a Miraphone 4/4 S186 BB-flat tuba, and the pervasive conical bore expansion collectively make tubas more amplifying and easier to play, but also give them a "tubby" sound quality. They are easy to play loud and fluently, but due to the very large bell throat and due to having only approximately 12% of overall main path instrument length in cylindrical bore tubing, they sound "tubby" and do not sound at all like a bass trombone. They do not blend well tonally with a jazz trombone section. Tubas are therefore normally excluded from modern school jazz bands.

It is however useful for the purposes of this patent to explore other possibilities for taking advantage of the power and consistently loud and fluent playing that most student tubists' embouchure training and breath control is inherently capable of delivering in bass range brass instrument playing. For example, instead of using an actual tuba which is loud, but has a conical bore expansion over most (approximately 88%) of its tubing length and has a very large bell throat (see 23 in FIG. 11A), and which produces the wrong tone quality for jazz trombone sections, the student tubist might conceivably be given another three valved or four valved bass brass instrument on which they might also perform loudly, but which has an essentially constant cylindrical bore over a majority (for example approximately 56%) of this instrument tubing length, and which further has a smaller throated bell, less than 3 inches in throat diameter, measured 10 inches back from the end of the bell flare, collectively yielding a tone quality which sounds like a powerful bass trombone. Modern piston valve B-flat trombones and B-flat marching trombones such as the ones seen in FIGS. 1B–D exhibit a cylindrical bore, following a tapered lead pipe, pervading over approximately 56% of their length and have a conical bore expansion progressing only over the remaining 44% of their length, and they also have small bell throats (23), but they are far too small in cylindrical bore size to fill this need in the bass performing range, and they only have three valves which, when pitched in B-flat with 108 inches of main path tubing as they normally are, leaves an unacceptable range of missing musical notes from low E-flat to low B, which renders jazz bass trombone playing impractical on these instruments. A few prior art three-valved trombones with main paths pitched in F were produced many years ago by Besson, but this trombone exhibited far too small of a cylindrical bore (0.485–0.535 inch bore) to perform well as a bass trombone, and it has been largely abandoned for lack of interest and utility. It was furthermore missing notes in the range of pedal B-flat to pedal G-flat and from BB-flat to GG-flat, but the main difficulty is that student tubists generally do not know valve fingering patterns for performing on F instruments while reading "concert key" music, so this historical valved F trombone by Besson is also unsuited to modern jazz bass trombone playing by student tuba players. However, larger cylindrical bore (and maintaining the large cylindrical bore over at least approximately 45% of main path tubing length) prior art instruments with four or five valves, and which can be performed loudly by tubists, and which do not have a missing range of bass notes, and which can blend tonally with trombone sections, are available in the form of the contrabass valve trombones or cimbassos pitched in E-flat or F and made by Rudolf Meinl, Meinl-Weston, Thein, and Kalison, and which are currently used on the fourth trombone part in operatic pit orchestras for the works of Verdi, Puccini, and Wagner.

Though cimbassos and contrabass valve trombones are unfamiliar to a majority of student musicians and school band directors, descriptions of prior art cimbassos and contrabass valve trombones, including E-flat and F-cimbassos and the original historical BB-flat "Trombone Basso Verdi" (also classified as a BB-flat contrabass valve trombone or BB-flat cimbasso) may be found in T.U.B.A Journal (volume 23, number 2, winter 1996, pp. 50–53), in "The New Grove Dictionary of Music and Musicians, e.d Stanley Sadie, Macmillan Ltd, London, 2001, v.5 (pp. 856–858), and on the Edinburgh Museum website (http://www.music.ed.ac.uk/euchmi/ucj/ucjth3.html, see especially exhibit 2532 which may be directly accessed at http://www.music.e-d.ac.uk.euchmi/ucj/ucjg2532.jpg), and also on corporate internet websites of the Meinl-Weston, Rudolf Meinl, and Thein companies in Germany. These cimbassos and contrabass trombones, as illustrated in FIGS. 12 and 13 and as first conceived by Verdi and first produced for him by Pelitti in 1881 are valved instruments playable by tuba players and they could theoretically yield a powerful bass trombone sound capable of blending tonally with modern jazz trombone sections, however cimbassos with trombone shaped bells are currently only available in the musical keys of E-flat and F (~144 inch total main path tubing length), for which typically only professional tuba players and tuba performance majors in music schools (at colleges and universities) are motivated to learn the valve fingerings. There is a CC cimbasso by Rudolf Meinl, but it has a euphonium shaped bell, does not sound like a bass trombone, and the CC fingerings are generally known only to professional tubists and tuba performance majors.

Middle school and secondary school student tuba players or "non-major" tubists at small colleges would have the required "wind" to play an F cimbasso or F contrabass slide trombone loudly, but they typically only know BB-flat or B-flat valve fingerings, and virtually none of them know any trombone slide positions at all. Student tubists (middle and secondary schoolers and college non-majors) generally do not know CC, E-flat, or F cimbasso valve fingerings, and they are generally not likely to invest the time to learn either trombone slide positions or the CC, E-flat, or F cimbasso valve fingerings for the school jazz band. F cimbasso fingerings in particular are also very awkward in rapid moving passages from pedal B-flat to pedal G-flat. For example the bass range chromatic sequence (below the bass clef staff) of B-flat, A, A-flat, G, and G-flat would be fingered 54, 234, 134, 5134, and 51234, respectively on an F-cimbasso, and this is quite an awkward pattern for anyone to play quickly. It also uses many more fingers than the simple finger pattern 0, 2, 1, 3, and 23, respectively for the same chromatic note progression, and which students already know for the BB-flat tuba.

It is clear that any instrument which it is hoped that student tuba players (middle schoolers, secondary schoolers, and college non-majors) and their band directors will universally accept for them to play, in order to replace the bass slide trombone in school jazz bands should, for practical purposes of widespread acceptance by the music education market, should be a three or four valved instrument with a trombone shaped bell, and should be pitched in BB-flat or B-flat, and should not be pitched in the typical available prior art cimbasso keys of CC, E-flat, or F, so this excludes virtually all present day cimbassos from widespread market acceptance in replacing the jazz bass slide trombone in school jazz bands. Prior art E-flat, F, and CC cimbassos are therefore not used in school jazz bands, owing to a lack of student tubist knowledge and familiarity with E-flat, F, and CC valve fingerings, and to the "tubby" sound of large throat CC cimbasso bells.

Historically, there once were BB-flat cimbassos and BB-flat contrabass valve trombones. The original "Trombone Basso Verdi" conceived by Verdi and produced for him by Pelitti in 1881 was actually in the key of BB-flat. These early instruments were, in fact, all in the fundamental musical key of BB-flat which is the key and has the valve fingerings most familiar to student tubists in today's secondary and middle schools. However, these historical BB-flat instruments were all very difficult to blow, due to large single-valued constant cylindrical bores persisting over great length (e.g. approximately 190 inches) and which do not yield much amplification. Without the amplifying power of a gradual conical bore expansion or a modestly stepped cylindrical bore progression, these instruments were difficult to blow and generally the player would have to blow very hard to get a good sound. The player would then tire quickly and it was also difficult to play softly with a good tone quality. Due to bore-related blowing difficulties and a general lack of foresight concerning potential future application in today's big student jazz bands, recognizing that jazz bands did not exist in the time of Verdi and Pelitti, these Italian BB-flat "Trombone Basso Verdi's" or BB-flat contrabass valve trombones originating in 1881 were abandoned in the 1930's and are no longer used by either music students or professional musicians of today. They have been relegated to museums. Today's professional cimbasso players are generally operatic tubists who primarily use the better designed, but still somewhat difficult to blow, modern E-flat or F cimbassos in operatic pit orchestras. The fact that many trombonists today have not seen and don't know about F or E-flat cimbassos may be due to their nearly exclusive use in professional operatic pit orchestras, where the orchestra is hidden from view, and also due to the fact that normally a tuba player plays the F-cimbasso in the operatic pit, rather than a trombonist. So, tubists are actually more familiar with the modern F and E-flat cimbasso than trombonists.

Prior art cylindrical bore BB-flat brass instruments generally play or played poorly, and most have been abandoned to museums. The few remaining BB-flat contrabass quadroslide trombones are very "clumsy" and are only produced in very small numbers (probably less than two or three per year world-wide by Thein, Haag, and Miraphone) and are generally terrible playing and bad sounding instruments due to non-optimized cylindrical slide bores which are generally too small, despite what their manufacturers and a very small selected minority of "eccentrics" may claim. There remains a need for a BB-flat cylindrical bore brass instrument with optimized bores and amplifying bore progressions, and a trombone shaped bell which blows easily (responsively) and consistently plays well and sounds good. There further remains a need for a valved BB-flat or CC instrument, playable by tuba players, and which is responsive, easy blowing, and which sounds like a good, powerful bass trombone rather than a bad baritone, a poor euphonium, or a cheap tuba. The BB-flat instrument is needed by student tubists for jazz bands. The CC instrument would be greatly appreciated by professional operatic tubists.

In order for student tubists to replace student bass trombonists in school jazz bands, there finally remains a need for development of a bass valve trombone or contrabass valve trombone or cimbasso which has a bore and an amplifying cylindrical bore progression over a majority of its tubing length, and a mouthpiece which allows the instrument to be played loudly, fluently, and easily by student tuba players, having a tone quality similar to that of a powerful bass trombone so as to blend tonally with jazz trombone sections, and being pitched in musical keys such as 216 inch BB-flat or 192 inch CC for which student tuba players and professional operatic tubists, respectively, may already know the valve fingerings. There finally remains a desire to shorten valve stroke, reduce valve friction, improve valve operational smoothness, reduce required valve spring tension, enable a more nimble-fingered musical performance, and lighten the overall weight of a BB-flat instrument to be used for sectional jazz bass trombone playing, or of CC, F, or E-flat instruments to be used in operatic pit orchestras.

Alternatively, a need remains for a 108 inch B-flat bass valve trombone with at least four valves and a cylindrical bore or amplifying stepped cylindrical bore progression over a majority of its length, and a bell shape to maintain an acceptable bass trombone tone quality, along with a mouthpiece which, in combination with a cylindrical bore or amplifying stepped cylindrical bore progression which eliminates backpressure issues of prior art B-flat valve trombones and bass slide trombones and which allows a student tuba player to play easily, loudly, and fluently with a minimum of relearning required in terms of either embouchure, breath control, or valve fingerings. There further remains a need for addition of a fourth valve to create a 108 inch B-flat bass valve trombone, and the fourth valve would fill in the missing range from low E-flat to low B, however with a simple 4-valved invention instrument it is recognized that there would be severe tuning issues arising in the range of low E-flat to low B.

In any B-flat low brass instrument, such as a prior art euphonium, or the valve trombone of FIGS. 1B–C, valves 1–3 (V1–V3; 46–48) normally have corresponding external length extension tubing loops (32, 35, 37) which chromatically alter the pitch when the valves are engaged. These loops are of length dimensions to provide reasonably accurate tuning for desired tuneful chromatic pitch alteration from the main key of B-flat, and each loop progressively provides an appropriate approximate 5.946% "compounding" percentage length extension beyond the basic B-flat 108 inch tubing length to give the desired tuneful chromatic pitch alterations from the fundamental B-flat key. However, when valve 4 (V4) of a simple B-flat 4-valved euphonium is engaged to facilitate the bass range from low E to low B-natural, suddenly the instrument is lengthened to 144 inches of total tubing and becomes pitched in the musical key of F. Further engaging of simple euphonium valves V1–V3 simultaneously with valve V4 means that the same three external tubing loops are added to the main path, however, they are now added to a 144 inch F path rather than a 108 inch B-flat path, and since they are not correspondingly longer themselves, they represent a smaller (and incorrect) percentage length extension beyond 144 inches than the extension they made, when engaged, beyond 108 inches. Because the percentage length extension of valve loops 1–3 is reduced in they key of F with V4 engaged, the chromatic intervals are therefore "wrong" and the V1–V3-altered pitches (with V4 also engaged) are too "sharp", since the external length extension tubing loops of valves 1–3 are too short to give the same percentage length extension beyond a 144 inch F total as they did beyond a 108 inch B-flat total. This is a classic B-flat 4-valve euphonium tuning issue, and it explains why prior art bass valved instruments are almost never pitched in B-flat. The simple prior art euphonium is typically used for higher pitched (tenor range) playing in ensembles, and the bass range of low E-flat to low B is typically not scored for euphonium in ensemble works.

In a BB-flat tuba, the overall main path tubing is twice as long (~216 inches) and the fundamental pitch is an octave lower, so this particular tuning problem—namely combinations of valves 1–3 with valve 4, is also deferred one octave lower, where even tuba music is only rarely written. So for BB-flat tubas, the tuning issue associated with combinations of valve 4 with valves 1–3 is deferred to a lower octave, low EE-flat to low BB, where performance is rare, even for the tuba. Rarity of performance in this range makes the tuning issue relatively unimportant for BB-flat tubas. When occasionally confronted with performance below a low EE, 3-valve BB-flat tuba players will "ghost" the notes or play the passage an octave higher, and astute 4-valve BB-flat tuba players will just finger the passage a half step flatter than written, while "'lipping' the pitch 'up'" by an automatic gentle tightening of the embouchure in cases where a half step lower fingering is actually too much flattening of the pitch to compensate for excessively short valve tubing loops for the range EE-flat–BB-natural.

In a simple B-flat 4-valve euphonium, the tuning issue is severe from low E-flat to low B, but euphoniums are not normally used for bass range band and ensemble playing, and their parts are typically written much higher, instead. The problem is thus simply avoided for ensemble playing by playing the simple euphonium in higher ranges where V4 isn't needed, and the low E-flat–B tuning problems do not arise.

It is primarily in in euphonium solo works where the low E-flat–low B range may be encountered, and for this purpose a tuning "compensation" system has evolved for better quality euphoniums, originating with the 1891 U.S. Pat. No. (457,337) of Fountaine Besson. With compensated euphoniums, more complex valves with extra internal passages are employed to reroute air for additional detouring through a second set of external length extension tubing loops when valves 1–3 are engaged simultaneously with valve 4. This is illustrated for a prior art compensated in-line four piston valve euphonium in FIGS. 14A–C. It should be noted that this particular compensated Willson model 2975 euphonium is a little unusual and was chosen for illustration because the unusual four-in-line piston valve arrangement is pertinent to tuba players. In B-flat, with only valves 1–3 engaged (46–48), the first set of tubing loops (32, 35, 37) is active and the second set (32F, 35F, 37F) is bypassed. When valve 4 (49) is engaged simultaneously with valves 1–3 (46–48), the instrument is automatically converted to the key of F, and the second set of external length extension tubing loops (32F, 35F, 37F) adds length remotely in series with the first set (32, 35, 37) so that a well tuned chromatic pitch alteration is made as a proper percentage increment to 144 inches (key of F), rather than to just 108 inches (key of B-flat). So when V1 (46) and V4 (49) are both engaged, the secondary V1 tubing loop (32F) adds its length remotely in series to the primary V1 tubing loop (32), and both V1 loops (32, 32F) are active. The same goes for V2 (47) and V3 (48) when engaged simultaneously with V4 (49). Both sets of external tubing loops (32, 35, 37, and 32F, 35F, 37F) are active whenever V4 (49) is simultaneously engaged with V1–V3 (46–48) in single or multiple combinations.

Compensated euphoniums are thereby well tuned, even in the range of low E-flat to low B, but they still exhibit a conical bore expansion over a majority of their 108 inch main B-flat path, and they have a large bell throat diameter. As a result they sound somewhat "tubby" and do not have the right tone qualities to blend adequately with a jazz trombone section. Also, as the V1 drawing of FIG. 4C illustrates, the internal valve piston complexity of compensated 4 valve euphoniums is such that air may traverse up to fourteen different internal valve piston passages for engagement of all four valves for a low B-natural, versus only eight internal piston passages for a low B-natural in a simple 4 piston valve euphonium. The inherent stuffiness incurred with euphonium piston valves is therefore multiplied by passage through up to six extra valve ports and six extra piston passages to play a low B-natural in a compensated four valve euphonium, and therefore compensated euphoniums play "stuffy" and exhibit significant back-pressure from low E-flat to low B. Simple 4 valve euphoniums do not necessarily play stuffy in that range, but they are badly out of tune (on the sharp side). Alternate fingerings (one half step lower than normal) may be applied from low E-flat to low C on a simple 4-valve euphonium such that low C is played Pitches must still be corrected by the embouchure, low B-natural is not accessible, and the alternate fingerings are not widely known by students.

As an "aside", there remains a need for a B-flat euphonium with at least four valves to access the range from low E-flat to low B, and being able to do that without being out of tune, without requiring alternate fingerings combined with radical embouchure pitch corrections, and without developing excess back-pressure leading to stuffy performance characteristics in this range. This "aside" is for euphonium players only, and even if the euphonium need were to be met, such an improved euphonium would still not address the bass trombone need in school jazz bands, because the euphonium tone quality does not suit the bass trombone needs of a jazz trombone section.

There finally remains a need for a B-flat bass valve trombone with at least four valves to access the range from low E-flat to low B, and being able to do that without being out of tune or developing excess back-pressure leading to stuffy performance characteristics. The B-flat bass valve trombone should have a cylindrical bore or bore progression over a majority of the 108 inch main air path which maintains easy blowing characteristics for bass trombonists or tubists, and which has a powerful bass trombone tone quality, loudly playable by student tubists or strong bass trombonists, or student euphonium players, and which has a bell throat dimension which collectively creates a sound quality that blends tonally with modern jazz trombone sections.

A need also exists for a 3 valve B-flat tenor trombone which blows more responsively and may be more aptly playable by extra trumpeters and euphonium players in school jazz bands, where insufficient numbers of tenor slide trombonists exist to fill the ranks.

SUMMARY OF THE INVENTION

This invention relates generally to novel 108 inch B-flat bass valve trombones, cimbassos, and Tu-Bones, contrabass 216 inch BB-flat, 192 inch CC, 162 inch E-flat, and 144 inch F valve trombones, cimbassos, and Tu-Bones, and application of an invention "inverted full double horn" principle to solve tuning issues from low E-flat to low B-natural in 108 inch B-flat/F bass valved instruments such as B-flat euphoniums and invention B-flat/F bass valve trombones, cimbassos, and Tu-Bones, without incurring performance "stuffiness". The invention also relates generally to unique tubing bore dimensions and progressive cylindrical bores, or gradual conical bore expansions, or combinations of gradual conical expansion and cylindrical bore in all pertinent keys (F, E-flat, CC, BB-flat, and B-flat valve bass and contrabass trombones, cimbassos, and Tu-Bones, as well as B-flat tenor valve trombones), as well as bell throat and flare dimensions in CC cimbassos and Tu-Bones, and arrangements and combinations useful for enhancing the tonal qualities and responsiveness of B-flat, BB-flat, F, E-flat, and CC bass and contrabass valve trombones, cimbassos and Tu-bones, yielding powerfully responsive bass valved brass instruments with tone qualities that blend well with jazz trombone sections or operatic trombone sections and in which certain embodiments are preferably fundamentally pitched in musical keys BB-flat and B-flat for which student tuba and euphonium players already know the valve fingerings, such that relearning requirements are minimal or nonexistent in allowing student tuba or euphonium players (as new Tu-Bone "doublers") to replace bass slide trombonists in school jazz bands. Three valve B-flat tenor trombones may also be enhanced by novel invention bores and bore progressions and these are also included in the scope of invention.

Because the name cimbasso is a misnomer regarding modern instruments (the name cimbasso actually refers to an ancient wooden instrument with "fingers-covering-holes" and a metal bell flare, but without any valves (see Grove, 2001, p. 856), the present patent authors prefer the name "Tu-Bone" to avoid confusion. Hereinafter, "Tu-Bone" will be taken to mean any of the following: B-flat bass valve trombones and cimbassos with at least four valves and a main B-flat path tubing length of approximately 108 inches, and BB-flat, CC, E-flat, or F contrabass valve trombones (loosely referred to as "cimbassos" by today's manufacturer's) with at least three valves, and a main BB-flat path tubing length of approximately 216 inches, or a main CC path tubing length of approximately 192 inches, a main E-flat path length of approximately 162 inches, or a main F path of approximately 144 inches.

Throughout this patent application, all invention mid-section bores shall be taken to exceed 0.490 inch to distinguish the invention from French horns and other very small bore prior art instruments.

Throughout this patent application, the term BB-flat refers to the second B-flat below the bass clef staff. The terms pedal B-flat and pedal G-flat herein mean the trombone pedal B-flat and G-flat and are the first B-flat and first G-flat below the bass clef staff. The terms low E, low E-flat, low B, and low B-natural refer to those pitches in their first occurrence below the bass clef staff.

In a nonlimiting first preferred embodiment, the invention concepts are applied as a BB-flat Tu-Bone comprising a mouthpiece receiver and tapered lead pipe, approximately 216 inches of main path tubing with a mid-section of the main air path being defined as commencing after the first 20% of total main path instrument length, the mid-section comprising at least 10% and in preferred embodiments comprising approximately 45% of the total main air path, the mid-section exhibiting a stepped cylindrical bore progression comprising at least one smaller cylindrical bore section preceding at least one larger cylindrical bore section, in which the larger cylindrical bore is at least 0.007" greater inside diameter than the smaller bore section, and in which no bore within the first 65% of total main air path exceeds 0.85 inch and preferably does not exceed 0.79 inch, and the BB-flat Tu-Bone further comprising at least three, and in certain preferred embodiments, at least four rotary valves for air path selection between the main approximately 216 inch musical air path and one, two, three, or optionally (preferably) at least four (or any combinations among the one, the two, the three, or the optionally preferred at least four) alternative length extension musical air paths in the form of at least three and preferably at least four alternative length extension tubing loops which are length-tuned for proper chromatic pitch alteration when the corresponding rotary valves are engaged, and the BB-flat Tu-Bone further comprising a bass trombone shaped bell.

A first embodiment invention BB-flat TuBone may alternatively have any gradually expanding conical bore over the mid-section, provided that the overall bore expansion rate is significantly less than that of baritones, euphoniums, and tubas, and such that a bore of 0.850 inch (and preferably 0.790 inch) is not exceeded within the first 65% of the 216 inch main BB-flat tubing path length, or a combination of conical and cylindrical bores may be employed over the mid-section within the limit of 0.850 inch (and preferably 0.790 inch) bore not being exceeded within the first 65% of total main air path length, and still be within the scope of the first embodiment invention.

In the first embodiment, air may proceed sequentially through valves V1–V4, beginning with V1, or it may alternatively proceed in reverse sequence from V4 to V1, prior to exiting to the bell section. Directionality and placement of the valve section within the cylindrical or gradual conical bore expansion section of the invention Tu-Bone may include any directionality or placement and be within the scope of the invention.

The first embodiment invention BB-flat Tu-bone is distinguished from prior art BB-flat contrabass valve trombones, prior art BB-flat cimbassos, and the prior art BB-flat "Trombone Basso Verdi" in that the invention BB-flat Tu-Bone exhibits a cylindrical bore progression, or a gradual conical bore expansion, or a combination of gradually expanding conical and cylindrical bores over at least 30% and preferably over approximately 65% of the instrument air path length, rather than a constant prior art single valued cylindrical bore over the mid-section of the main path 216 inch tubing length. Any progression of cylindrical bores or gradual conical bore expansion, or combination of cylindrical and conical bore progressions is claimed for the mid-section within the limits of not exceeding 0.850 inch bore within the first 65% of main air path length, but several nonlimiting examples may include mid-section stepped increases in cylindrical bores such as any two or more cylindrical bores where the smaller cylindrical bore(s) precede(s) the larger cylindrical bore(s) and in which the change between the smaller and the larger cylindrical bore is at least 0.007 inch and is either sudden (stepped) or in which the change from one cylindrical bore to another cylindrical bore proceeds gradually, with a length of conically or otherwise expanding tubing occurring at the interface between two progressive cylindrical bores.

In one nonlimiting example, an initial mid-section cylindrical bore might be 0.578 inch, leading to a second mid-section cylindrical bore section of 0.594 inch bore, followed by a third mid-section cylindrical bore section of 0.625 inch bore. In this nonlimiting example, the 0.578/0.594/0.625 inch mid-section cylindrical bore progression might precede a 0.625 inch bore valve section. Following the valve section, the 0.625 inch cylindrical bore might lead to the bell section where final more rapid conical expansion begins and accelerates leading into the bell throat and flare, or additional intervening mid-section cylindrical bore progressions might include a further step up to 0.656 inch bore, and then to 0.689 inch bore, and finally to 0.728 inch cylindrical bore between the 0.625 inch bore valve section and the bell section, prior to the final more rapid conical expansion of the curved bow (optionally a tuning bow), bell throat, and bell flare, in a nonlimiting example.

The foregoing nonlimiting example is of a mid-section cylindrical bore progression involving cylindrical sections of tubing successively increasing in bore from 0.578 inch to 0.728 inch with the progression being 0.578/0.594/0.625/0.656/0.689/0.728 inch. Alternatively, certain of these listed mid-section bores might be skipped, such as starting with 0.594 inch or 0.625 inch, and then progressing as listed to 0.728 inch, or any one or more of the intermediate-listed mid-section bores might be skipped, or other mid-section bores smaller or larger than those listed might be included at the start, in the middle, or at the end of the mid-section progression. Essentially, the invention covers all possible combinations of two or more mid-section cylindrical bores that step up or otherwise progress from smaller to larger cylindrical bore over at least 30% of the approximate 216 inch BB-flat main tubing path, and preferably over approximately 65% of this length in a nonlimiting example. The distinguishing feature of the first embodiment BB-flat Tu-Bone is therefore midsection amplifying "progressive bores", which may be a cylindrical progression or gradual conical bore expansion, or a combination of the two, so long as the progression does not exceed 0.850 inch (and preferably not exceeding 0.790 inch) within the first 65% of total main path tubing length.

Prior art contrabass BB-flat valve trombones, the BB-flat Trombone Basso Verdi originating in Italy in 1881, and BB-flat cimbassos did not and do not have mid-section progressive bores, and typically they employ(ed) a constant, single-valued cylindrical bore over a majority of the 216 inch tubing length. Prior art single-valued cylindrical bores over typical long tubing distances are not strongly amplifying and therefore yield instruments that are difficult and require more effort to blow and to play musically than conically expanding (amplifying) BB-flat tubas and also than the cylindrically progressive (amplifying) mid-section bores, or amplifying mid-section gradual conical bore expansion, or than an amplifying combination of mid-section conical and cylindrical bores of the first embodiment invention BB-flat Tu-Bone. The first embodiment invention BB-flat Tu-bone is therefore distinguished by progressively increasing cylindrical mid-section bores or gradually increasing conical mid-section bores, or a combination of the two, all of which have an amplifying effect and make the instrument more responsive and easier to play than prior art BB-flat contrabass valve trombones, BB-flat cimbassos, and the BB-flat Trombone Basso Verdi, which exhibit straight, single valued, constant cylindrical bore over a majority of their main path tubing length.

Since the primary distinguishing feature of the first embodiment invention BB-flat Tu-Bone is progressive cylindrical mid-section bores, or gradually expanding mid-section conical bore, or a combination of the two, over at least 30% (and preferably approximately 65% in a nonlimiting example) of the approximately 216 inch BB-flat tubing path, within the limits of not exceeding 0.850 inch bore within the first 65% of overall tubing length, it should be noted that any location of the valve section and any type of valves may be included, such as piston valves or rotary valves of any design, such as FIG. 6 conventional rotary valves, S.E. Shires rotary valves, O. E. Thayer rotary valves, Greenhoe rotary valves, Hagmann rotary valves, Christian Lindbergh rotary valves, Willson Rotax rotary valves, or any type of air valve known in prior art, or not yet known but to become known in future, may be employed and still be within the scope of the invention.

The first embodiment invention BB-flat Tu-Bone may be further improved in an alternate first embodiment example, in which the invention mid-section progressive cylindrical bore, or gradual conical bore expansion, or a combination of the two, employs the aforementioned use of smaller tubing bores first, and the valve section is optionally moved "earlier" into this smaller cylindrical bore or smaller conical bore section. Smaller bore valves may thereby be employed (e.g. 0.562 inch, 0.578 inch, 0.594 inch, 0.609 inch, or 0.625 inch bore valves in several nonlimiting, relatively small bore valve examples) without inducing bore mismatch with proximal main path tubing. The smaller valve bores values allow use of a more compact, lighter weight valve with reduced internal surface area and reduced friction in the valve piston or rotor, and in which a smoother action occurs, and a shorter throw and lighter "throw-return" spring tension may be employed for the smaller bore piston valve or in the rotary valve linkage arm, instead of a typical larger cimbasso valve (e.g. 0.728–0.787 inch bore valve). In this case, the smaller bore piston or rotary valves will be smoother operating and have a "lighter touch", a shorter throw or stroke, and may be operated more nimbly by a musician executing rapid and technically demanding musical passages.

Thus, in one nonlimiting example, the first embodiment BB-flat Tu-Bone invention may include "early" location of the valve section (closer to mouthpiece than prior BB-flat cimbasso or contrabass valve trombone art), where smaller invention tubing bores, "early" in the invention progression of cylindrical tubing bores or "early" in an invention gradually expanding conical bore section, allow use of smaller bore, more compact, lighter weight, and shorter throw invention valve sections with lower internal valve friction and reduced spring tension than prior art BB-flat contrabass valve trombones, BB-flat cimbassos and BB-flat Trombone Basso Verdis, which have the valve section located relatively "late" in a large bore (e.g. 0.728–0.787 inch bore) cylindrical path, where large bore valves (e.g. 0.728–0.787 inch bore) with increased internal friction, longer throw, and stiffer, heavier spring tension must be employed to avoid bore mismatch with the proximal main air path bore.

It should be noted that the scope of the progressive mid-section bore Tu-Bone invention also includes "late" positioning of the valve section, but in the case of "late" positioning, the proximal invention main path bore progression will have increased to larger bores, dictating the need for larger bore invention valves which are inevitably less compact, weigh more, incur more internal friction, have a longer throw, and require greater spring tension to effect "return of throw" when the valve is disengaged. This increased spring tension must then be overcome with an initial long "stiff" throw when the valve is first engaged, and the operation may not be performed with as "light" of a "touch" or as nimbly by a musician as would be the case with the "early" located valve section with smaller bore, lighter weight, reduced friction, shorter throw, and reduced spring tension facilitated by the progressive mid-section bore of the earlier mentioned example of a first embodiment invention BB-flat Tu-Bone.

The first embodiment BB-flat Tu-Bone is distinguished from prior art F and E-flat cimbassos in that progressive invention mid-section bores are employed only by the invention, and only three or four valves are needed in the first embodiment invention musical key of BB-flat, and also in that BB-flat valve fingering patterns to produce the entire chromatic scale of musical tones are already known and familiar to student tuba players and are much simpler and easier to execute from the trombone pedal B-flat to pedal G-flat, whereas prior art F and E-flat cimbasso valve fingerings are generally not known and not familiar to the vast majority of student tuba players, and are substantially more complicated and more difficult to execute dextrously from the trombone pedal B-flat to pedal G-flat.

The invention BB-flat Tu-Bone is distinguished from prior art BB-flat tubas in that a mid-section and preferably a majority of the invention main path tubing length exhibits cylindrical bore or gradually stepped cylindrical bore, or only gradually expanding conical bore, or a combination of the latter two, not to exceed 0.85 inch within the first 65% of total BB-flat air path length, and maintains a bass trombone tone quality, and an invention bell throat diameter measured 10 inches from the end of the bell flare is less than 3 inches diameter, whereas the BB-flat prior art tubas have a majority of tubing length exhibiting rapidly expanding conical bore greatly exceeding 0.85 inch early in the path, and a much larger bell throat diameter (often 7 inches or more, measured 10 inches from the end of the bell flare), collectively exhibiting a significantly more "tubby" tuba tone quality which does not blend acceptably with jazz trombone sections.

A second preferred embodiment is similar to the first preferred embodiment in all respects and distinguished from prior art in all respects, except overall length of main path tubing, which may be approximately 192 inches in the second preferred embodiment, yielding an invention Tu-Bone pitched in the musical key of CC in a nonlimiting second preferred embodiment. The second embodiment is distinguished from prior art CC-cimbassos in the use of invention amplifying progressive cylindrical mid-section bores or gradual conical mid-section bore expansions, or a combination of the two, yielding more performance responsivity and easier blowing, and also in an invention option for early placement of a smaller bore, more compact, lighter weight valve section with reduced internal valve friction, shorter valve throw, lighter spring tension, and more nimble musical performance as described in the aforementioned first embodiment summary. The second preferred embodiment Tu-Bone is further distinguished from prior art CC cimbassos in that an invention bell throat diameter measured 10 inches from the end of the bell flare is less than 3 inches in diameter and preferably less than 2.5 inches diameter, whereas prior art CC cimbassos have this particular bell throat diameter larger than 3 inches, and typically 3.75 inches in diameter, such that the invention CC Tu-Bone sounds like a powerful bass slide trombone and blends well with jazz or operatic trombone sections, and prior art CC cimbassos sound like a bad baritone, a poor euphonium, or a small cheap tuba and do not blend well tonally with jazz or operatic trombone sections.

A third preferred embodiment is similar to the first preferred embodiment in all respects and distinguished from prior art in all respects, except overall length of main path tubing, which may be approximately 144 inches, yielding an invention Tu-Bone pitched in the musical key of F in a nonlimiting third preferred embodiment. The third embodiment is distinguished from prior art F-cimbassos in the use of invention amplifying progressive cylindrical mid-section bores or gradual conically expanding mid-section bores, or a combination of the two, yielding more performance responsivity and easier blowing, and also in an invention option for early placement of a smaller bore, more compact, lighter weight valve section with reduced internal valve friction, shorter valve throw, lighter spring tension, and more nimble musical performance as described in the aforementioned first embodiment summary.

A fourth preferred embodiment is similar to the first preferred embodiment in all respects and distinguished from prior art in all respects, except overall length of main path tubing, which may be approximately 152 inches, yielding an invention Tu-Bone pitched in the musical key of E-flat in a nonlimiting fourth preferred embodiment. The fourth embodiment is distinguished from prior art E-flat cimbassos in the use of invention amplifying progressive cylindrical mid-section bores or gradual conically expanding mid-section bores, or a combination of the two, yielding more performance responsivity and easier blowing, and also in an invention option for early placement of a smaller bore, more compact, lighter weight valve section with reduced internal valve friction, shorter valve throw, lighter spring tension, and more nimble musical performance as described in the aforementioned first embodiment summary.

A fifth preferred embodiment is similar to the first preferred embodiment in all respects including the aforementioned use of amplifying progressive cylindrical mid-section bores or gradual conically expanding mid-section bores, or a combination of the two, in which the mid-section commences earlier, commencing after the first 10% of total instrument main air path length, to yield exceptionally responsive playing, and including the aforementioned option for early placement of a smaller bore valve section with lower mass rotors or pistons, lower internal friction, shorter throw or stroke, smoother operation, lighter spring tension, and enabling more nimble musical performance, except at least four valves and four secondary length extension tubing loops are employed in the fifth preferred embodiment Tu-Bone and also except for overall length of main path fifth embodiment invention tubing, which may be approximately 108 inches, yielding an invention Tu-Bone pitched in the musical key of B-flat in a nonlimiting fifth preferred embodiment. In the fifth embodiment, air may proceed sequentially through valves V1–V4, beginning with V1, or it may alternatively proceed in reverse sequence from V4 to V1, prior to exiting to the bell section. Fifth embodiment valves may be rotary valves of any design, or they may be piston valves of any type. The fifth embodiment B-flat Tu-Bone bell may be any bell with a throat smaller than 3 inches diameter, and preferably small than 2.5 inches diameter, measured 10 inches from the end of the bell flare, and may include any bell flare diameter, but a preferred fifth embodiment Tu-Bone bell would have a bell throat approximately 1.75 inch in diameter measured 10 inches from the end of the bell flare in a nonlimiting example, and a preferred fifth embodiment would also have a bell flare between 9.3 inch and 11 inch diameter with an especially preferred fifth embodiment bell being approximately 10 inch to 10.5 inch in diameter, in nonlimiting examples.

The fifth embodiment B-flat Tu-Bone may have an amplifying progressive cylindrical mid-section bore as in the first embodiment BB-flat Tu-Bone, or the fifth embodiment may alternatively have a constant single valued mid-section cylindrical bore, or it may alternatively have any gradually expanding conical mid-section bore, provided that the conical bore expansion is significantly less than that of baritones, euphoniums, and tubas, and such that a bore of 0.850 inch is not exceeded within the first 65% of the 108 inch main B-flat tubing path length, or a combination of conical and cylindrical mid-section bores may be employed within the limit of 0.850 inch bore not being exceeded within the first 65% of total path length, and still be within the scope of the fifth embodiment invention.

The fifth embodiment B-flat Tu-Bone is distinguished from all prior art B-flat trombones in that it is a valved bass trombone or cimbasso pitched in the musical key of B-fiat, for which there is no precedent in prior art The fifth embodiment B-flat Tu-Bone is distinguished from all prior art B-flat bass trombones in that the invention has at least four valves and has no telescoping hand slide. The fifth embodiment B-flat Tu-bone is distinguished from all prior art cimbassos and contrabass valve trombones in that the third embodiment invention Tu-Bone main tubing path is approximately 108 inches, corresponding to a musical key of B-flat, whereas prior art cimbassos and contrabass valve trombones have only been produced and described in the musical keys of F, E-flat, CC, and BB-flat. The fifth embodiment B-flat Tu-Bone is distinguished from prior art B-flat baritones and euphoniums in that the invention main path tubing exhibits a cylindrical mid-section bore or cylindrical mid-section bore progression or only a gradual conical mid-section bore expansion, or a combination of cylindrical and gradually expanding conical mid-section bores not exceeding 0.850 inch bore over a majority of its length, and in that the invention bell throat diameters are preferably significantly smaller than those of euphoniums and baritones, in a nonlimiting example, in that baritones and euphoniums have more rapidly expanding conical bores and larger bell throats leading to tubbier tone qualities which are undesirable in applications where the Tu-Bone must exhibit tone qualities that blend appropriately with jazz or operatic trombone sections. The fifth embodiment Tu-Bone is further distinguished from prior art B-flat baritones in that at least four valves are employed by the fifth embodiment Tu-Bone in order to access the musical range from low E-flat to low B, whereas B-flat baritones have only three valves and cannot access the important bass trombone range from low E-flat to low B.

A sixth preferred embodiment is identical to the fifth embodiment B-flat Tu-Bone, except that the at least four valves are more complex valves in the sixth embodiment and the at least four valves are designed to accommodate an "inverted full double" Tu-Bone approach to eliminate tuning errors in the range low E to low B-natural, without incurring performance stuffiness. In the sixth preferred embodiment inverted full double Tu-Bone, valves V1–V3 are actually each double valves and may be visualized as "two story" valves each having an "upper story" ("upper" being an arbitrary designation to aid in visualization) which may, when engaged, divert air from the main B-flat path to an "upper" length extension tubing loop specifically associated with, and length tuned specifically for chromatic pitch alteration within the main B-flat Tu-Bone key, and each of valves V1–V3 also having a "lower story" which may, when engaged, divert air from the main F path to an independent "lower" length extension tubing loop associated with, and length tuned specifically for chromatic pitch alteration within the alternate F Tu-Bone key. V4 simply selects whether the main B-flat air path is active with the valve V4 disengaged in a first of two V4 operating positions, or whether the alternate F air path is active with the valve V4 engaged in a second of two V4 operating positions. With V4 disengaged, the main B-flat path is active and in this case engaging V1–V3 activates only the "upper story" V1–V3 length extension tubing loops (one loop length tuned specifically for a certain chromatic pitch alteration within the main B-flat key and associated with an upper story of each of three valves V1–V3), either singly or in combination to produce a series of chromatic pitch alterations to the main B-flat key. With V4 engaged, the alternate F path is active, and in this case, simultaneously engaging V1–V3 causes only the "lower story" V1–V3 length extension tubing loops (one loop specifically length tuned for a certain chromatic pitch alteration within the alternate F key and specifically associated with a lower story of each of three valves V1–V3) to be selected or bypassed by V1–V3, either singly or in combination to produce chromatic pitch alterations to the alternate F key. The sixth embodiment is called a "full double" Tu-Bone because the paths are independent, and each of the two independent paths (B-flat and F) forms a complete Tu-bone. The sixth embodiment is further called an "inverted" full double Tu-Bone, because the main path is B-flat, and V4 engagement lengthens the Tu-Bone and changes the fundamental pitch "downward" to F, instead of "upward". (In a normal "double" French Horn, which is the only prior art "full double" brass instrument, engaging V4 shortens the instrument and changes the pitch "upward" from a main path F key to an engaged V4 alternate B-flat key.)

In the sixth embodiment, the B-flat inverted double Tu-Bone may have the change of "story" occurring via tubing routing external to the valves, such that external tubing moves from a lower level valve port to an upper level port of another valve, or alternatively, V4 may have an air passage internal to the valve which changes between lower and upper levels, and still be within the scope of the invention. Essentially any valve design and any tubing routing which achieves the independent "inverted full double" B-flat Tu-Bone implementation is claimed, such that either the main B-flat V1–V3 tubing loops are employed, or the alternate F V1–V3 tubing loops are employed, but no B-flat V1–V3 loops are used simultaneously with any F V1–V3 tubing loops.

In a first nonlimiting example of a sixth preferred embodiment B-flat inverted double Tu-Bone, the at least four valves may be two-story rotary valves with each story having rotor passages of conventional rotary valve design, or each story may alternatively have a rotor segment according to the designs of Greenhoe, Shires, Hagmann, Lindbergh, or any other rotary valve design. In a second nonlimiting example of a sixth preferred embodiment B-flat double Tu-Bone, the at least four valves may be piston valves facilitating selection of either upper story (B-flat path) or lower stony (F path) length extension tubing loops for valves V1–V3, with upper story B-flat path length extension tubing loops being selected or bypassed by V1–V3 whenever V4 is disengaged, and with lower story F path length extension tubing loops being selected or bypassed by valves V1–V3 whenever V4 is simultaneously engaged.

The sequence of valves which is encountered by vibrating air in one nonlimiting example of a sixth preferred embodiment begins with the bottom story of V4 where air enters from the mouthpiece, lead pipe and initial section of cylindrical Tu-Bone brass tubing. Air traversing a bottom story V4 rotor air passage and exiting the bottom story of V4, when V4 is in the disengaged first of two operating positions, is then routed by external main B-flat path tubing to the top of V1, and from there to the top of V2, the top of V3, and finally to the top story of V4 prior to exiting to the bell section with the Tu-Bone in the fundamental B-flat musical key. Diversion to upper story V1–V3-associated secondary length extension tubing loops may occur with engagement of valves V1–V3 whenever V4 is in its disengaged first of two operating positions. The V1–V3-associated upper story secondary length extension tubing loops are each length-tuned to effect specific chromatic alterations to the main B-flat key when their associated valve is engaged, without V4 also being engaged.

Air exiting the bottom story of V4, when V4 is in the engaged second of two operating positions, is routed by external main F path tubing to the bottom of V1, and from there to the bottom of V2, the bottom of V3, and finally by external tubing to the top of V4 prior to exiting the bell section in the fundamental F musical key. Diversion to a second independent set of lower story V1–V3-associated secondary length extension tubing loops may occur with engagement of valves V1–V3 whenever V4 is also in its engaged second of two operating positions. The V1–V3-associated lower story secondary length extension tubing loops are each length-tuned to effect specific chromatic alterations to the main F key when their associated valve is engaged, while V4 is also engaged. To facilitate familiarity of fingerings for tuba players, the valve actuator for V4 is preferably physically located below or following the V3 actuator in the actuator location sequence V1, V2, V3, and V4 in a nonlimiting example embodiment of the invention, even though external tubing routing determines that V4 is the first encountered valve within the invention air path.

In another example of a sixth preferred embodiment, V4 may be designed to change the level of air between two of the stories internally with a vertically diagonal air passage within the V4 valve rotor or piston, rather than by external tubing routing.

The sixth preferred embodiment may further optionally have two actuators for V4, such that V4 may be actuated with either the right hand or the left hand. This is beneficial to certain euphonium players who may wish to play the sixth preferred embodiment Tu-Bone, but who may be accustomed to V4 operation with the opposite hand from which they normally operate V1–V3.

The sixth preferred embodiment B-flat inverted full double Tu-Bone is distinguished from all prior art in that it is the only 108 inch B-flat bass brass instrument in existence or in history which is accurately tuned from low E-flat to low B-natural without incurring performance "stuffiness" within that range. Prior art compensated B-flat euphoniums are well tuned in the range low E-flat to low B-natural, but they simultaneously activate both upper and lower story length extension tubing loops whenever V1–V3 are engaged simultaneously with V4. The prior art euphonium thus uses every tubing loop to perform a low B-natural with all four valves engaged. This means a great many tubing bends (loops), and a total of fourteen events occur where air must traverse through constricted or tortuous internal piston or rotary valve air passages for a prior art B-flat compensated euphonium. With 14 trips through a valve piston or rotor, back-pressure always builds and an unresponsive "stuffy" playing characteristic inevitably results from low E-flat to low B. The sixth embodiment B-flat inverted full double Tu-Bone is distinguished in that only one (upper or lower story, but not both) of the valve "stories" is activated for V1–V3 at a time, regardless of whether V4 is engaged or disengaged. For a low B, all four valves are engaged, but the sixth embodiment B-flat inverted full double Tu-Bone will have only 8 trips through a valve piston or rotor, and back-pressure will not be nearly as severe, leaving the sixth embodiment Tu-Bone playing responsively and without stuffiness and also playing accurately in tune. The important distinguishing feature of the sixth embodiment Tu-Bone is use of the "inverted full double horn" approach, which has never before been implemented or described in any prior art B-flat bass brass instrument, and certainly not for any prior art valve trombone, valve bass trombone, valve contrabass trombone, cimbasso, or in any instrument which sounds even remotely like a trombone or bass trombone.

A seventh invention B-flat Tu-Bone embodiment is identical to the sixth embodiment, except that a "compensated" Tu-Bone is envisioned in B-flat rather than a full double Tu-Bone in B-flat. For a seventh embodiment compensated B-flat Tu-Bone, a two story valve arrangement also applies, except that in this case, engaging V4 activates the main B-flat and the main F paths simultaneously, so their lengths add together in series. Engaging V1 simultaneously with V4 activates both the upper and the lower V1 length extension tubing loops, placing them both in series with different sections of the main B-flat and the main F path of the instrument, and engaging V2 simultaneously with V4 activates both the upper and the lower V2 length extension tubing loops, placing them both in series with different sections of the main B-flat and the main F path of the instrument, and engaging V3 simultaneously with V4 activates both the upper and the lower V3 length extension tubing loops, placing them both in series with different sections of the main B-flat and the main F path of the instrument. Both four piston and four rotary valve seventh embodiments are included. The seventh embodiment is not, in fact, preferred to the sixth embodiment, owing to seventh embodiment "stuffiness" issues from low E-flat to low B arising from too many length extension loops and too many piston or rotor air passages being simultaneously activated in this range, but the seventh embodiment is still within the scope of the invention B-flat Tu-Bone.

An eighth preferred embodiment involves the B-flat inverted full double Tu-Bone of the sixth embodiment in a nonlimiting example, in which the mid-section of the main B-flat air path is defined as commencing after the first 10% of total B-flat main path instrument length, the mid-section comprising at least 10% and in preferred embodiments comprising approximately 45% of the total main air path, the mid-section exhibiting a stepped cylindrical bore progression comprising at least one smaller cylindrical bore section preceding at least one larger cylindrical bore section, in which the larger cylindrical bore section is at least 0.007 inches greater inside diameter than the smaller bore section, and in which no bore within the first 65% of total main air path exceeds 0.85 inch and preferably doesn't exceed 0.79 inch, in a nonlimiting example, or in which a gradual conical bore expansion is employed over the mid-section in a nonlimiting example, within the limits of not exceeding 0.850 inch bore within the first 65% of path length, or in which a combination of the two is employed over the mid-section. However, a constant and single valued cylindrical bore may also be employed in the cylindrical mid-section, prior to the final more rapid conical expansion of the bell section, and still be within the scope of a sixth embodiment invention.

In a first nonlimiting example of an eighth embodiment B-flat inverted full double Tu-Bone, main B-flat path mid-section cylindrical tubing bores following an approximate 8.5 inch tapered lead pipe may be approximately 0.578 inch for the first approximately 12 inches, followed by an approximate 14.5 inch section at approximately 0.594 inch bore leading through the bottom of V4, followed by approximately 39 inches of cylindrical tubing at 0.625 inch bore prior to the final conical expansion in the bell section which includes the last 34 inches of the 108 inch B-flat total in a nonlimiting example. In this case, V4 is a hybrid bore two story rotary valve with the bottom story rotor bored at approximately 0.594 inch and the top story rotor bored at approximately 0.625 inch in a nonlimiting example. V1–V3 would all be bored at 0.625 inch on both stories in this nonlimiting example. Alternatively, the preferred B-flat stepped cylindrical mid-section bore progression of 0.578 inches, 0.594 inches, and 0.625 inches following an approximate 8.5 inch tapered lead pipe and prior to the conically expanding bell section may proceed over mid-section lengths of approximately 12 inch, 22.5 inch, and 31 inches, respectively in a second nonlimiting example. In this case, all four valves would be hybrid valves with 0.594 inch rotor bores in the top of V1–V3 and 0.625 inch rotor bores in the bottom of V1–V3. V4 would be inverted with 0.594 inch bore in its bottom half and 0.625 inch bore in its top half. Finally, the preferred B-flat stepped cylindrical bore progression of 0.578 inches, 0.594 inches, and 0.625 inches, may also proceed over mid-section lengths of approximately 11.5 inches, 11.5, inches and 51 inches, respectively, following an approximate 8.5 inch lead pipe in a third nonlimiting example. In this case, all valves would be bored at 0.625 inch bore, in both top and bottom halves.

The eighth preferred Tu-Bone embodiment is distinguished in that it's progressive cylindrical mid-section bores or its gradually expanding conical mid-section bores, or combination of the two, are unusually large bore for a B-flat bass trombone, and they will also be strongly amplifying due to the progressive mid-section bore effect, and will yield an unusually responsive and loud playing bass trombone, especially for a valve trombone.

A ninth invention embodiment is not a Tu-Bone, but is a euphonium, much like prior art compensated euphoniums except that the prior art euphonium "compensation" is eliminated in favor of the inverted full double euphonium invention approach in exactly the same way this approach was described for the sixth embodiment Tu-Bone. However, invention full double euphonium bores will be conically expanding beginning right after the valve section, as with prior art euphoniums. The distinguishing feature of the ninth embodiment euphonium is that a "full double euphonium" approach to resolving tuning issues in the range low E-flat to low B is employed, and this has no precedent in euphonium prior art.

A tenth invention embodiment is also not a Tu-Bone, but is a 3 valve B-flat tenor trombone such as in FIG. 1C with a valve bore of at least 0.500 inch, and may be of constant cylindrical or progressive mid-section bore.

An eleventh invention embodiment is also not a Tu-Bone, but is a 3 valved B-flat tenor trombone or marching trombone such as in FIG. 1D with a mid-section progressive bore as described earlier in the fifth embodiment section.

BRIEF DESCRIPTION OF THE DRAWINGS

The Foregoing and other aspects, benefits, and advantages of the invention will be better understood from the following detailed description of the preferred embodiments of the invention with the reference to the drawings, in which:

In FIG. 1B, the valve section (46–48) has been rotated away from the bell throat (23) about an axis defined by pipe 18 and nut 17 to facilitate a view of the back side of the valves, the valve interconnect tubing (32B, 35B), and valve attachment points of tubing loop 37. In this view the valve keys (46–48) protrude horizontally to the player's right. It should be noted that this is not the normal playing position.

FIG. 2 is a cutaway side view of a prior art trombone mouthpiece.

FIG. 3A is a bottom view of a prior art trombone inner slide removed from a prior art trombone telescoping length extension hand slide assembly of FIG. 4A or 5A.

FIG. 3B is a bottom view of a prior art trombone outer slide (braced U-tube) removed from a prior art trombone telescoping length extension hand slide assembly of FIG. 4A or 5A.

FIG. 6A is a bottom view of a valve, such as the one shown in a segment (85) of FIG. 4A (170 of FIGS. 4B–D). FIG. 6A illustrates a rotor (147), two air passages (148, 149) which are bounded on the interior of the rotor by cutouts (148, 149) in rotor body (147) and bounded on the exterior by valve casing (150, 151). The air passages (148, 149) shown in FIG. 6A do not interconnect within the rotor and they proceed independently straight back into the plane of the drawing as shown with the rotor in the engaged second of two rotary operating positions. Air entering valve casing port (221) is diverted straight back into the plane of the drawing by rotor passage (148). FIG. 6A also illustrates upper and lower rotor spindles (227), thrust bearing (230), end plate (228), lower spindle bushing (231), lower casing cap (229), valve casing (151), main path valve tubing inlet port (221), main path valve tubing outlet port (222), upper spindle bushing (232), spindle collar (300) retaining screw (301), rotor stop (215), rotor stop pads (226), ball swivel joint (185), and rotary linkage arm (184), shown in the engaged second of two operating positions.

FIG. 6B is similar to that of 6A, except that it is larger in diameter and overall dimensions, thereby allowing passages 148 and 149 to be machined wholly or partially within rotor (147), and to be essentially round in the FIG. 6B valve, rather than "D-shaped" like passage 148 in the FIG. 6A valve. In one scenario these improved FIG. 6B passages may be bored straight back through the rotor (into the plane of the drawing as shown in FIG. 6B which illustrates the rotor in the engaged second of two rotary operating positions), and an in improved scenario, they may be bored as curved tunnels curving first inward toward spindle 227 and indeed cutting through a portion of the spindle, but not through it's very center, and then curving back away from the spindle as they pass its center moving back through the plane of the drawing in this engaged second of two rotary operating positions of the valve.

FIG. 7A shows valve 170 in it disengaged first of two operating positions, in which vibrating air enters from the main instrument path (82) at port 171 and then simply skips directly through rotor passage 149, as indicated by the passage arrow and exits the valve directly at 176 to continue in the main instrument path (83, 98), having completely bypassed external secondary length extension tubing loop 172–175 in this disengaged first of two valve operating positions.

(FIGS. 6B–C also indicates that these curved tunnels (148, 149) are essentially round in their cross-sectional aspect.)

(FIGS. 6B–C also indicates that these curved tunnels (148, 149) are essentially round in their cross-sectional aspect.)

http://www.music.ed.ac.uk.euchmi/ucj/ucjg2532.jpg.

Figure 13:
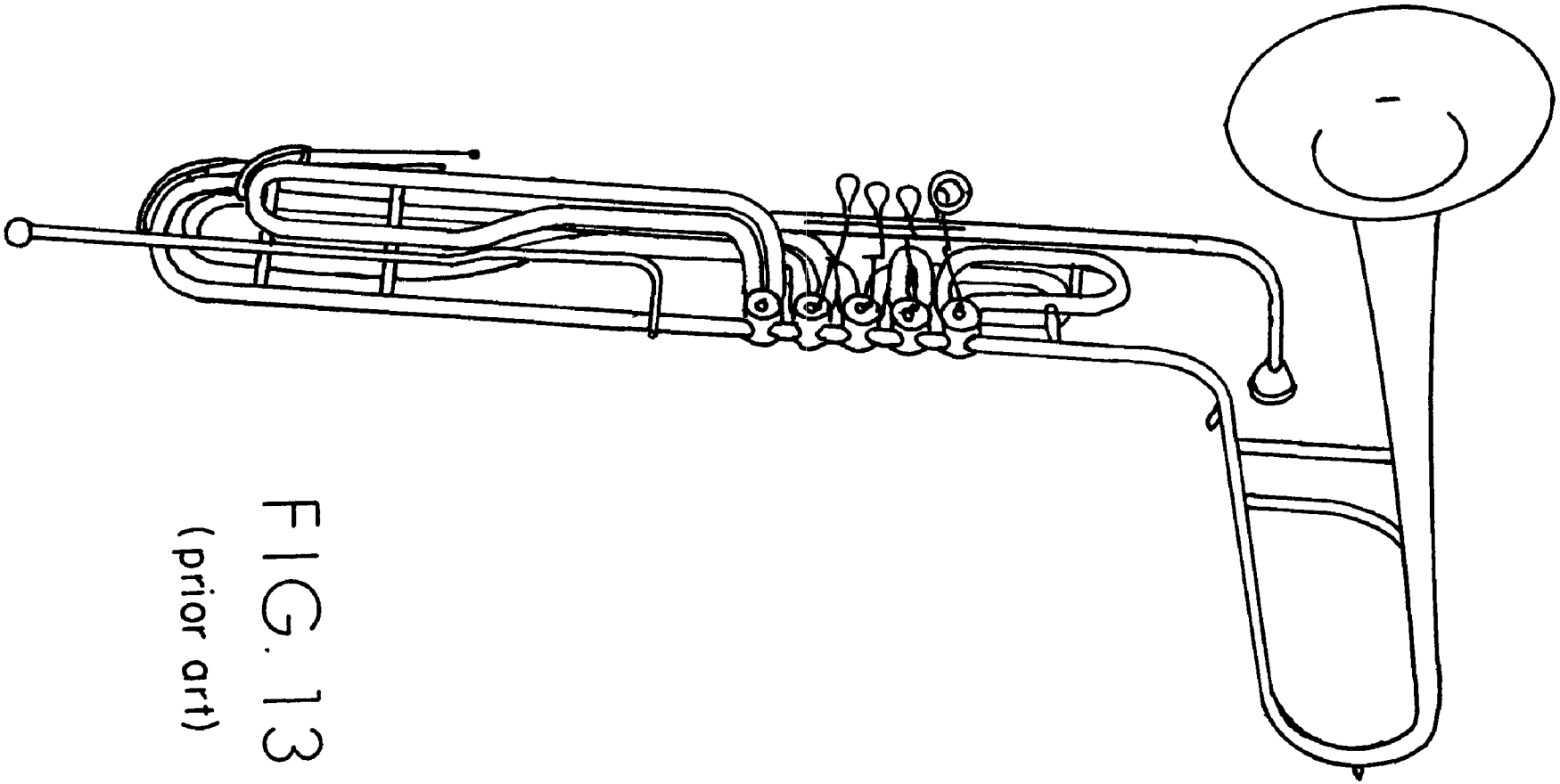
FIG. 13 (prior art)

FIG. 13 illustrates a prior art Meinl-Weston F cimbasso in a front view.

Figure 14A:
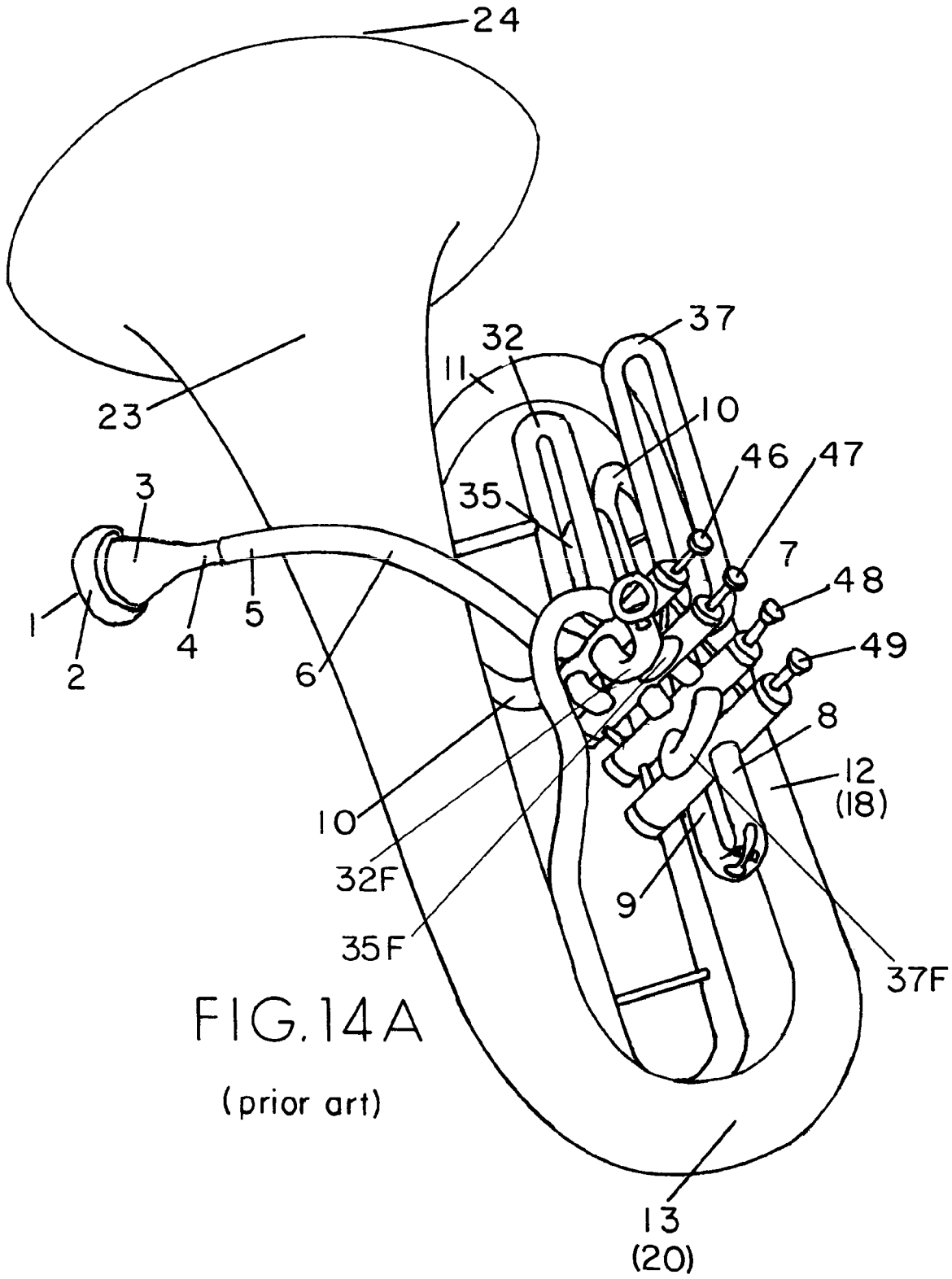
FIG. 14A (prior art)

FIG. 14A illustrates a prior art compensated B-flat euphonium with four in-line piston valves. The illustrated euphonium is a Willson model 2975 Perspective is from the side and about 45 degrees below horizontal.

Figure 14B:
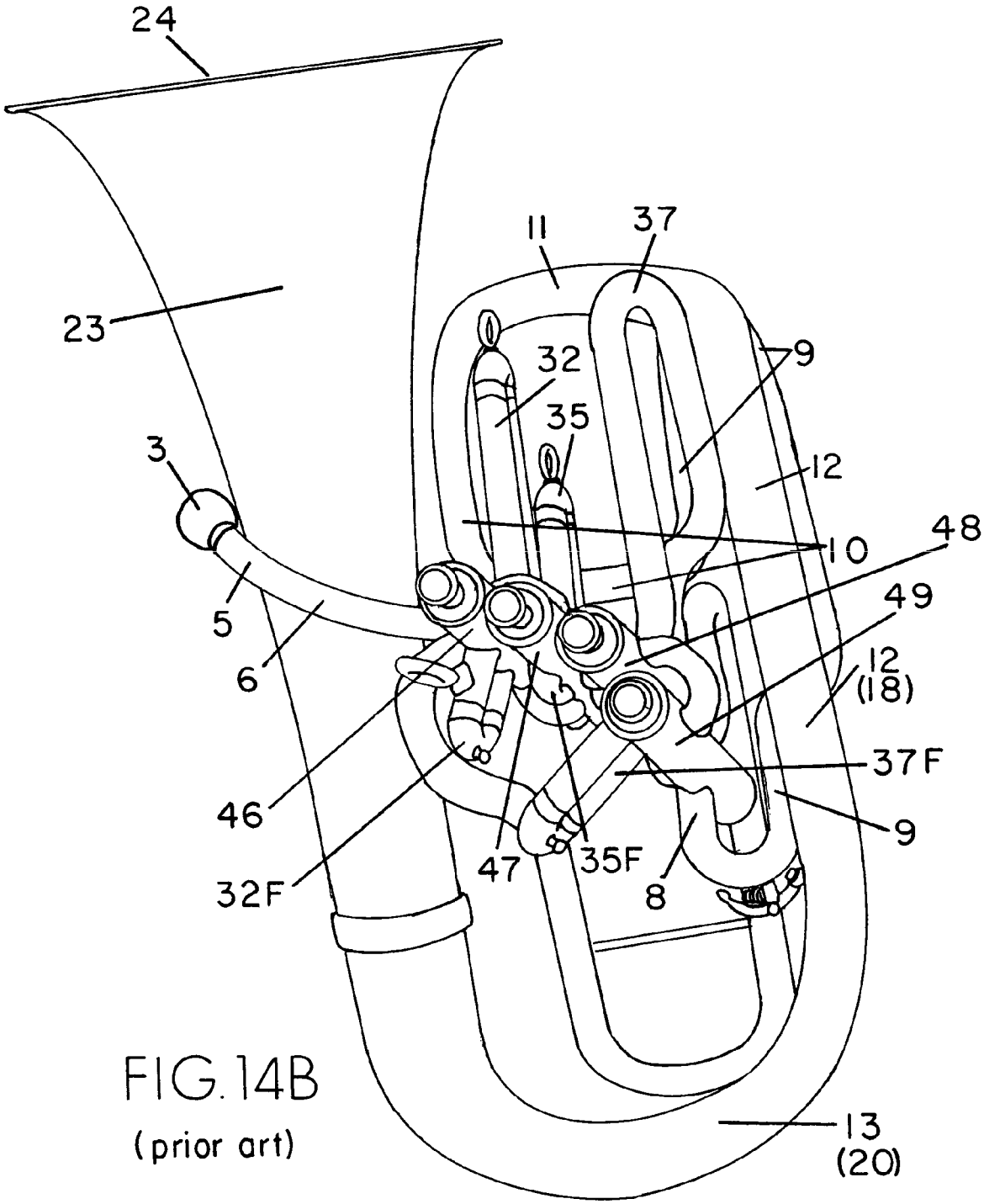
FIG. 14B (prior art)

FIG. 14B illustrates the prior art compensated B-flat euphonium of FIG. 14A with perspective adjusted directly on the horizontal.

Figure 14C:
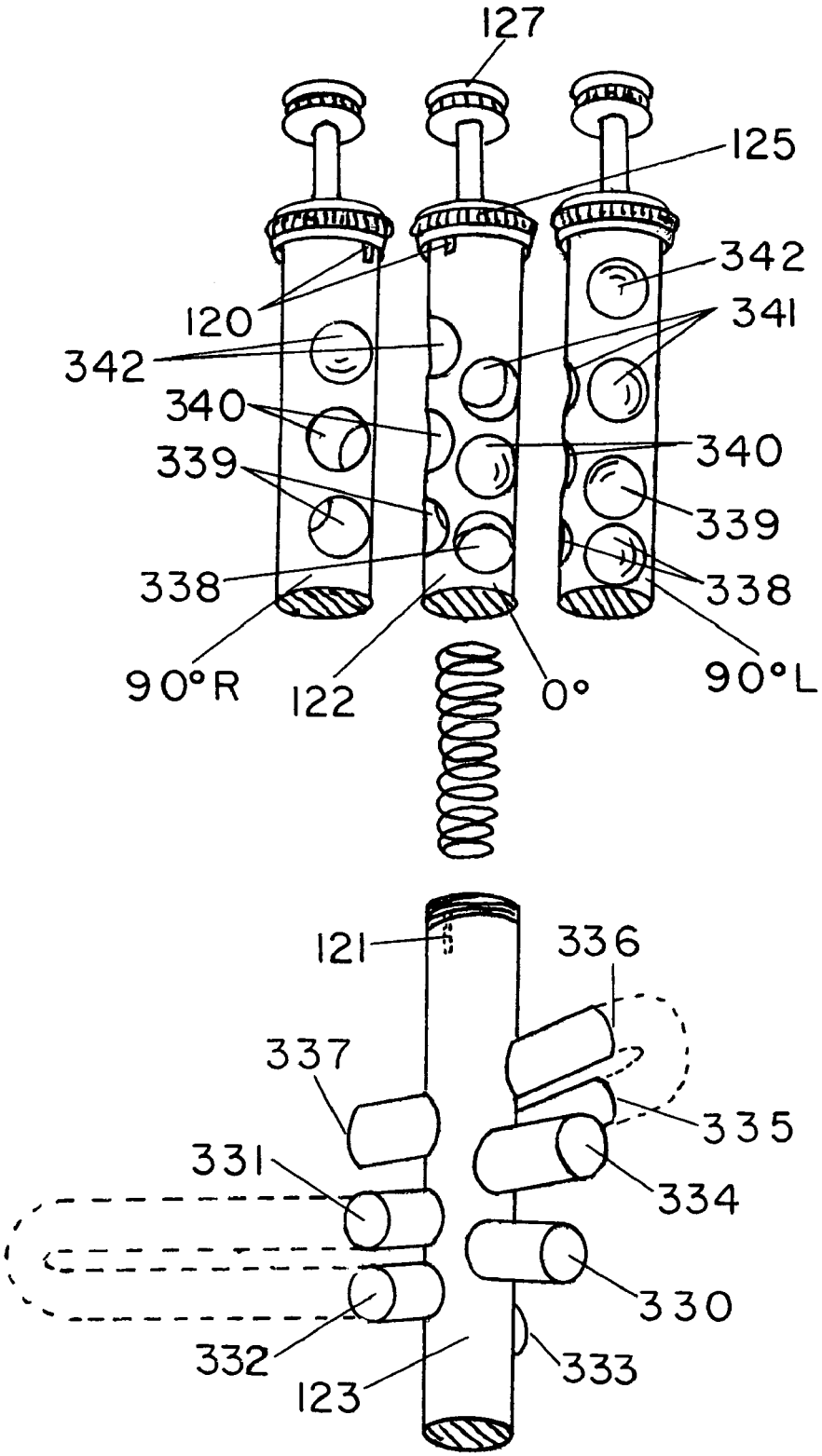
FIG. 14C (prior art)

FIG. 14C is an exploded view of the side of a 5-passage piston valve taken from the V1 position of the compensated euphonium of FIGS. 13A–B.

Figure 15A:
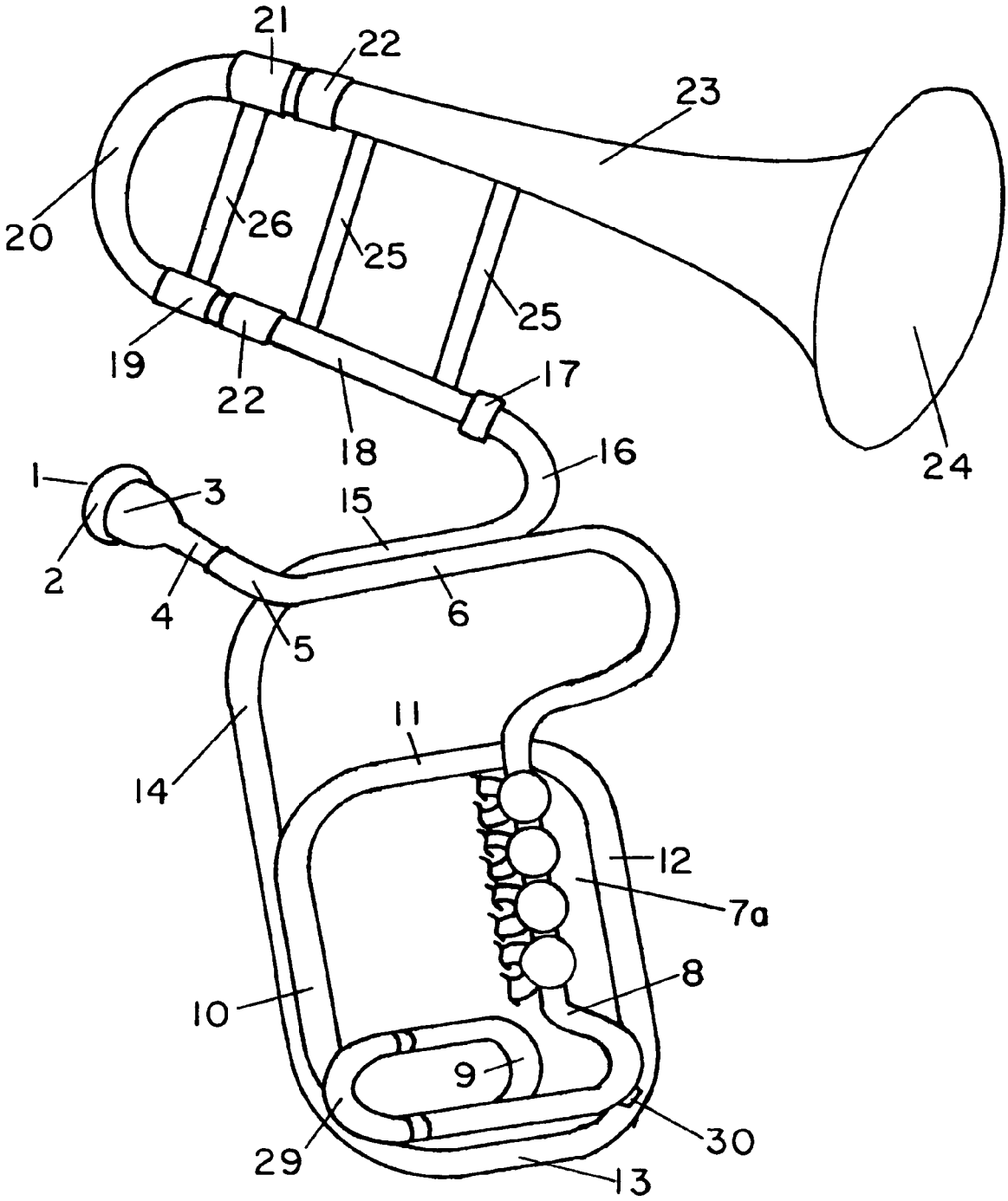

FIG. 15A is a perspective view from about 30 degrees to the left of front of a 1$^{st}$ embodiment four valve BB-flat invention Tu-Bone illustrating "early placement" of the valve section (7*a*) within the approximately 216 inch main path tubing, corresponding to a musical key of BB-flat, and exhibiting a progressive cylindrical mid-section bore, a gradually expanding conical mid-section bore, or a combination of the two over the mid-section tubing path (e.g. 6–16), within the limit of not exceeding 0.850 inch bore and preferably not exceeding 0.790 inch bore within the first 65% of main path tubing length, and with the onset of more rapid conical bore expansion being delayed until tube 18 or tubular bow (20). Secondary valve tubing loops, rotary valve linkages, and keypads have been removed for simplified inspection of the main BB-flat path.

Figure 15B:
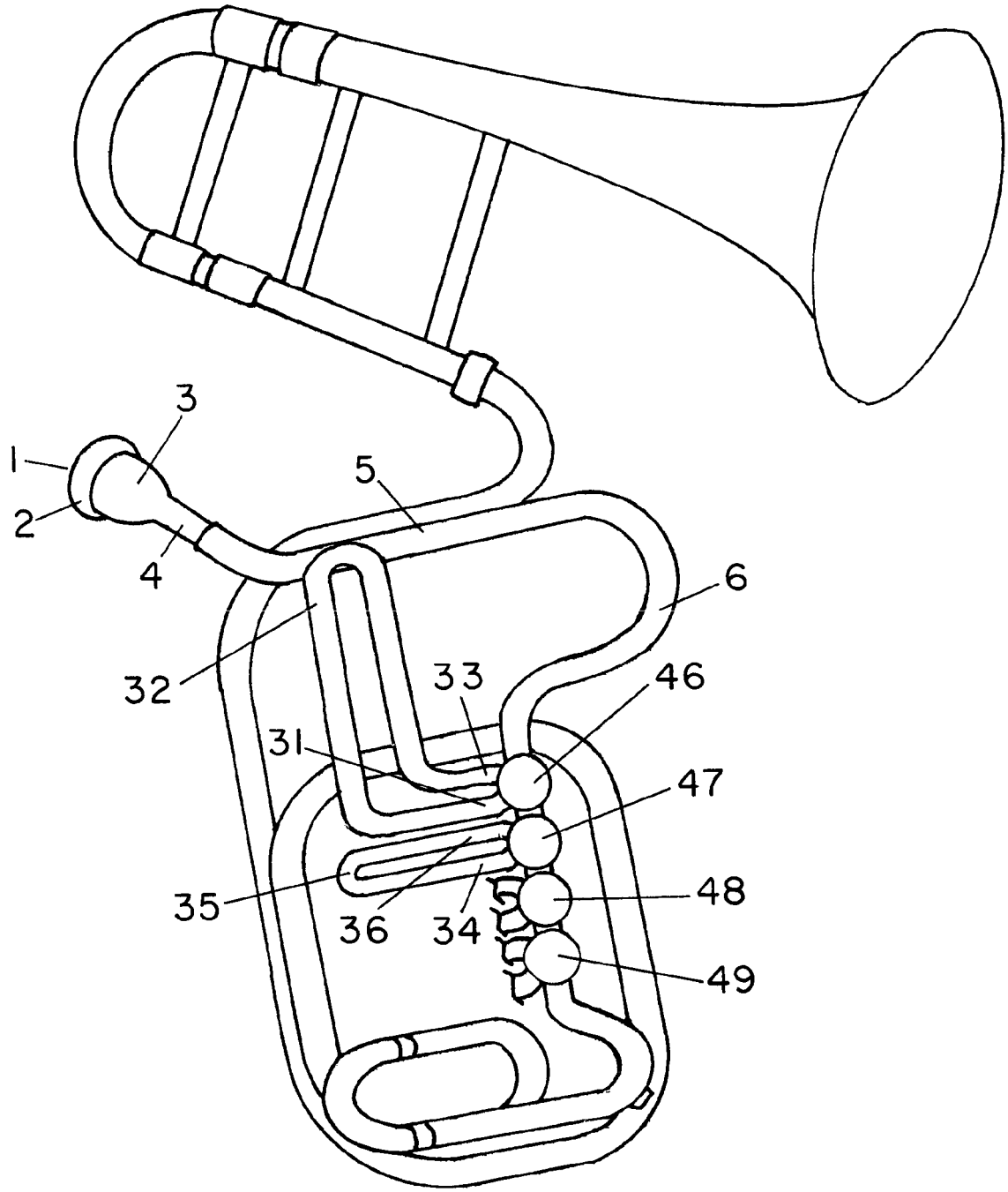

FIG. 15B is the same as 15A with addition of the first two secondary length extension tubing loops (31–33 and 34–36) attached to valves V1 (46) and V2 (47), respectively.

Figure 15C:
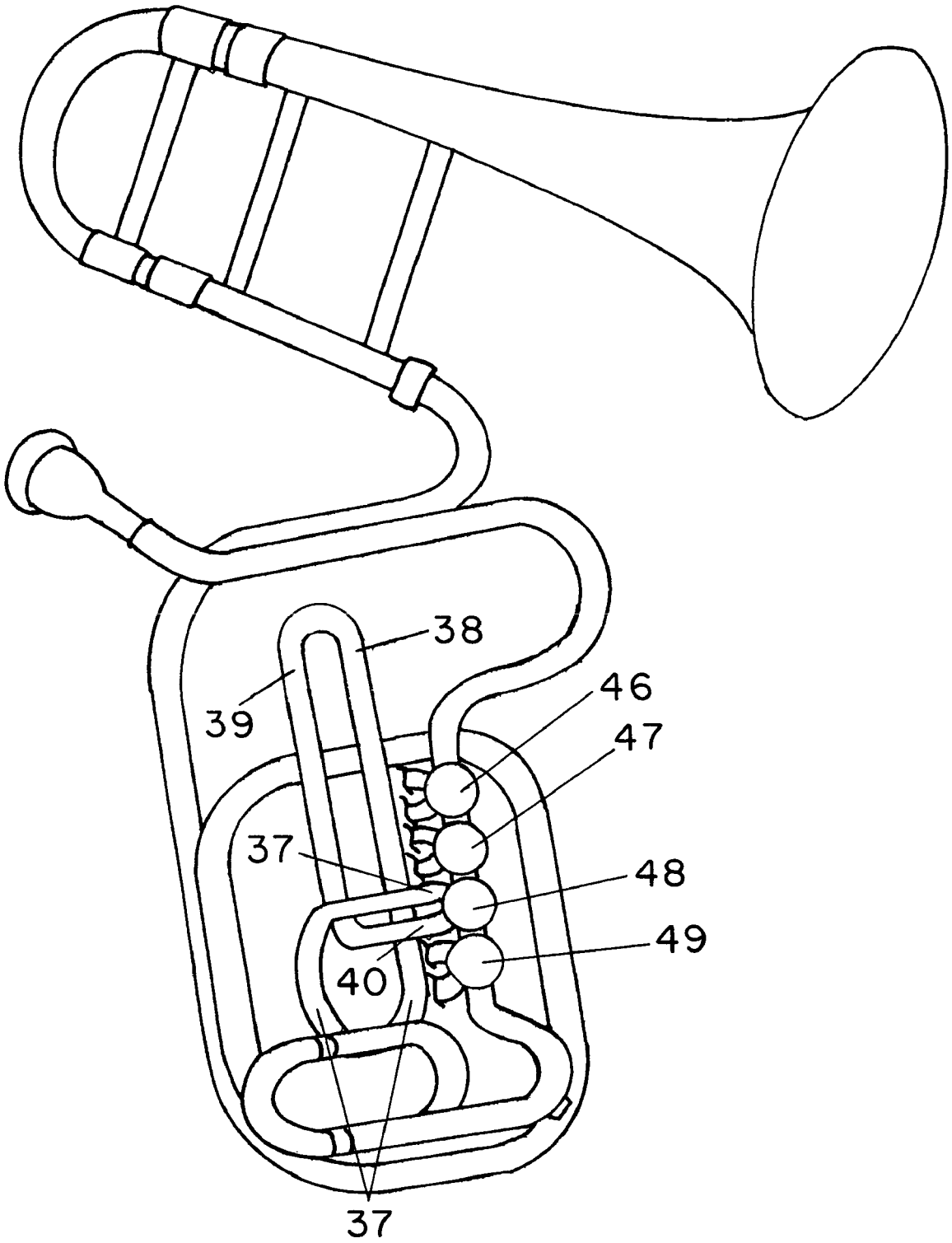

FIG. 15C is the same as 15A with addition of a third secondary length extension tubing loop, which looks like a "knotted coil" (37–40) and is attached at the two coil ends (37, 40) to valve V3 (48).

Figure 15D:
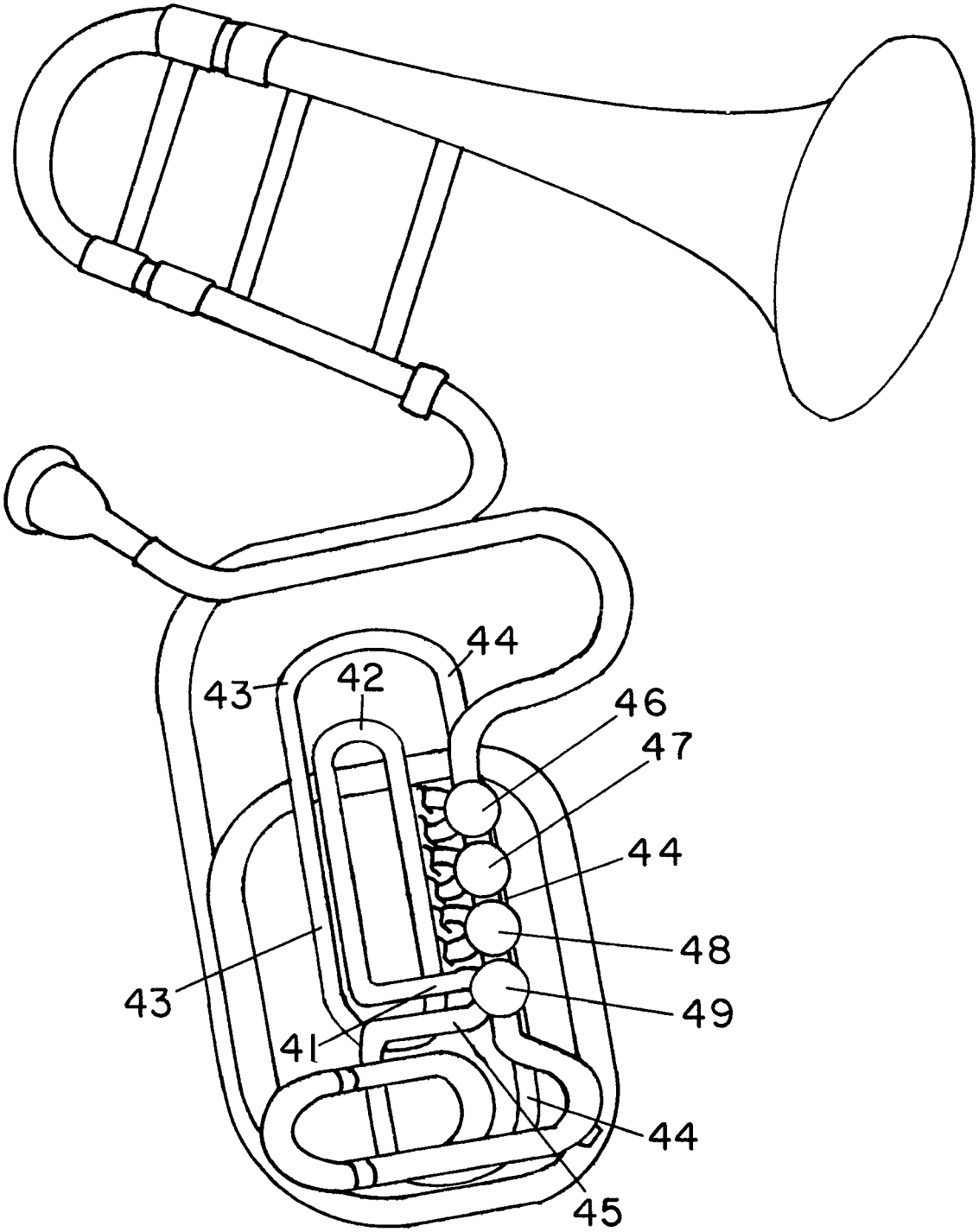

FIG. 15D is the same as 15A with addition of a fourth "convoluted coil" secondary length extension tubing loop (41–45) with the two ends of the coil (41, 45) attached to valve V4 (49).

Figure 15E:
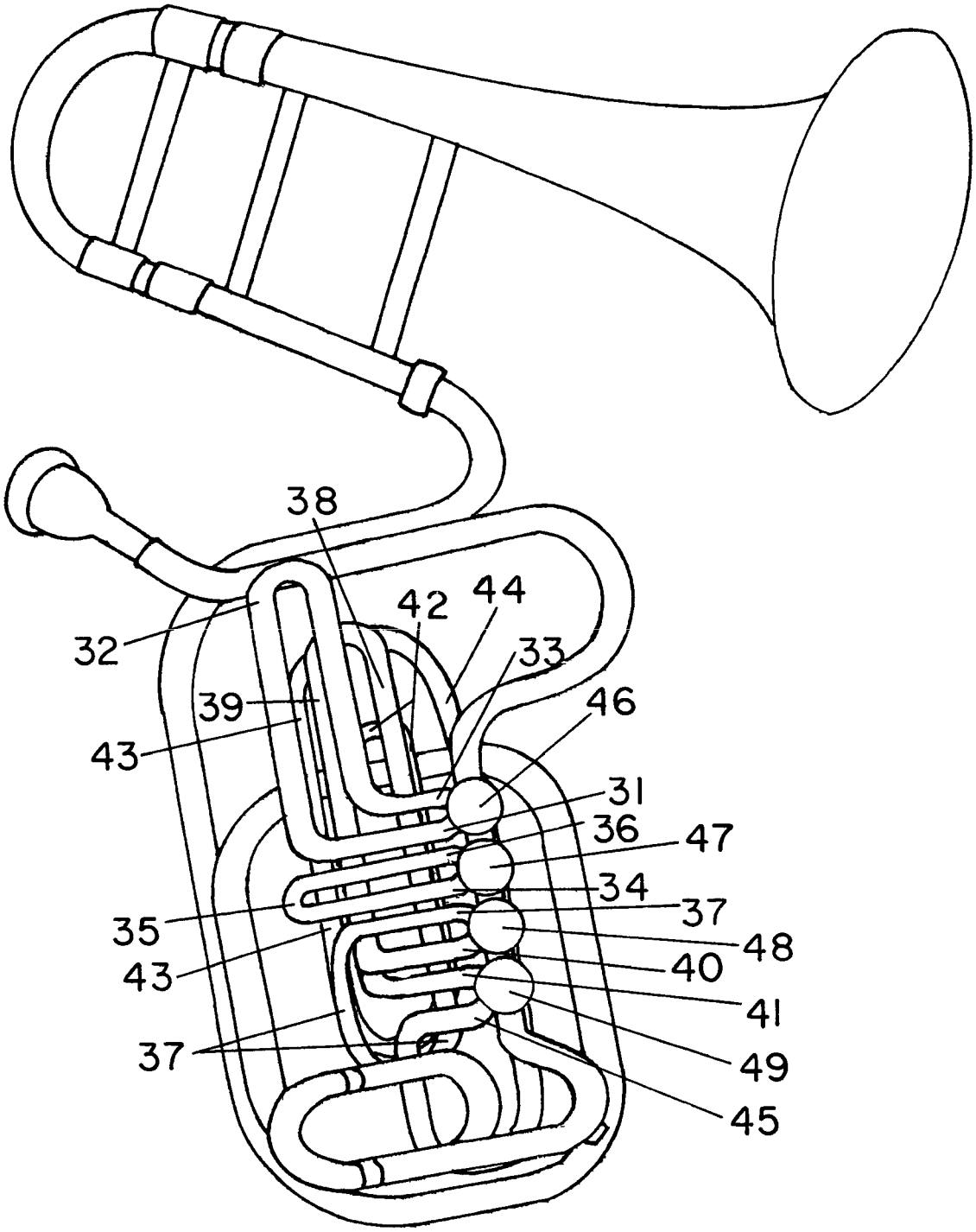

FIG. 15E is the same as FIGS. 15A–D, combined, and having all four secondary length extension tubing loops (31–33, 34–36, 37–40, and 41–45) attached to V1–V4 (46–49), respectively in this first embodiment BB-flat Tu-Bone.

Figure 15F:
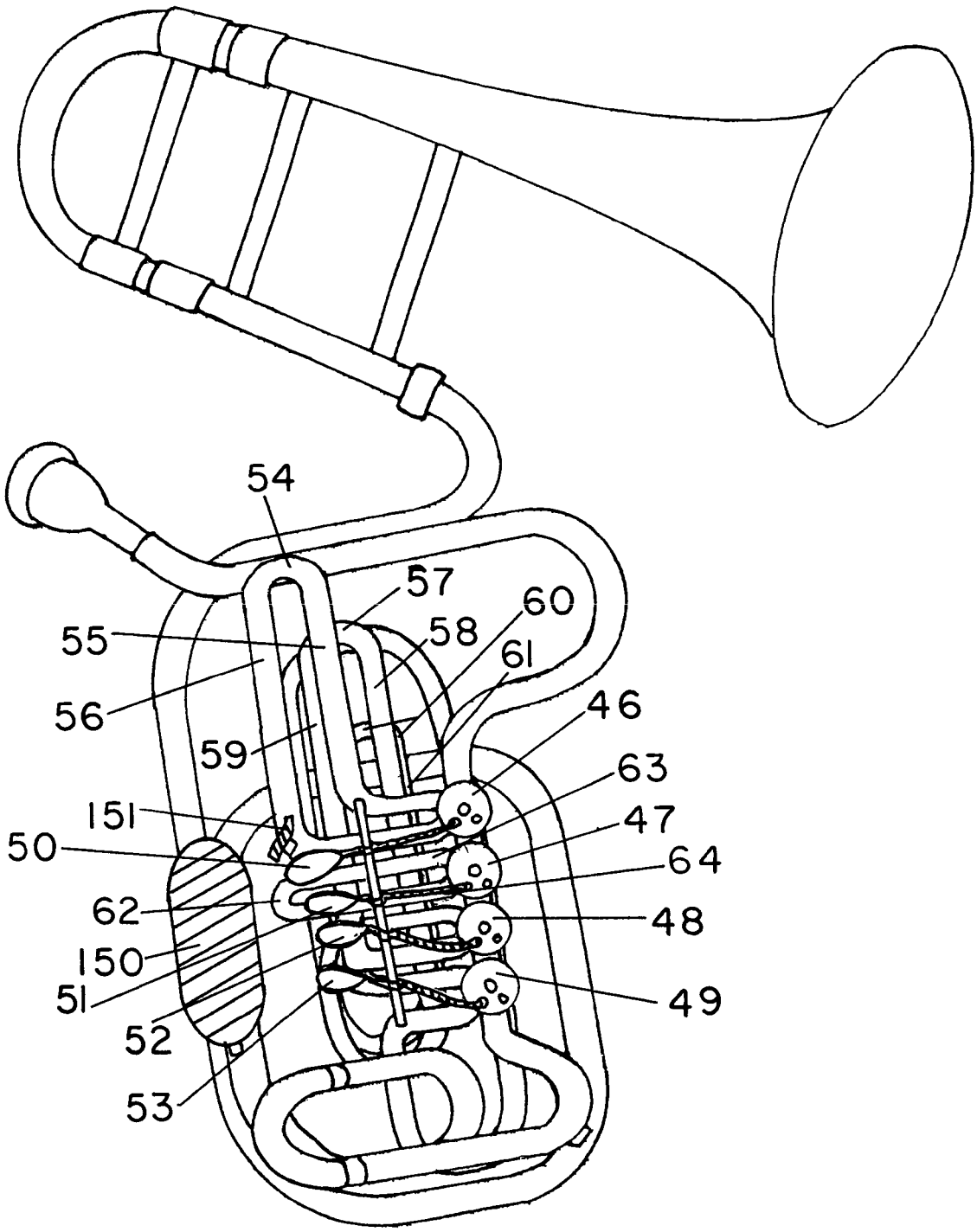

FIG. 15F is the same as 15E, with addition of four rotary valve linkages, four linkage arms, four actuator keypads (50–53), and optional palm rest (150) and optional thumb rest (151). This is a complete first embodiment BB-flat Tu-Bone.

Figure 15G:
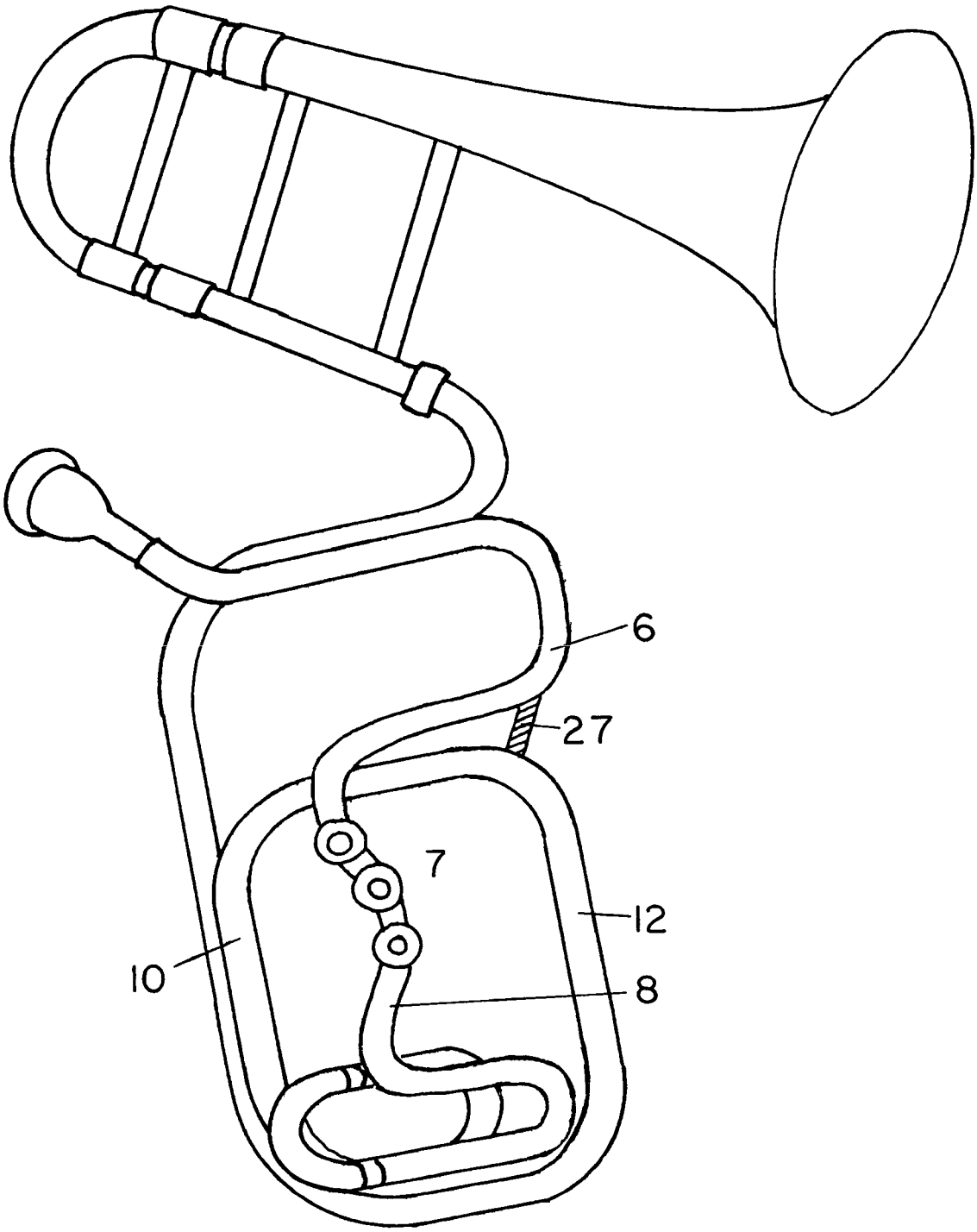

FIG. 15G is a first embodiment three piston valve BB-flat Tu-Bone. FIG. 15G is the same as 15A except that 3 piston valves are shown in an "early" placement FIG. 15G configuration, and tube 8 has been lengthened at the expense of shortening tube 6 to position V1–V3 (7) proximally to a performer's right hand while maintaining the overall approximate 216 inch main path length requirement of a BB-flat Tu-Bone.

Figure 15H:
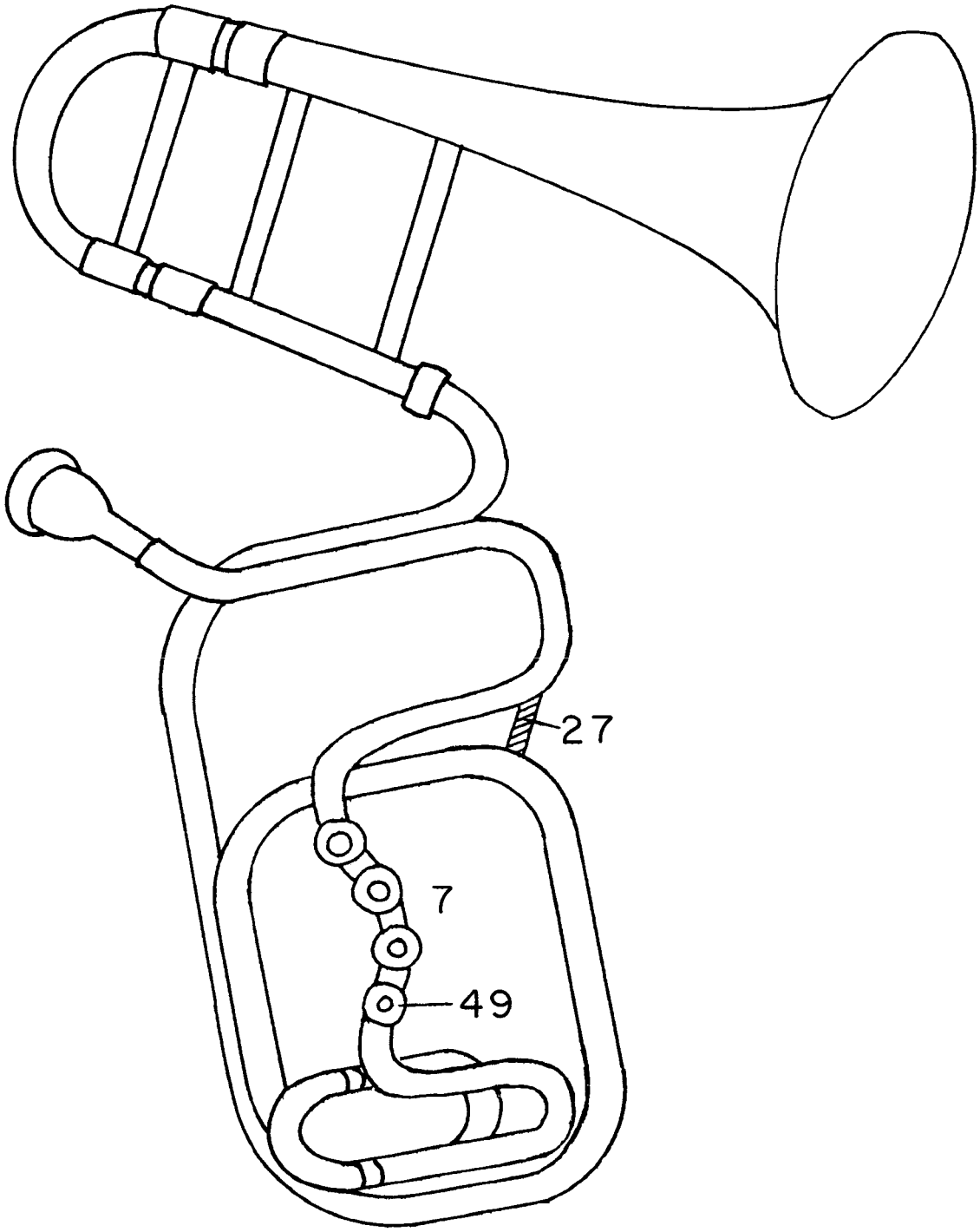

FIG. 15H is the same as 15G with addition of a fourth piston valve (49).

Figure 16A:
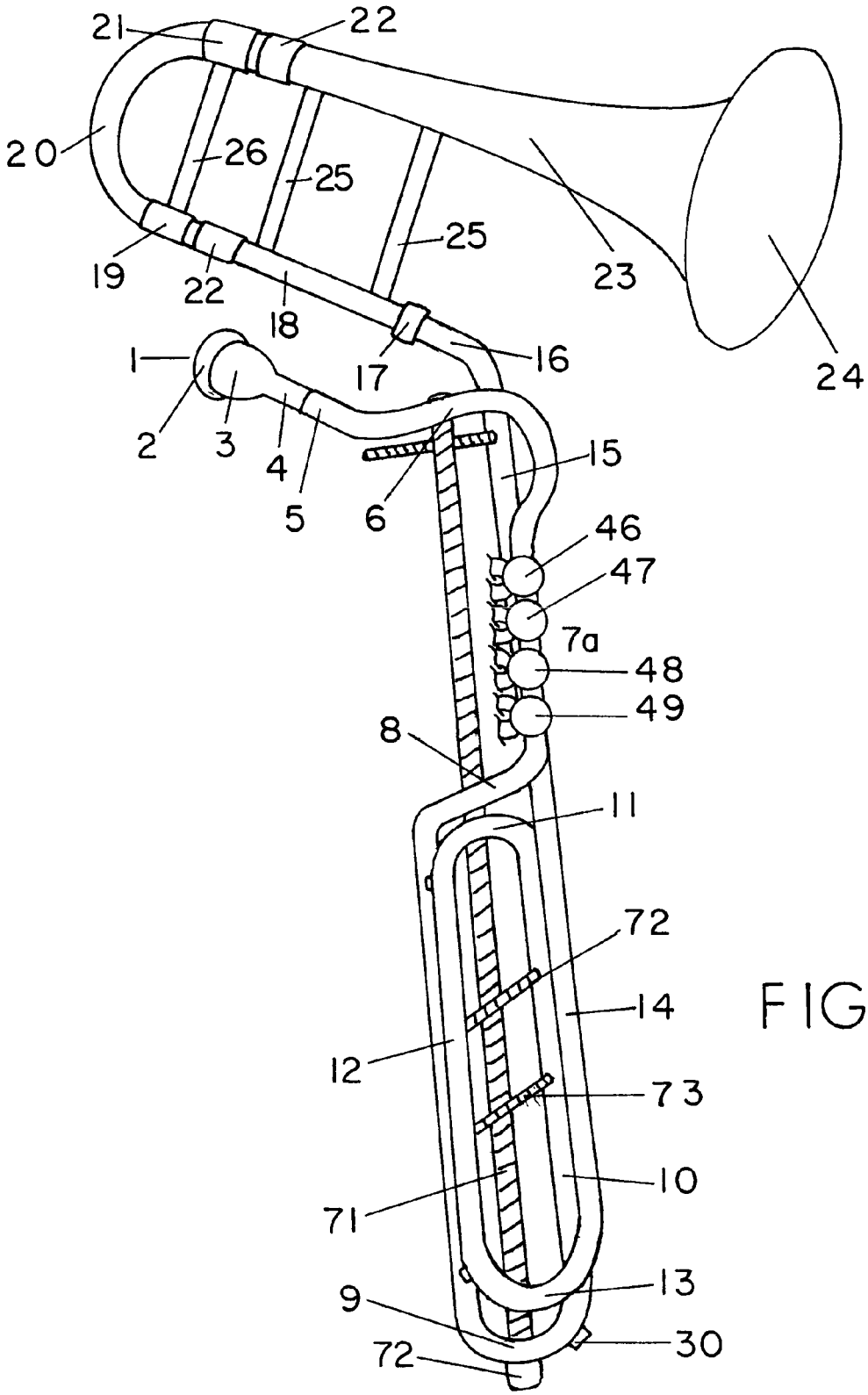

FIG. 16A illustrates an alternative tubing routing for a first embodiment invention BB-flat rotary valve Tu-Bone, with an "early placement" of the rotary valves (46–49) within the approximate 216 inch main BB-flat tubing path. Secondary length extension tubing loops have been omitted (truncated) and keypads and rotary valve linkages have also been omitted from the drawing to facilitate a simplified view of the main approximate 216 inch BB-flat air path. This Tu-Bone is attached to an adjustable height support cane (71) which rests on the floor, allowing a seated player's embouchure to comfortably reach a mouthpiece (1).

Figure 16B:
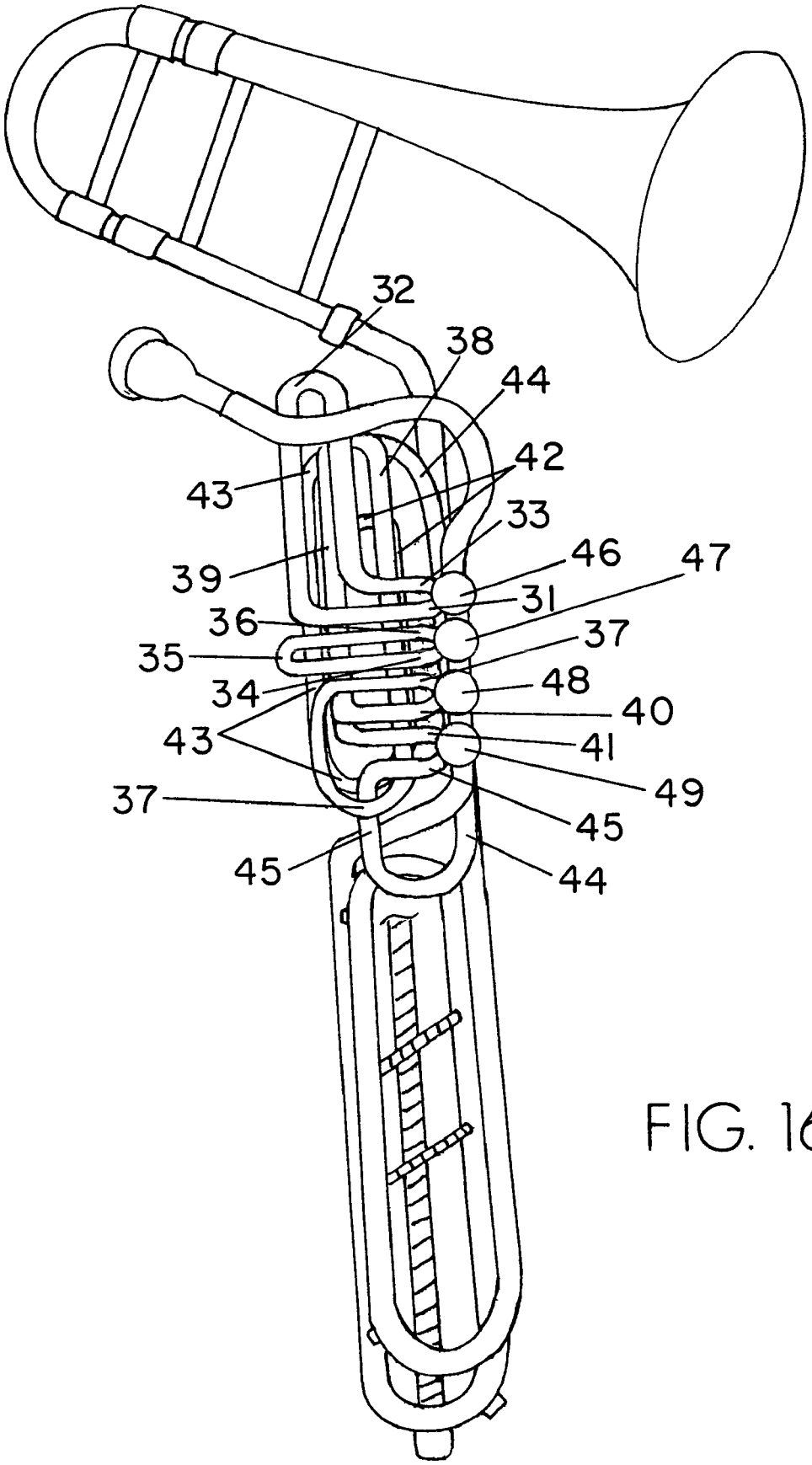

FIG. 16B is the same as 16A with addition of four secondary length extension tubing loops (31–33, 34–36, 37–40, and 41–45) attached to V1–V4, respectively. These FIG. 16B loops are identical to the correspondingly numbered loops of FIGS. 15B–E.

Figure 16C:
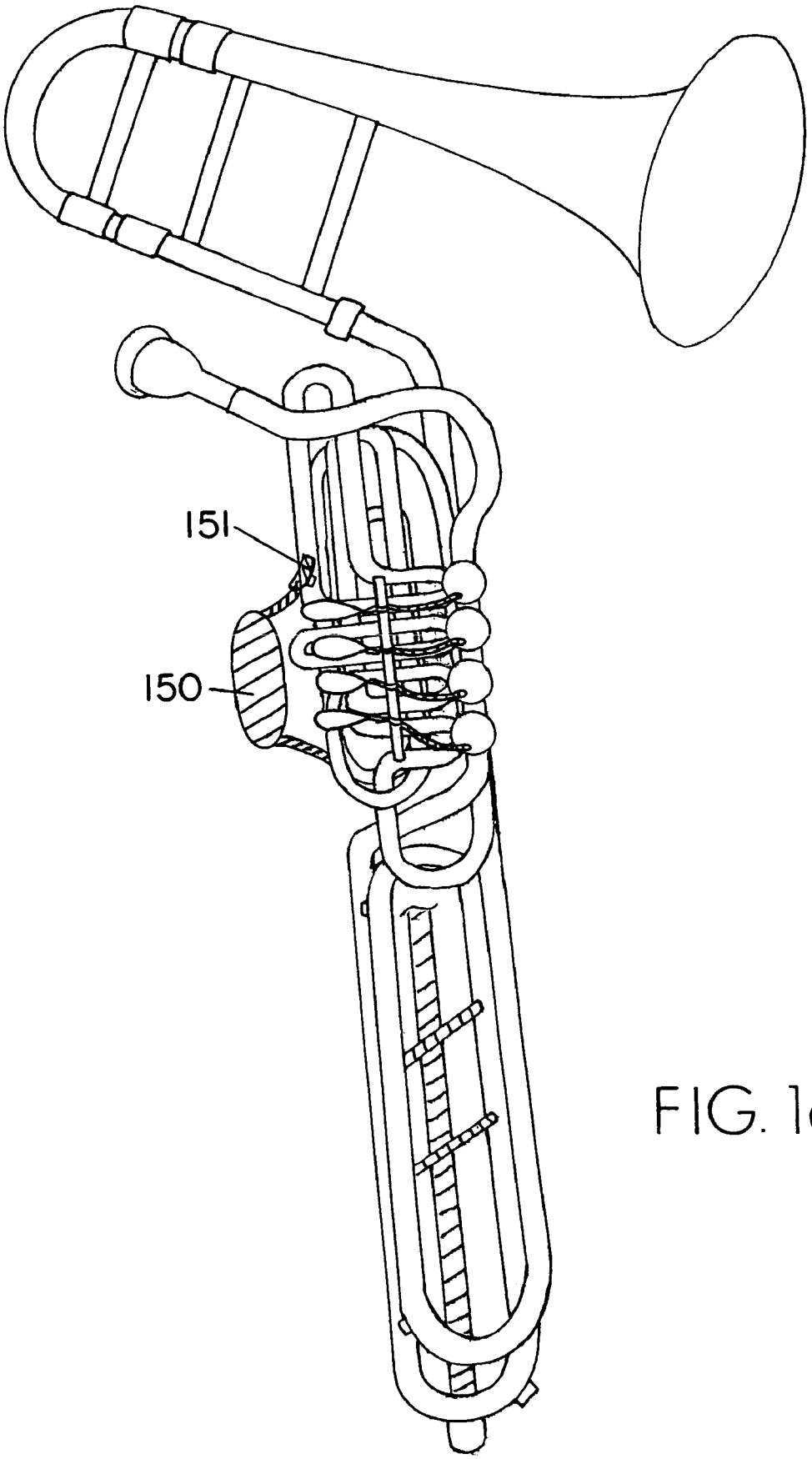

FIG. 16C is the same as 16B with addition of keypads, rotary linkage arms, palm rest (150) and thumb rest (151). This is a nonlimiting example of a complete first embodiment rotary valve BB-flat Tu-Bone, with "early" valve placement.

FIG. 17 A is an illustration of a nonlimiting example of a first embodiment four piston valve BB-flat Tu-Bone with "very early" placement of the piston valves (7). Valve tubing loops have been omitted to facilitate simplified inspection of the remaining approximately 216 inch BB-flat main air path.

Figure 17A:
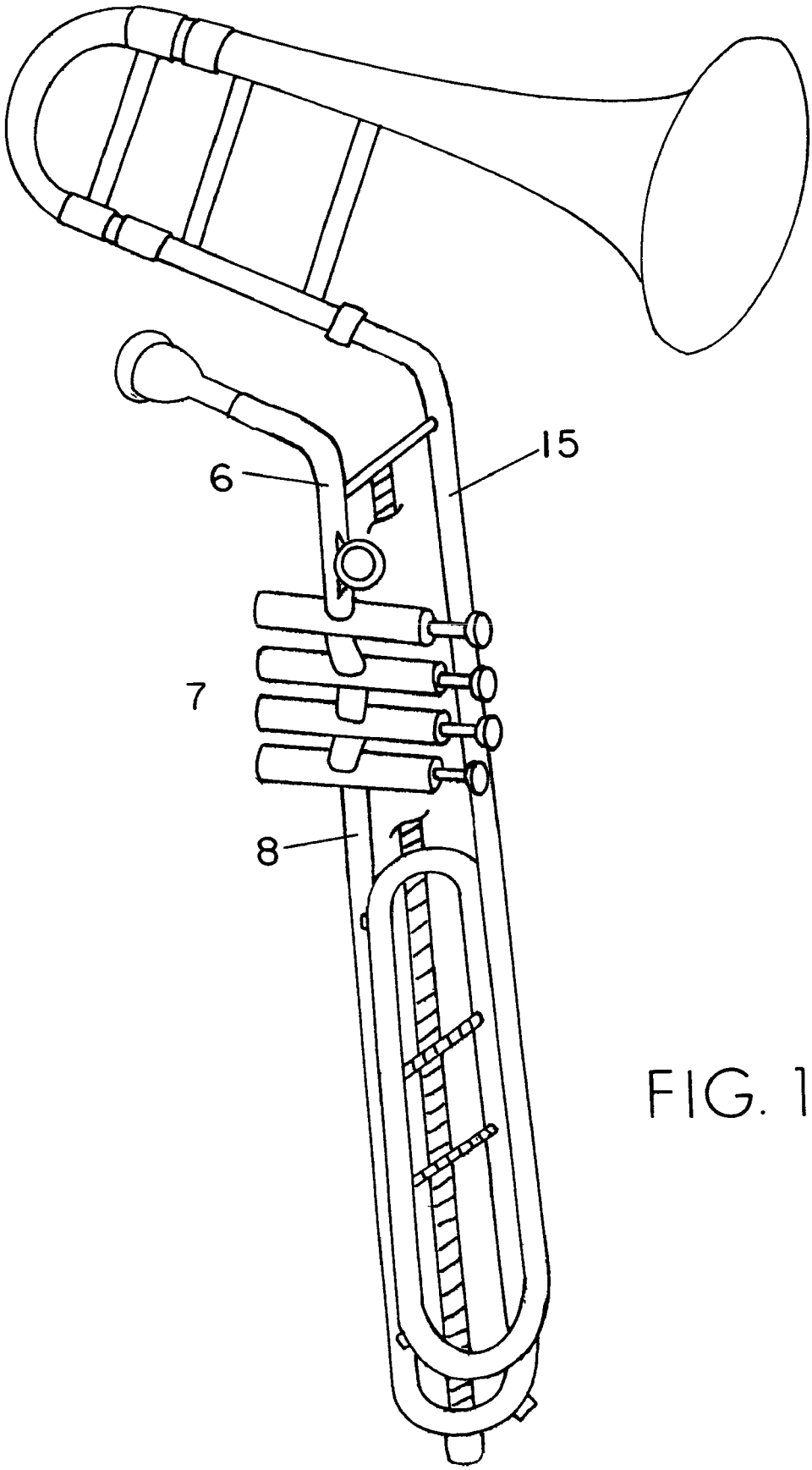
Figure 17B:
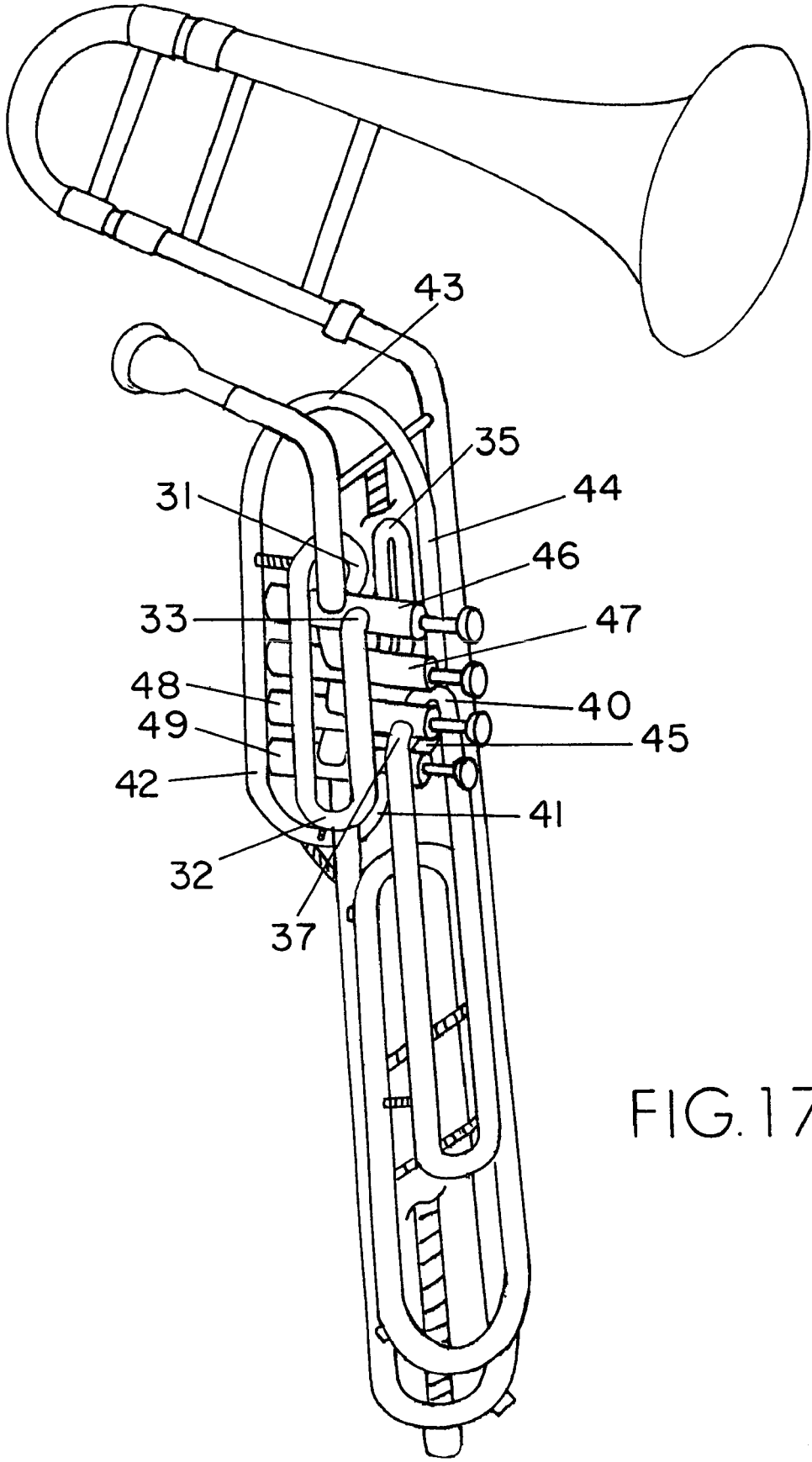

FIG. 17B is the same as 17A with addition of four secondary length extension tubing loops (31–33, 35, 37–40, and 41–45) attached to V1–V4 (46–49), respectively. This is a complete early placement four piston valve first embodiment BB-flat Tu-Bone.

Figure 17C:
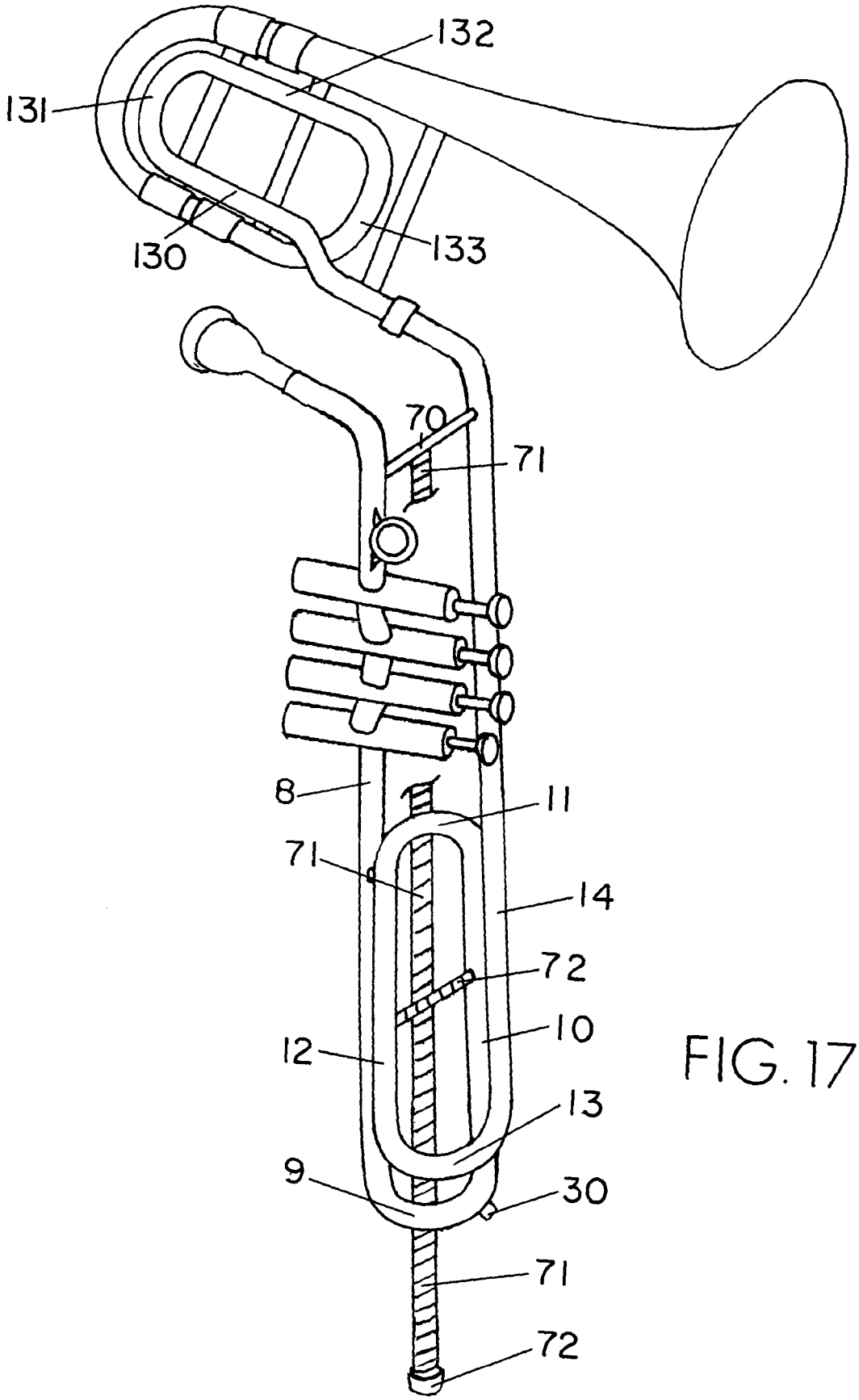

FIG. 17C is the same as 17A with main BB-flat path tubing segments 8, 10, 12, and 14 shortened to allow room (below crook 9) for downward Tu-Bone height adjustment (via adjustable-height floor cane (71)) above the floor for a seated performer of shorter stature. The length removed from tubing segments 9, 10, 12, and 14 has been restored in main path bell section loop 130–133 to maintain the original approximate 216 inch path corresponding to the musical key of BB-flat.

Figure 17D:
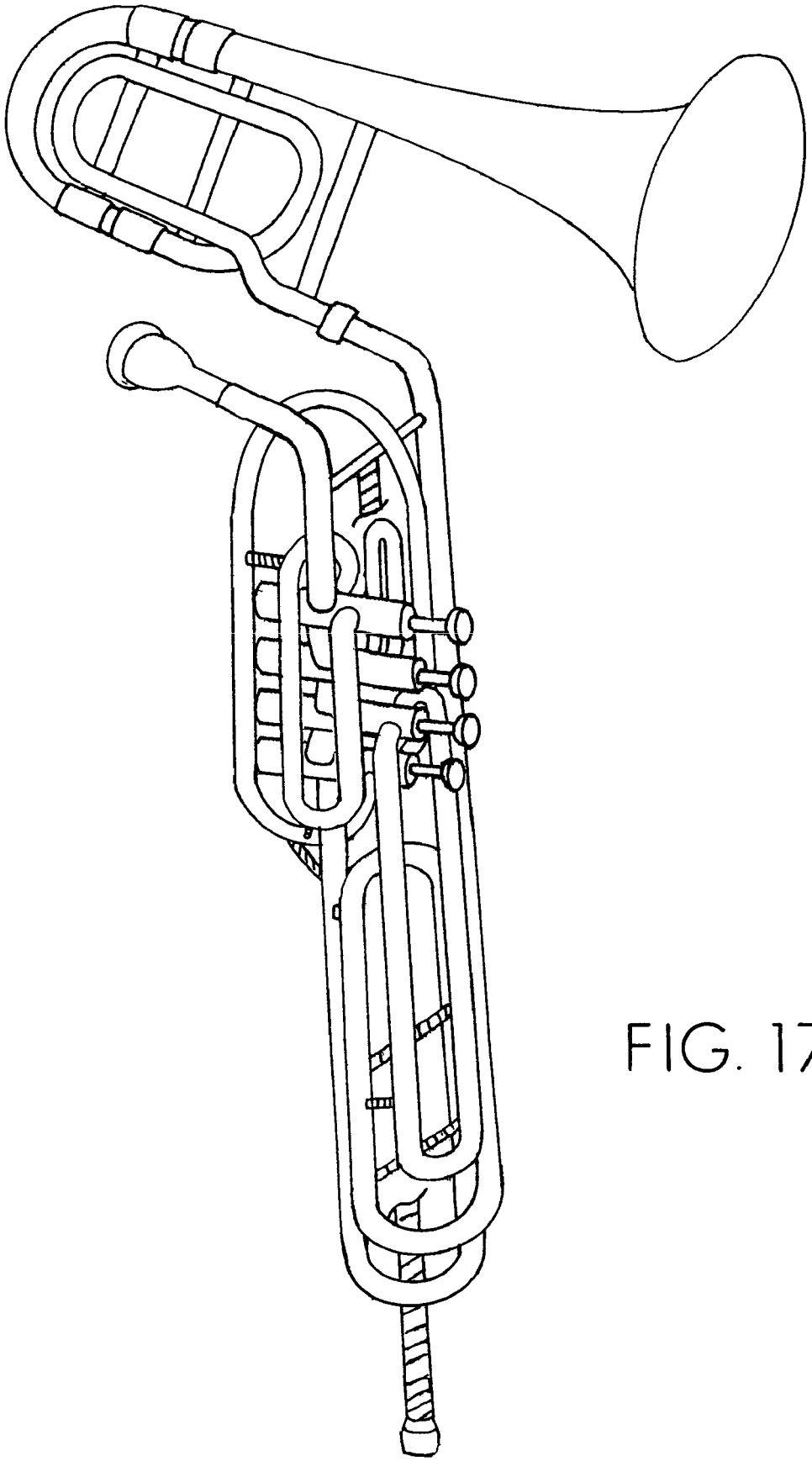

FIG. 17D is the same as 17 C with addition of the four secondary length extension tubing loops attached to V1–V4, respectively as in 17B. FIG. 17D is a complete early placement four piston valve first embodiment BB-flat Tu-Bone with enough floor cane (71) adjustment to accommodate "short" seated performers.

Figure 18:
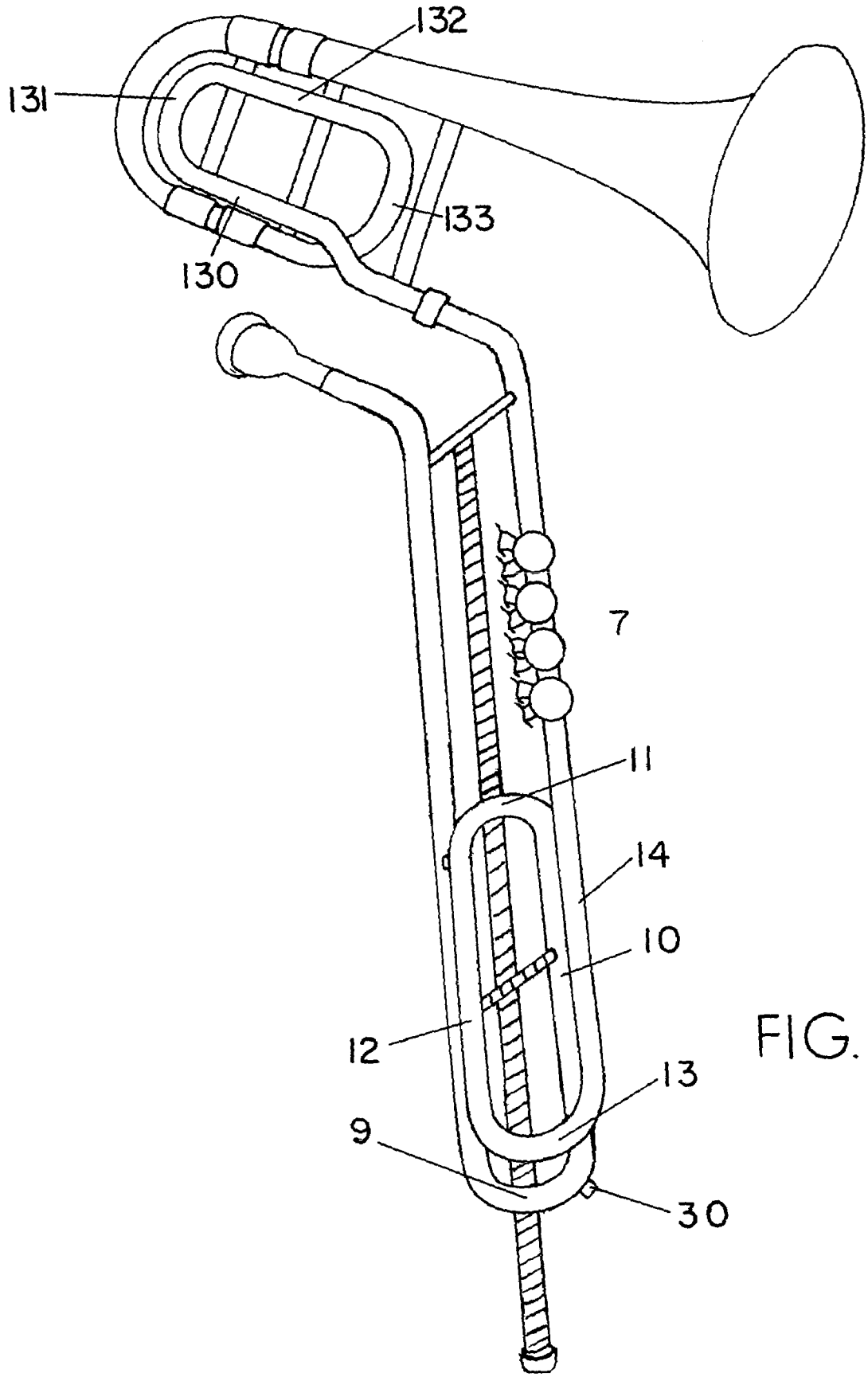

FIG. 18 is the same as 17C, except that late placement of the valve set (7) is employed and four rotary valves are substituted for the 17C piston valves.

Figure 19:
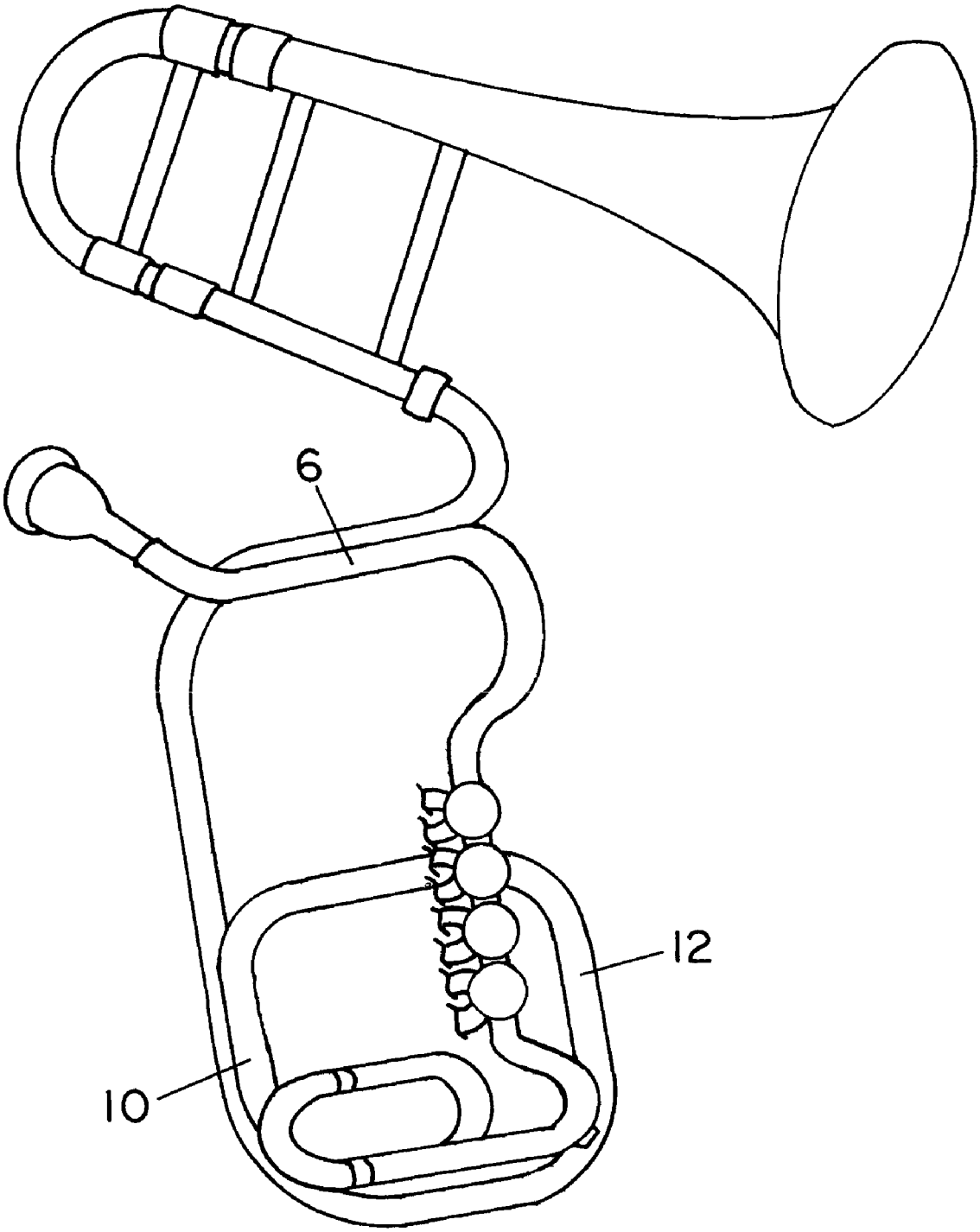

FIG. 19 is the same as 15A, except that main path tubing sections 6, 10, and 12 have been shortened to create an overall path length of approximately 192 inches, corresponding to a musical key of CC in this nonlimiting example of a second embodiment "early placement" rotary valve CC Tu-Bone. Other examples of CC tubones may include piston valves and may include early or late placement of either piston or rotary valves and still be within the scope of a second embodiment CC Tu-Bone invention.

Figure 20:
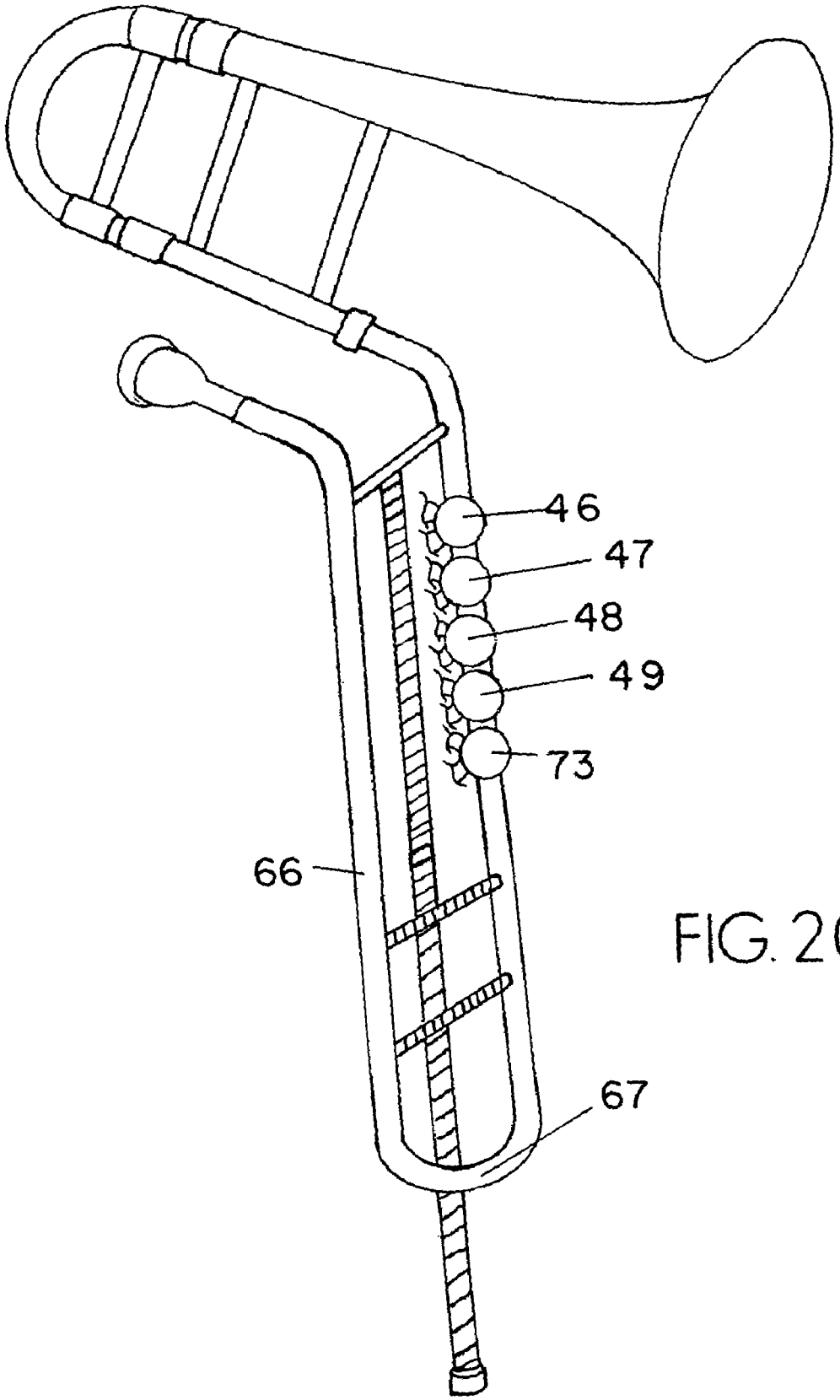

FIG. 20 is the same as 15A, except that a fifth valve (73) has been added, the valve section (46–49) is shown as a "late placement" example, and the main path length has been shortened to approximately 144 inches, corresponding to the musical key of F. Progressive mid-section (66, 67) bores are a key distinguishing feature of this third embodiment F Tu-Bone.

Figure 21:
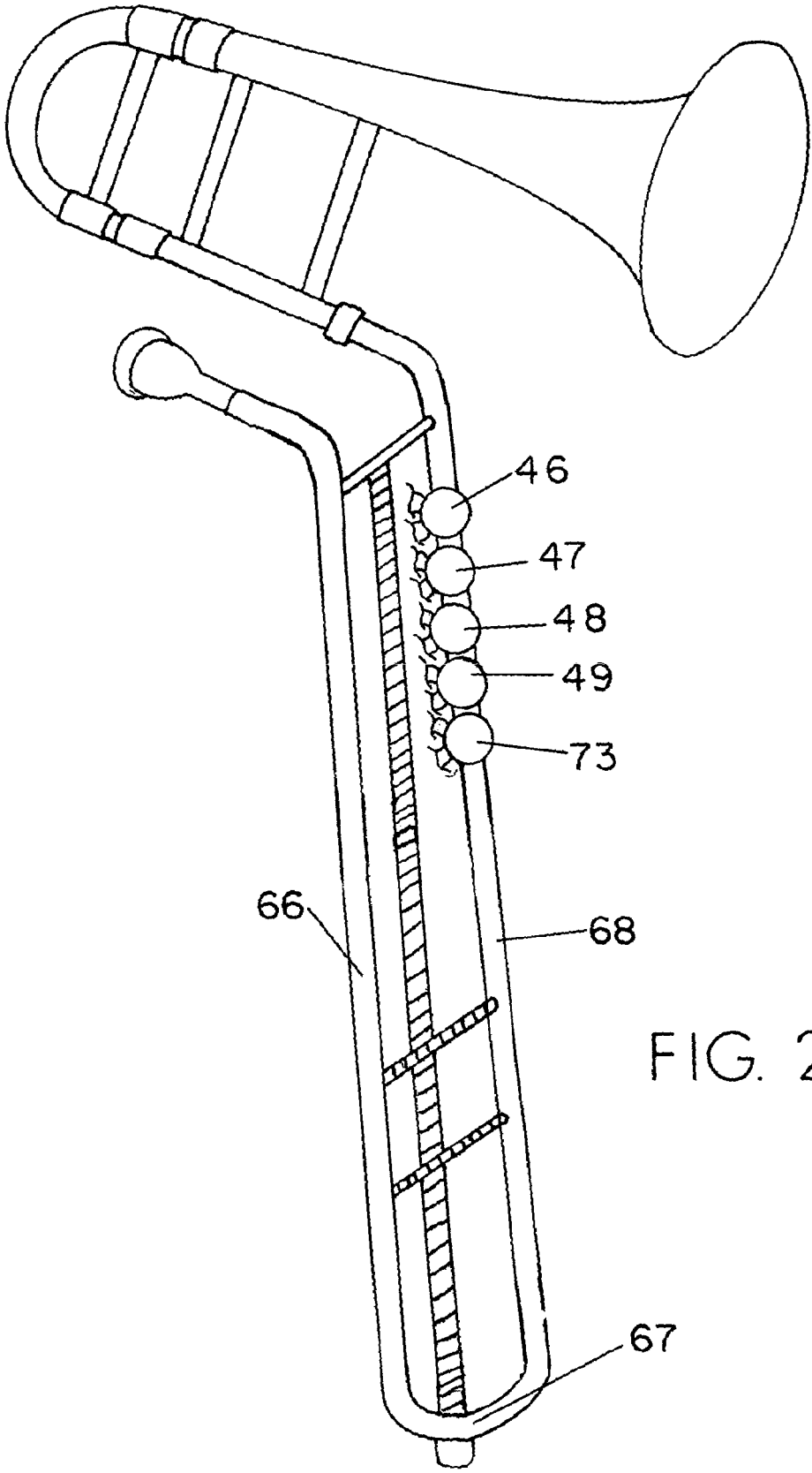

FIG. 21 is the same as 20, except that the main path tubing has been elongated in segments 66 and 68 to create a new main path total length of approximately 162 inches corresponding to the musical key of E-flat in this nonlimiting example of a fourth embodiment progressive mid-section bore E-flat Tu-Bone.

Figure 22A:
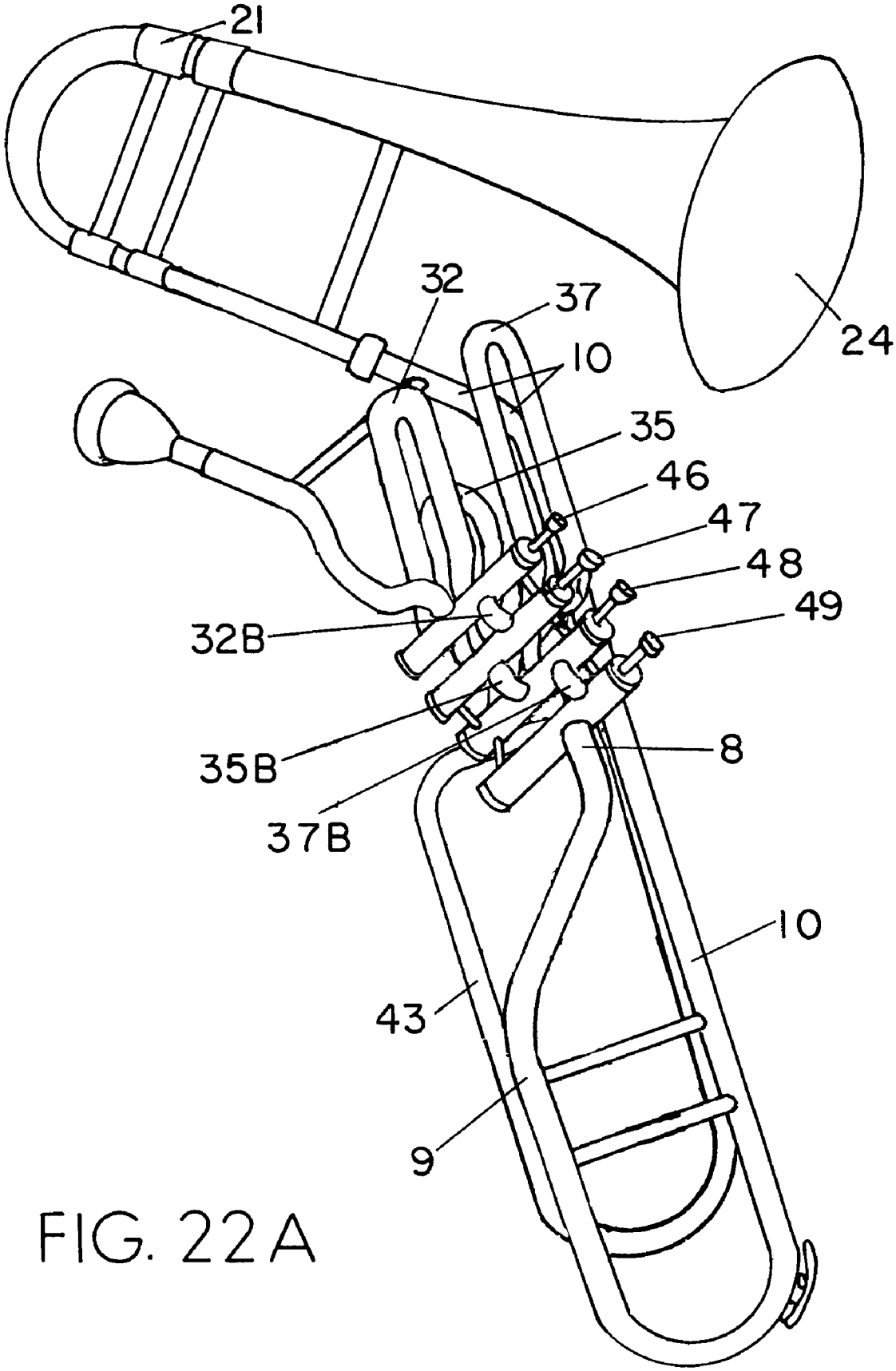

FIG. 22A is a fifth embodiment early placement four piston valve, approximately 108 inch main path, B-flat Tu-Bone.

Figure 22B:
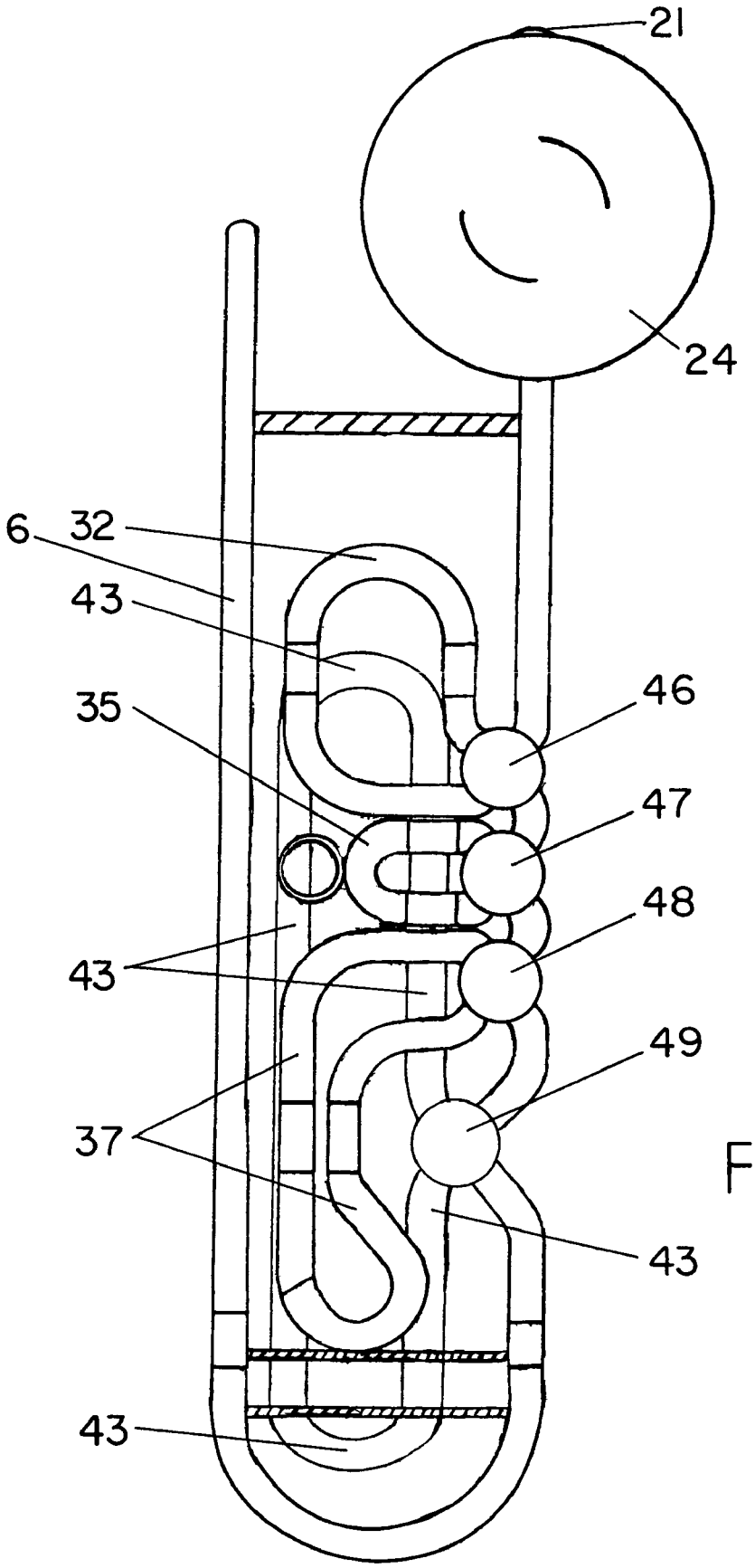

FIG. 22B is a late placement four rotary valve B-flat Tu-Bone

Figure 23A:
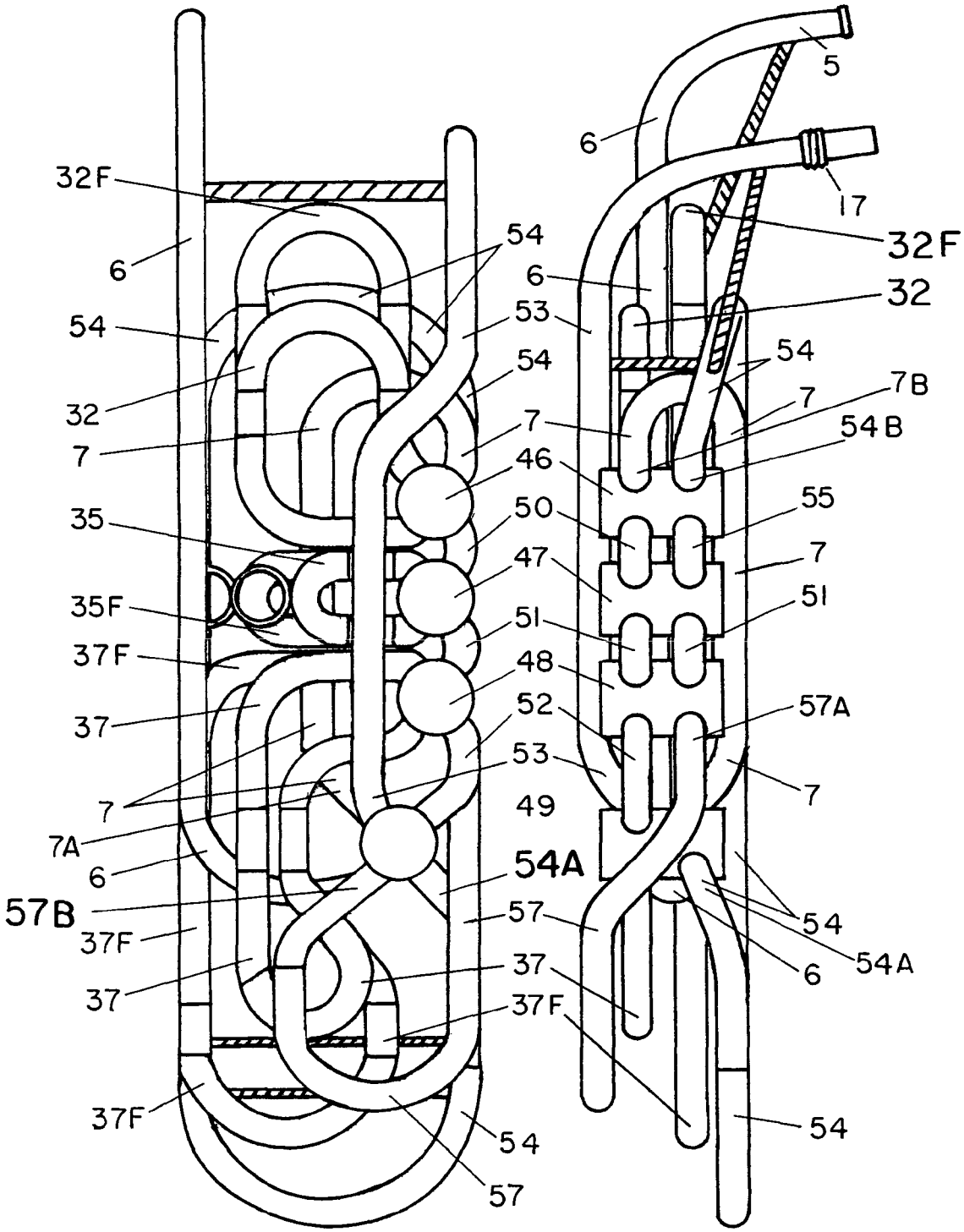

FIG. 23A illustrates a front view and an outward rotated side view of a sixth embodiment B-flat inverted full double Tu-Bone valve section with two story valves. The bell section has been omitted to allow a more expanded and detailed view of the valve section.

Figure 23B:
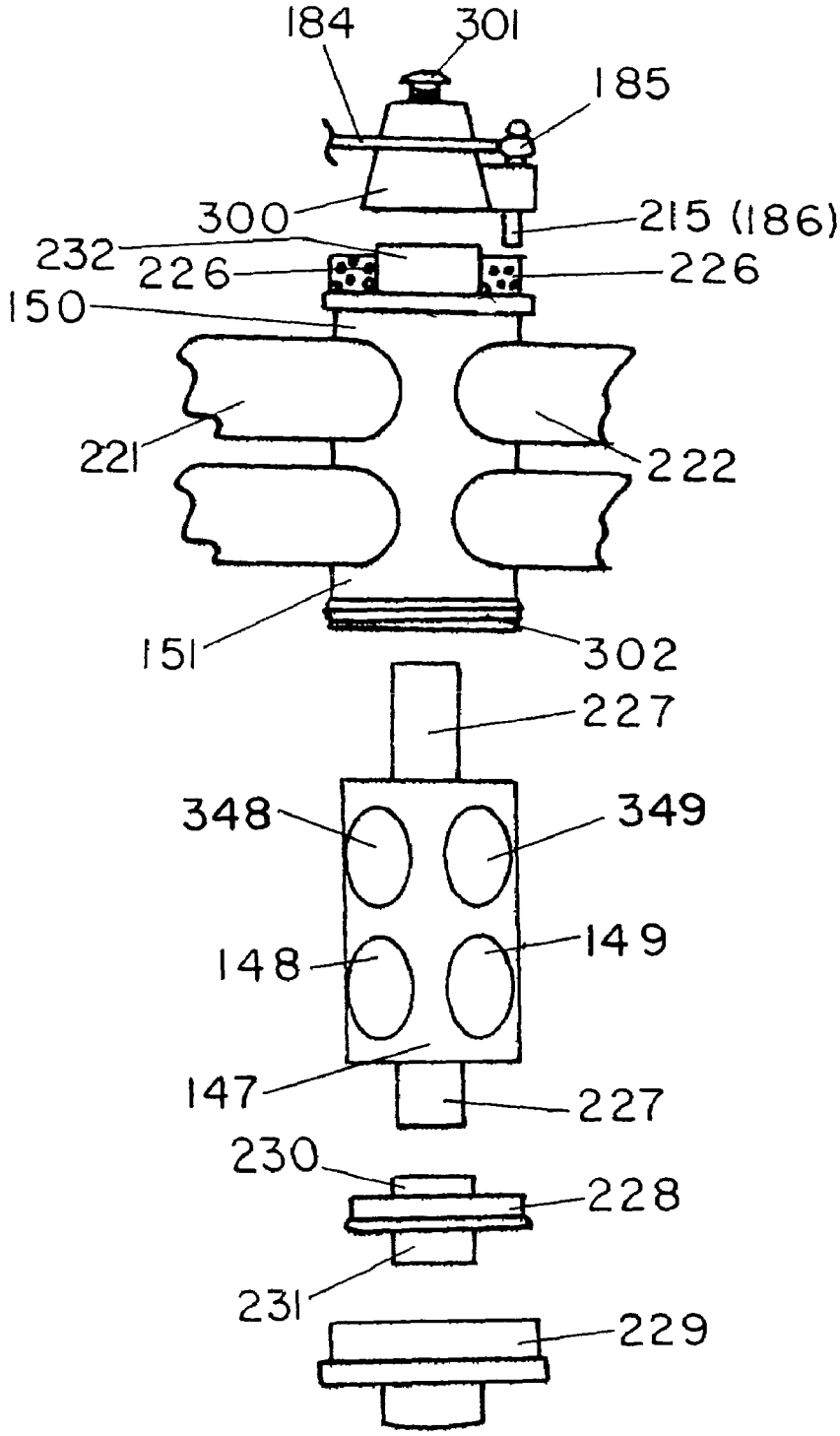

FIG. 23B is an exploded view of a two story, four passage valve selected from V1–V3 (46–49) from FIG. 23 A, shown in its disengaged first of two operating positions in which all four rotor openings shown (148, 149, 348, 349) are separate air passages proceeding back into the plane of the drawing.

Figure 23C:
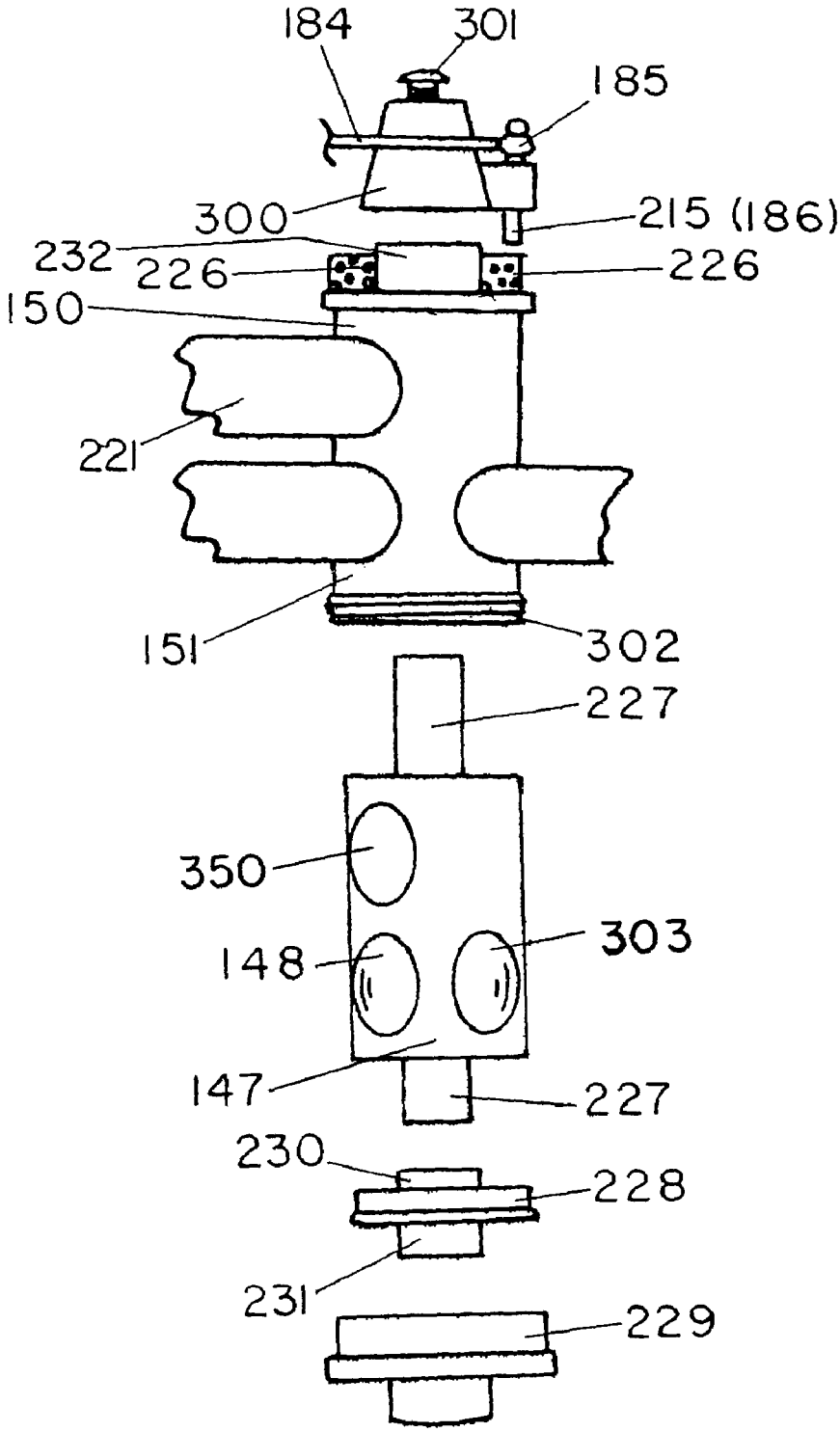

FIG. 23C is an exploded view of a two story two passage V4 valve from FIG. 23A, in a disengaged first of two operating positions in which rotor opening 350 is an air passage proceeding back into the plane of the drawing and 148 is one opening of a curved tunnel proceeding from left to right through the rotor (147) in the figure and 303 is just the opposite end of the same curved tunnel (148).

Figure 23D:
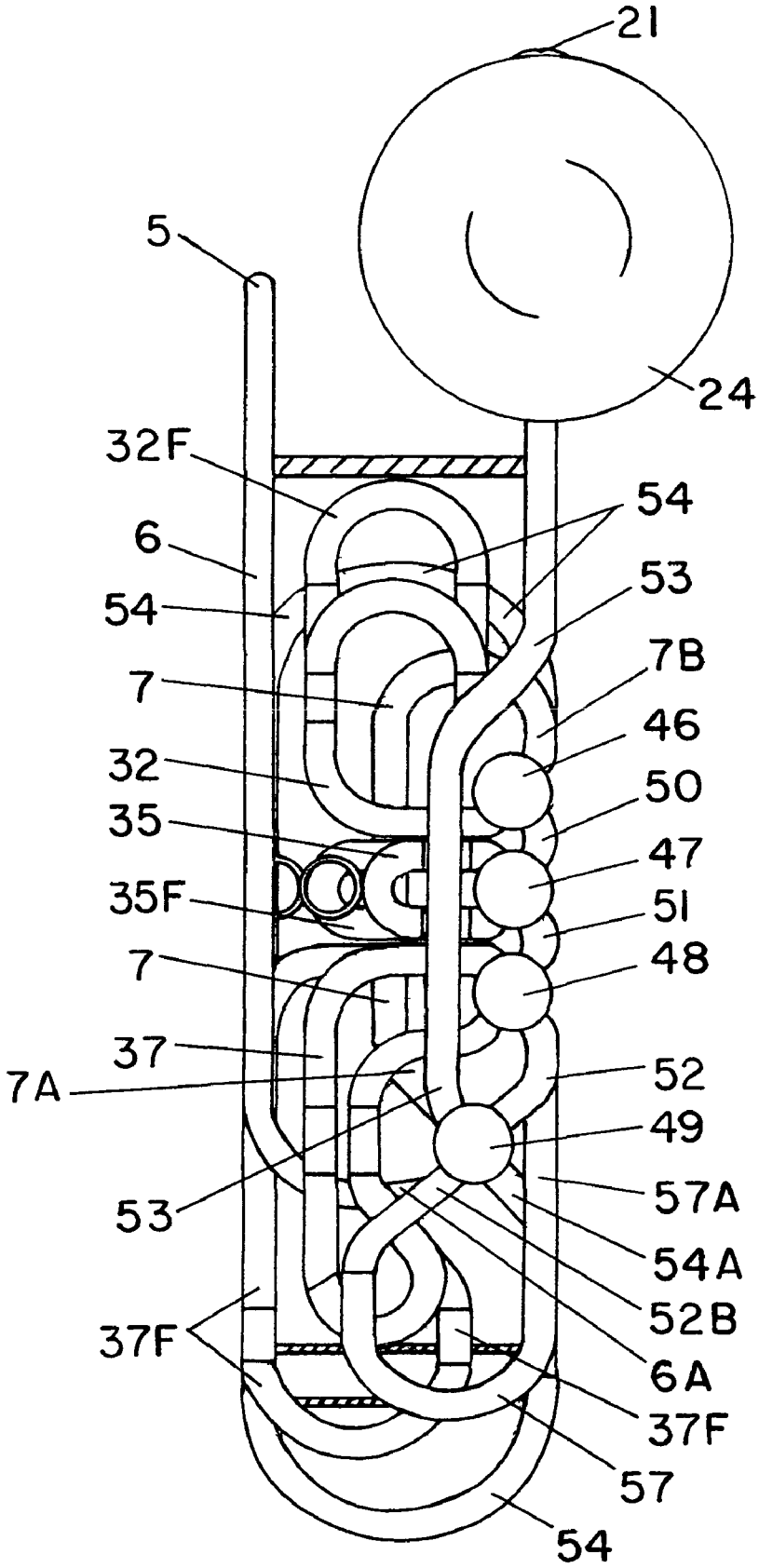

FIG. 23D is the same front view as 23 A, with addition of a bell section (23, 24) to complete the sixth embodiment inverted full double Tu-Bone in B-flat with four rotary valves. Rotary linkages and actuator key pads have been omitted from the drawing, but they would be within the scope of the invention.

Figure 23E:
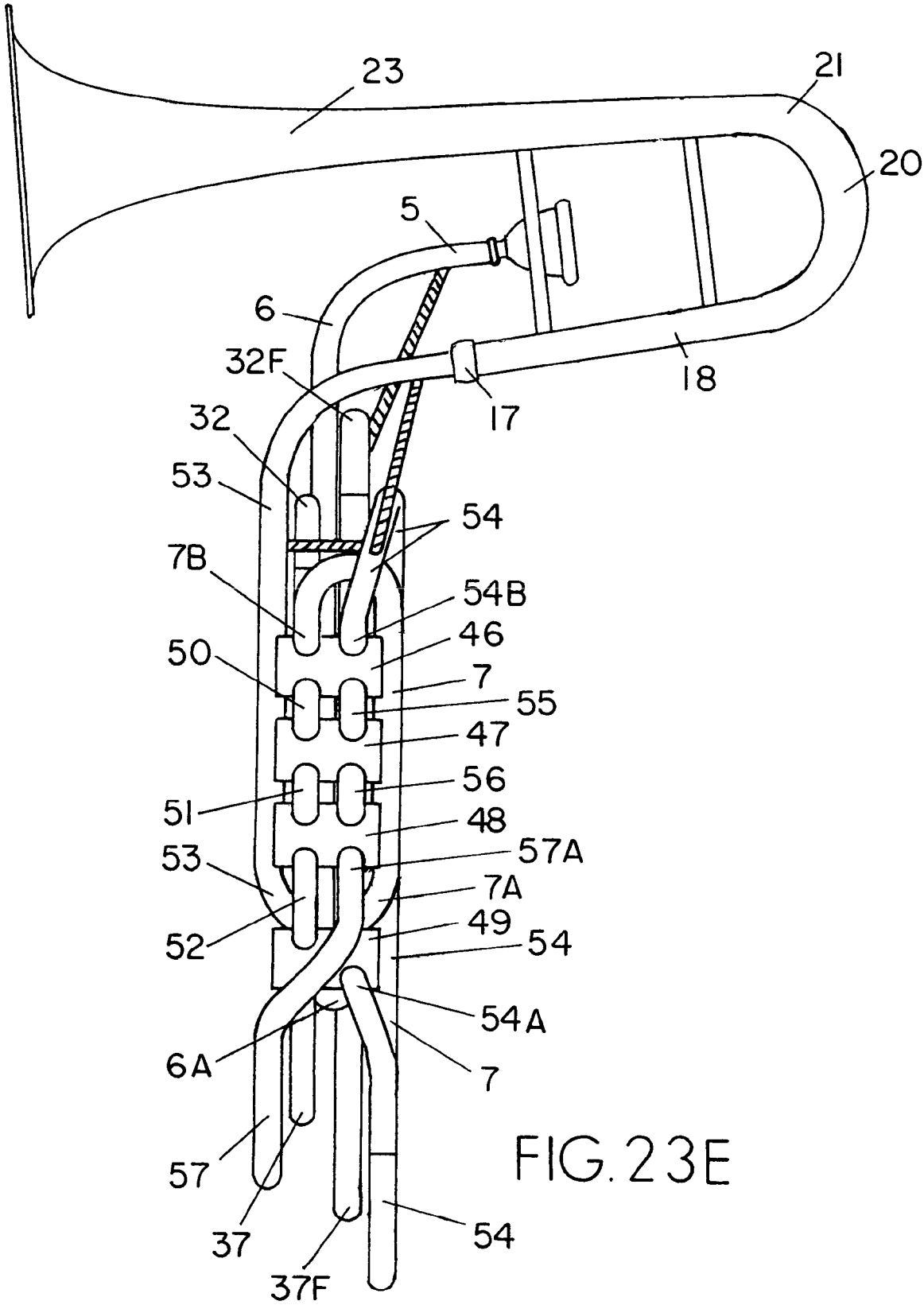

FIG. 23E is a side view of FIG. 23D.

Figure 24A:
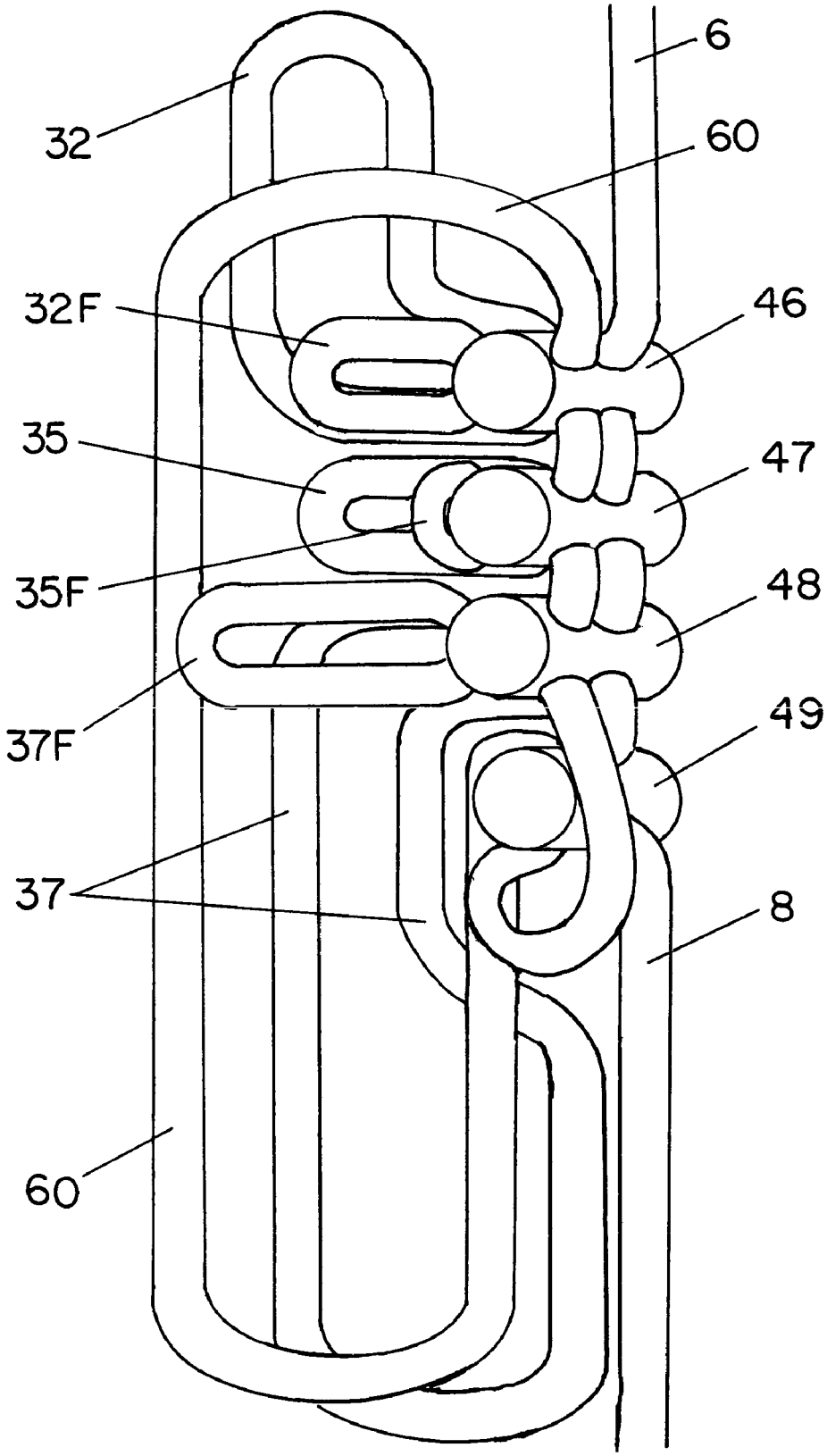

FIG. 24A illustrates a seventh embodiment "compensated" B-flat valve section for a four rotary valve B-flat Tu-Bone.

Figure 24B:
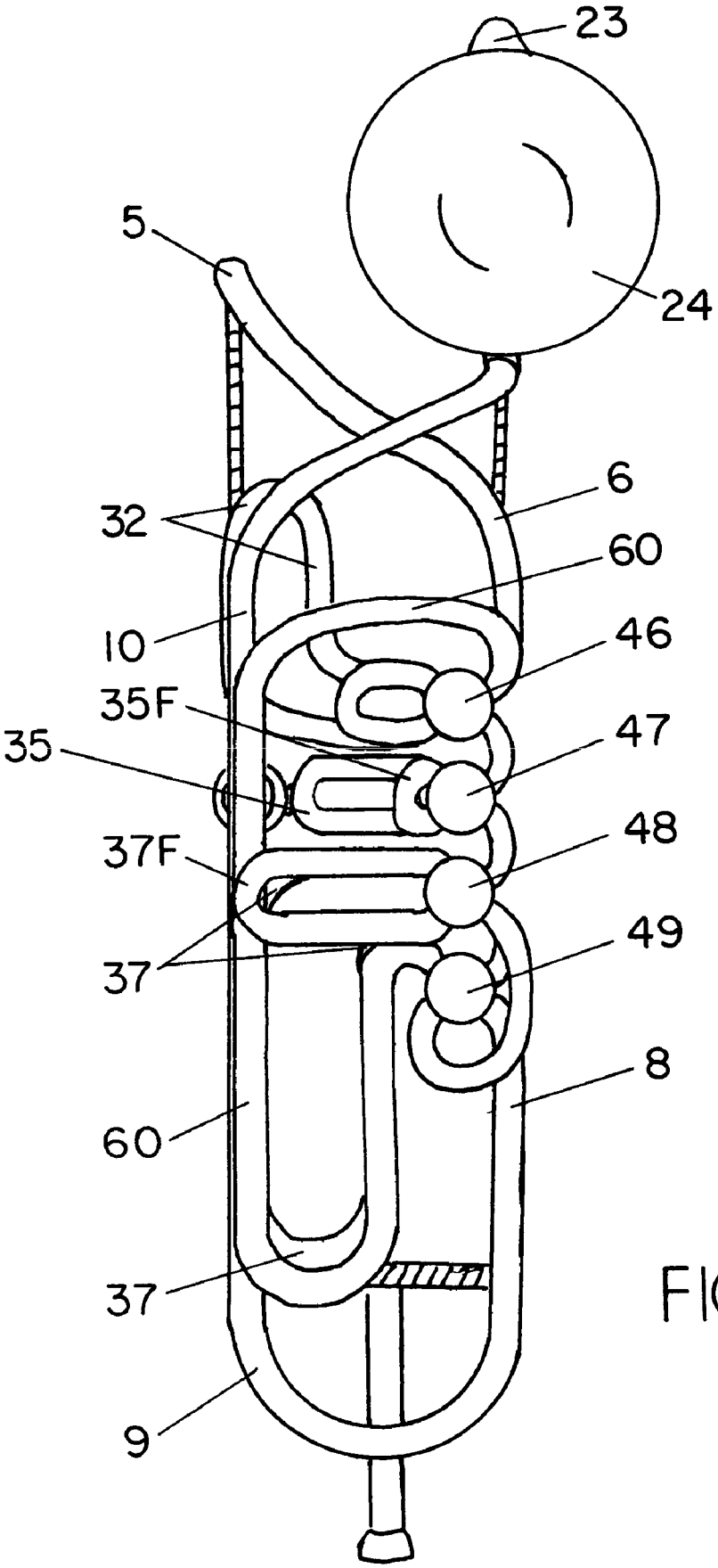

FIG. 24B is a front view of the same valve section as 24A with completion of tubing path and addition of bell section and mouthpiece receiver.

Figure 24C:
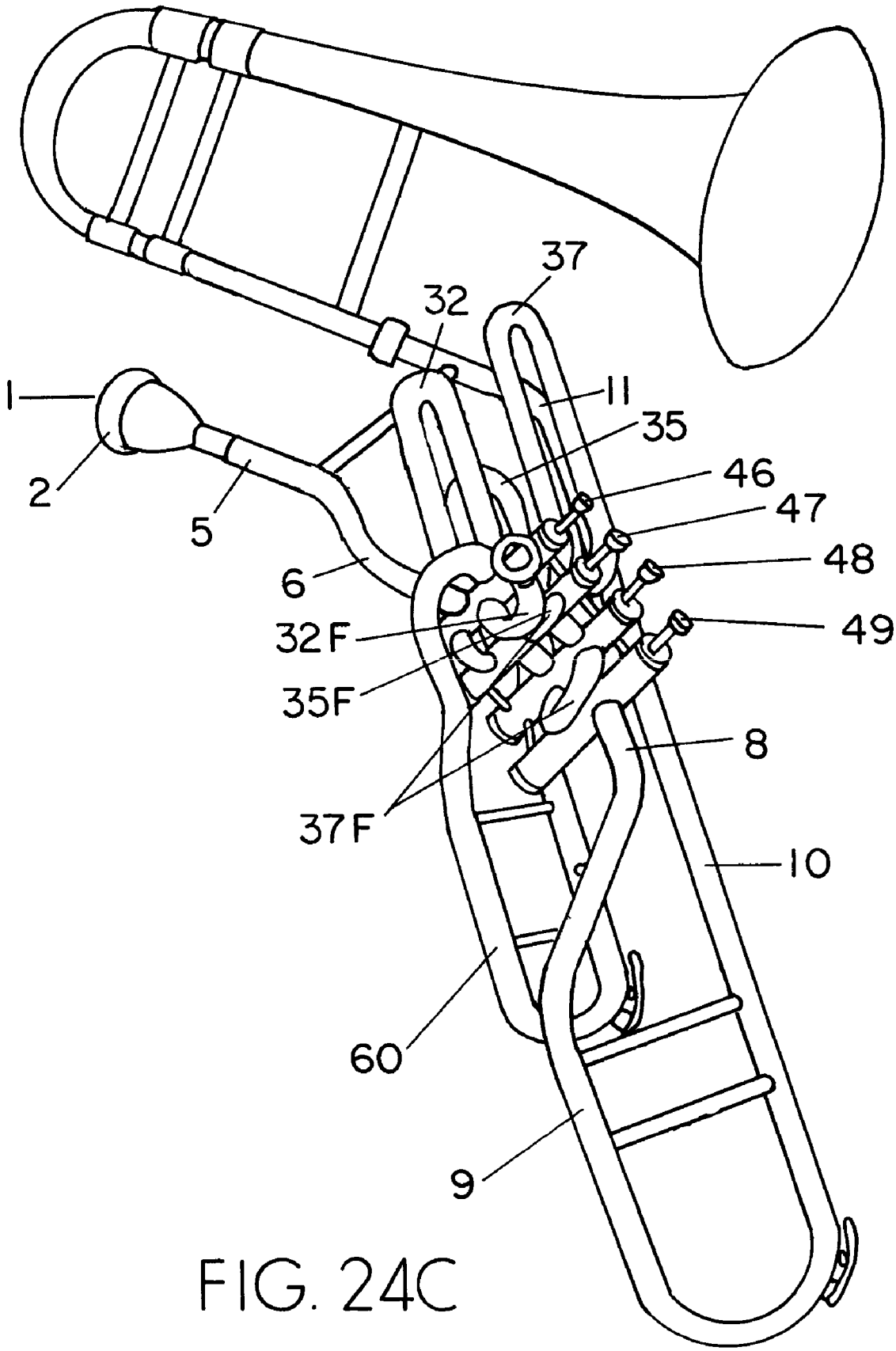

FIG. 24C illustrates a seventh embodiment "compensated" early placement B-flat four piston valve Tu-Bone.

Figure 25:
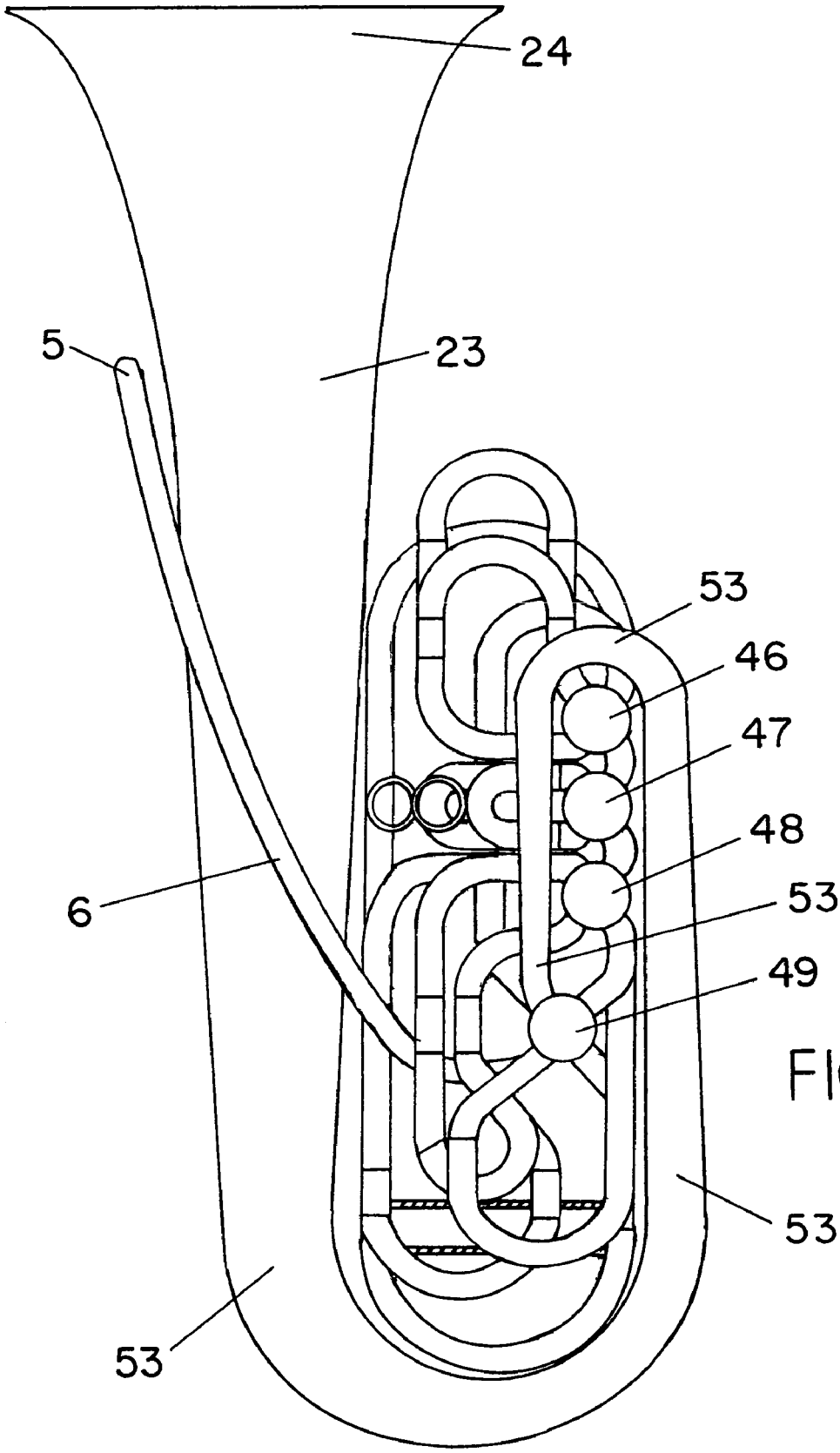

FIG. 25 illustrates an $11^{th}$ embodiment 4-valve B-flat independent "full double euphonium" with two story valves and 3 extra valve tubing loops for F-side of horn which are 50% longer than B-flat side tubing loops. Either B-flat side loops are activated when V1–V3 are engaged without engaging V4, or F-side loops are activated when V1–V3 are engaged simultaneously with V4 being engaged. The FIG. 25 valve section is essentially the same as FIG. 23 A.

DETAILED DESCRIPTION OF THE INVENTION

Referring to FIGS. 15A–F, in a first nonlimiting example of a first preferred embodiment, the invention concepts are applied as a BB-flat Tu-Bone comprising a mouthpiece receiver (5) and lead pipe (6), approximately 216 inches of main path tubing (5, 6, 8, 29, 9–18, 20, 23, 24) including a bell throat and bell flare (23, 24), in which a mid-section of the approximately 216 inch main path tubing length (7*a*, 8, 29, 9–17) is defined as commencing after the first 20% (e.g. ~5, 6) of total main air path instrument length, the mid-section comprising at least 10% and in preferred embodiments comprising approximately 45% (7*a*, 8, 29, 9–17) of the main air path, the mid-section exhibiting any gradual bore progression which does not exceed 0.850 inch bore and preferably does not exceed 0.790 inch bore within the first 65% of total tubing length, and in the mid-section in one nonlimiting example comprising at least one smaller cylindrical bore section followed by at least one larger cylindrical bore section (larger by at least 0.007 inch bore diameter), in which the interface between the at least two cylindrical bores is a sudden step in bore, or in which the interface is a conical or otherwise expanding tube, and in a second nonlimiting example comprising a gradual conical mid-section bore expansion not to exceed 0.85 inch bore in the first 65% of the approximately 216 inch main path tubing length, and in a third nonlimiting example comprising a combination progression of any cylindrical bores and conical bores which sequentially increase in bore, but do not exceed 0.850 inch bore within the first 65% of main path tubing length (5, 6, 8, 29, 9–18). The first embodiment further comprises at least three and preferably four air valves which may be rotary valves (7*a*, 46–49) of any prior art rotary valve design including conventional rotary valves, Shires, Greenhoe, Thayer, Lindbergh, Hagmann, Willson Rotax, or any other rotary valve design presently known or to become known in future, or they may be piston valves, and the first embodiment further comprises at least three and preferably four secondary length extension tubing loops (31–33, 34–36, 37–40, and 41–45).

Figure 11A:
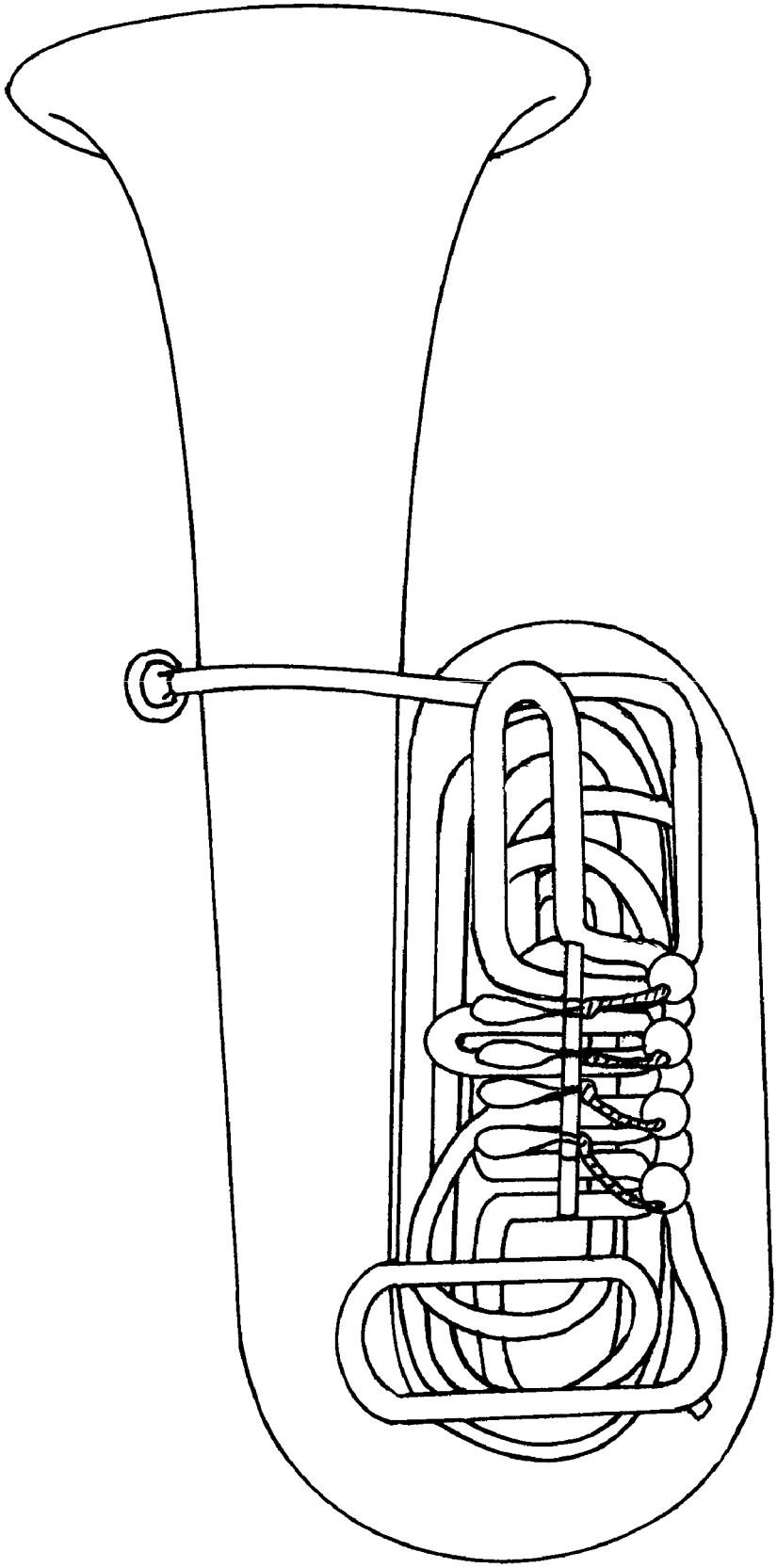
FIG. 11A (prior art)
FIG. 11A illustrates a prior art BB-flat rotary valve tuba.
Figure 11B:
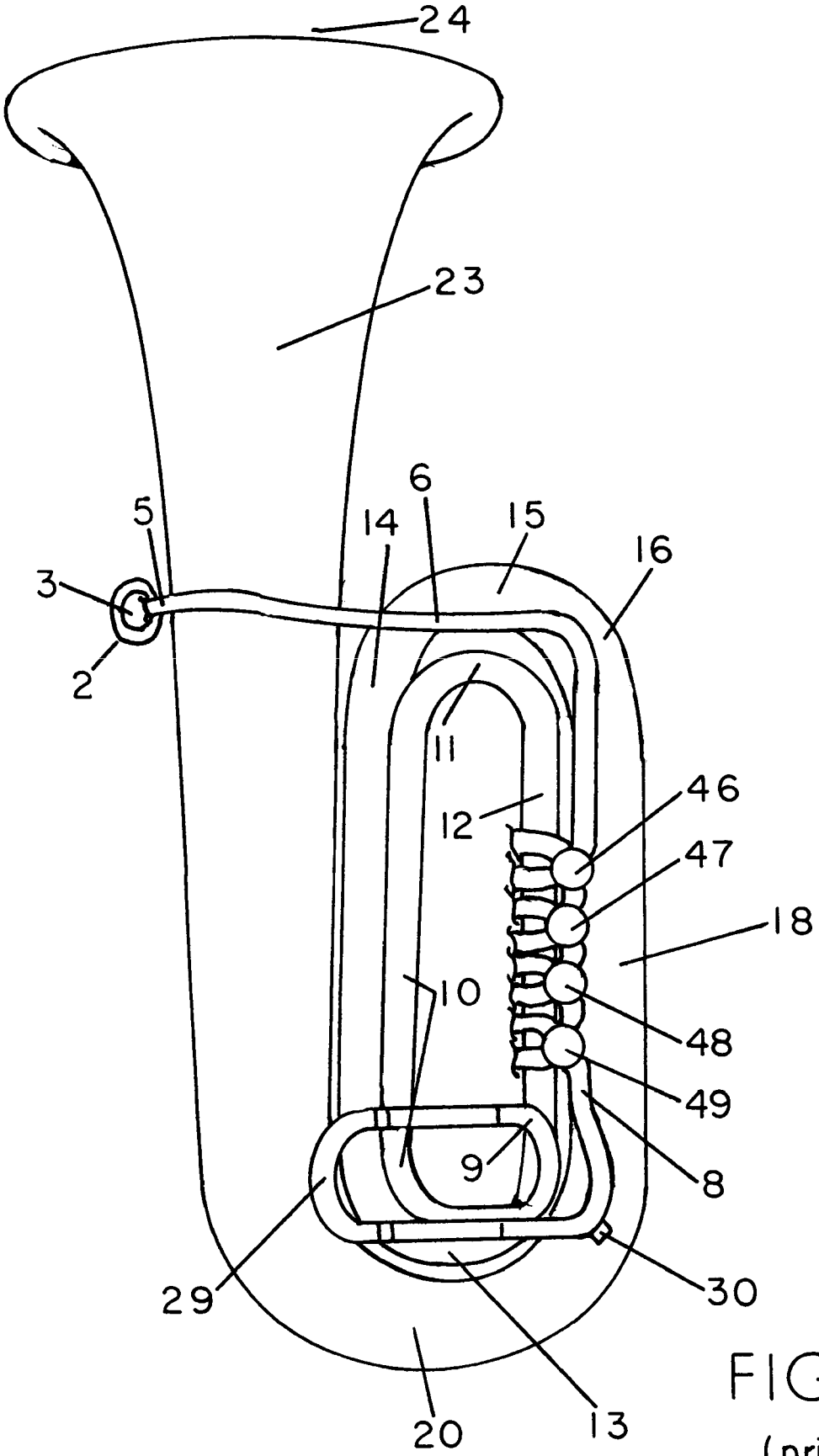
FIG. 11B (prior art)
FIG. 11B is the same as 11A, but with the valve tubing loops removed (truncated) and valve linkages removed to allow inspection of the conically expanding BB-flat main tubing path. Conical expansion begins at section 9, soon after air exits the valve section (46–49) and the tuning slide (29).
Figure 12:
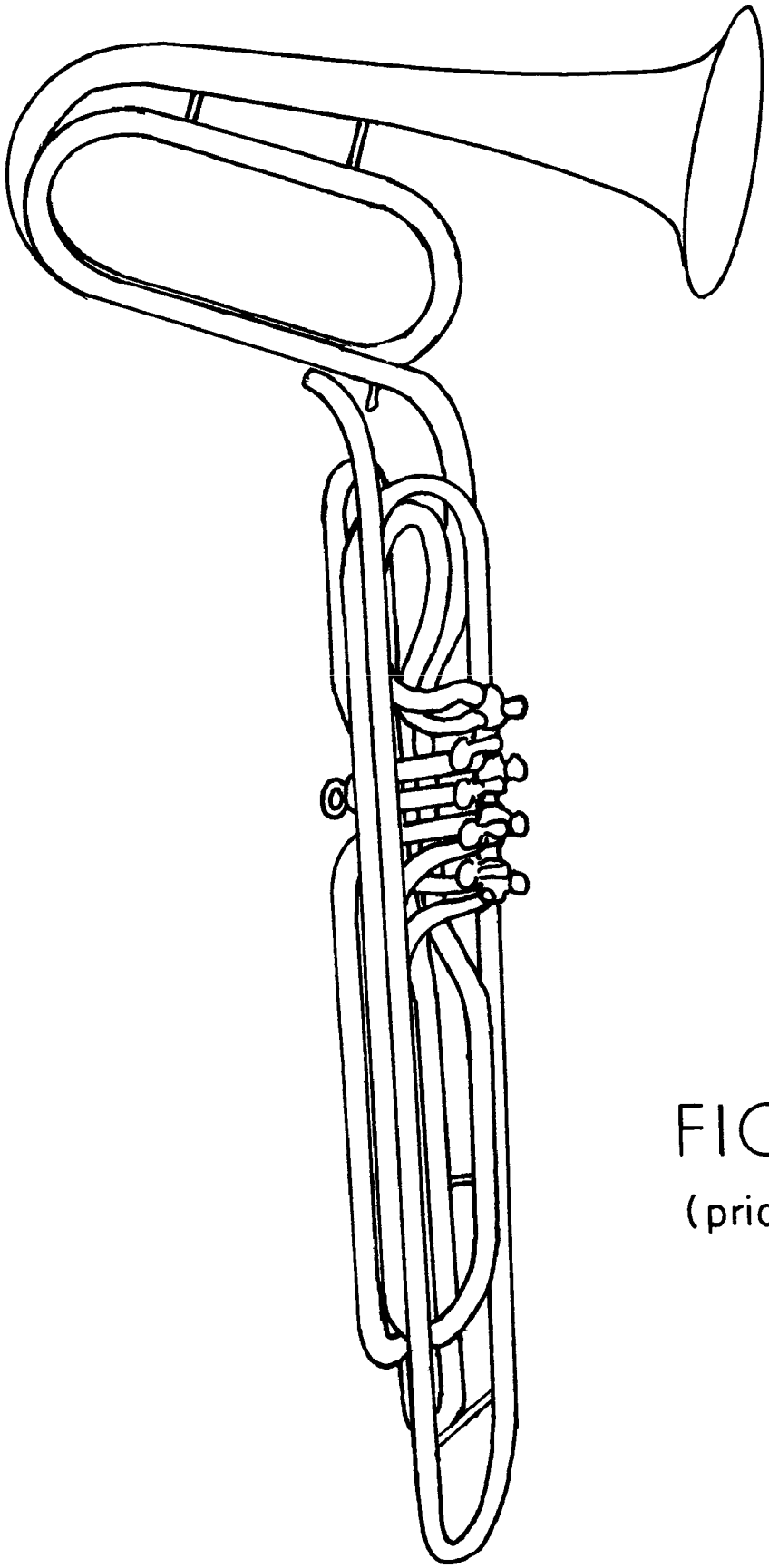
FIG. 12 (prior art)
FIG. 12 illustrates a prior art BB-flat cimbasso or BB-flat contrabass valve trombone or BB-flat "Trombone Basso Verdi" in a side view. This figure is manually redrawn with permission from a photographic image which may be viewed at internet site for historical musical instruments at the University of Edinburgh, UK.

FIG. 15A shows a non-limiting first example of the first embodiment BB-flat Tu-Bone with the at least three and preferably four rotary valves (7*a*), but with valve tubing loops truncated and valve keypads, and rotary linkages removed to facilitate a simplified inspection of the main approximately 216 inch BB-flat path (5, 6, 8, 29, 9–18, 20, 23, 24) which is the only active air path with no valves (7*a*) engaged. The radical difference in the limited (limited to 0.850 inch maximum bore) progressive cylindrical mid-section tubing bore or gradual conical mid-section bore expansion, or combination of limited progressive cylindrical and gradual conical mid-section bore expansion of the invention BB-flat Tu-Bone over a preferred majority of its main path length may be seen, relative to the significantly more rapid conical bore expansion of a BB-flat tuba, by comparing FIG. 15A with FIG. 11B. The small bell throat (23) diameter of the invention Tu-Bone, relative to the tuba may also be seen by comparing throat (23) in FIG. 15A with throat (23) in FIG. 11B. These major differences in main path mid-section progressive bore expansion rates and bell throat diameters collectively give the invention Tu-Bone a bass trombone tone quality which blends well with jazz trombone sections and operatic trombone sections, while the tuba has a "tubby" tone quality that does not blend well with trombone sections.

The valve section of FIG. 15A is also seen to be an "early placement" within the approximately 216 inch main BB-flat path, and because the earlier mid-section bores of this progressive bore system will be smaller bores, the early placement of valves allows use of smaller bore valves with less massive rotors and reduced internal friction. This allows for smoother operation and the use of shorter throw and reduced spring tension in operating the valve, so that it may be operated more nimbly in musical performance.

FIG. 15B is the same as 15A, with addition of the first two alternative length extension tubing loops. The first length extension tubing loop (31–33) is associated with valve V1 (46) and the second length extension tubing loop (34–36) is associated with valve V2 (47). With no valves engaged, air from the mouthpiece (1–4) moves to the receiver (5) down lead pipe (6) and enters V1 (46), bypassing the first loop (31–33) and exits V1 (46) to enter V2 (47), bypassing the second loop (34–36) and exiting V2 (47) to enter V3 (48). With no valves engaged, the 216 inch path length is maintained and the fundamental musical key remains as BB-flat. When V2 (47) is engaged alone, air entering V2(47) is diverted through the second alternative length extension tubing loop (34–36) and returns to V2 (47), prior to exiting V2 (47) and entering V3 (48). This added approximately 12.8 inches in series to the 216 inch path which makes a total path length of approximately 228.8 inches corresponding to a fundamental pitch of AA. When V1 (46) is engaged alone, air entering V1 (46) is diverted through the first alternative length extension tubing loop (31–33) and returns to V1 (46), prior to exiting V1 (46) and entering V2 (47). This added approximately 26.5 inches in series to the 216 inch path which makes a total path length of approximately 242.5 inches corresponding to a fundamental pitch of AA-flat.

FIG. 15C illustrates addition of a third "knotted coil" secondary extension tubing loop (37–40) associated with V3 (48), and with the first two loops of FIG. 15B removed to simplify inspection of the V3 loop (37–40). When V3 (48) is engaged alone, air entering V3 (48) is diverted through the third alternative length extension knotted coil tubing loop (37–40) and returns to V3 (48), prior to exiting V3 (48) and entering V4 (49). This added approximately 41 inches in series to the 216 inch path which makes a total path length of approximately 260 inches corresponding to a fundamental pitch of GG.

So far, by activating V1 alone, and then V2 alone, and then V3 alone, we have decremented the fundamental instrument pitch in half-step chromatic intervals from BB-flat to AA, and then to AA-flat, and then to GG. The next chromatic half step down from GG would be GG-flat, and that is achieved by activating valves V2 (47) and V3 (48) at the same time, which simultaneously adds the second (34–36) and third (37–40) loops of FIGS. 15B–C together in series with one another and also in series with the remaining instrument path to add a total of approximately 68 inches bringing the total path to about 284 inches, corresponding to a fundamental instrument pitch of GG-flat.

FIG. 15D illustrates addition of a fourth "convoluted coil" alternative secondary extension tubing loop (41–45) associated with V4 (49) in which a segment of the convoluted coil is hidden behind valves V1–V4 (46–49), and in which the first three coils of FIGS. 15 B and C have been removed to facilitate simplified viewing of the fourth "convoluted coil" secondary extension tubing loop (41–45) associated with V4 (49) in FIG. 15D. When V4 (49) is engaged alone, air entering V4 (49) is diverted through the fourth alternative secondary length extension tubing loop (41–45) and returns to V4 (49), prior to exiting V4 (49) and proceeding through the remaining main air path (8, 29, 9–18) tuning bow (20), bell throat (23) and bell flare (24). This added approximately 85 inches in series to the 216 inch path which makes a total path length of approximately 301 inches corresponding to a fundamental instrument pitch of FF.

FIG. 15E shows all four alternative secondary length extension tubing loops from the earlier first embodiment drawings 15B–D added together to make a nearly complete first embodiment Tu-Bone in a nonlimiting example. FIG. 15F shows further addition of rotary valve linkages and valve activation key pads (50–53) as well as an optional palm rest (150) and thumb rest (51) in a nonlimiting example of a first example of a complete first preferred embodiment BB-flat invention Tu-Bone. This embodiment will be particularly familiar to tuba players as it is dimensioned and shaped to rest in the lap of a seated tuba player (Tu-Bone "doubler"), like the BB-flat tuba of FIGS. 11A–B. This embodiment further illustrates an "early" valve placement made possible with use of mid-section progressive tubing bores. Since the mid-section main path tubing bores of a first embodiment Tu-Bone are yet relatively small early in the path (closer to the mouthpiece), the "early" valve placement then allows use of smaller bore valves and smaller bore valve tubing loops. This allows for a lighter weight, more compact instrument, and the smaller, lighter valves may exhibit a shorter throw, exhibit less internal friction, and require less spring tension on the valve linkages, giving the valve section a "lighter touch" and allowing more "nimble" musical performance for difficult, fast moving, musical passages.

FIG. 15 G illustrates the main path (only) of another example of a first embodiment Tu-Bone with only three valves, and these are illustrated as piston valves, but they may be either rotary valves or piston valves. Valve tubing loops and linkages have been omitted for simple observation of the main path and "early" valve placement within the main path. It may be envisioned that valve placement may be even earlier than shown in FIGS. 15 A–G if tube (6) is shortened more than illustrated, and tubing sections 10 and 12 are lengthened more than illustrated to make up the same 216 inch total.

FIG. 15 H illustrates that four piston valves may also be used in a first embodiment "early placement" valve set, enabled by the invention progressive bores.

FIG. 16A illustrates a second example of tubing routing for a first embodiment rotary valve BB-flat Tu-Bone with "early" valve placement, and in which valve tubing loops have been removed (truncated) to facilitate simplified viewing of the main BB-flat path. In this case, the instrument is attached to a cane (71) which rests on the floor. FIG. 16B is the same as 16A with valve tubing loops added. FIG. 16C is the same as 16B with rotary valve linkages and valve activation key pads added, along with an optional palm rest (150) and optional thumb rest (151). The 1$^{st}$ embodiment BB-flat Tu-Bone of FIG. 16 C is meant to rest on the floor between a seated performer's legs (like a cello), so there is no need to hold up the weight of this horn during performance.

FIG. 17A illustrates a piston valve model of first embodiment BB-flat Tu-Bone with valve tubing loops removed for simplified inspection of the main BB-flat path. It is also of the "very early" valve placement design which allows for relatively smaller bore, "short light action" piston valves and nimble musical performance. FIG. 17B is the same as 17A with addition of one possible routing of piston valve tubing loops in a nonlimiting example.

FIG. 17C illustrates and early placement piston valve arrangement (main path only) in which the bell section has an extra coil (130–133) which lessens the length requirements of lower main path coils (8–10 and 11–15) to make up the 216 inch BB-flat main path total. This raises the FIG. 17C instrument up off of the floor more than the embodiments of FIGS. 16A–17B and allows more adjustment range of the height of cane (71) to accommodate shorter performers. (The FIG. 17C embodiment may be lowered (more than shown) on the adjustable cane (71) for a shorter performer.) FIG. 17D is the same as 17C with addition of one nonlimiting example of valve tubing loops to complete the piston valve first embodiment (early valve placement) BB-flat invention Tu-Bone.

All first embodiment BB-flat examples illustrated in FIGS. 15–17 have the 216 inch main path, the progressive mid-section bore options (progressive cylindrical, gradually expanding conical, or combination of the two), at least three and preferably at least four air valves, at least three, and preferably at least four secondary length extension tubing loops, and bass trombone shaped bell (23, 24). It should also be noted that "late" valve placements such as in FIG. 18 may also be employed and still be within the scope of the first embodiment BB-flat Tu-Bone.

Combinations of V1, V2, V3, and V4 (46–49) may then be employed with all of the above illustrated FIGS. 15–18 first embodiment BB-flat Tu-Bones, in addition to variation in the human lip vibrational frequency to access all of the chromatic scale pitches normally within range of a BB-flat tuba, and in this case of a BB-flat Tu-Bone. These pitches cover the performance range needed for bass trombone playing in school jazz ensembles, which is from pedal F (technically FF) to the first F above the bass clef staff. Professional bass trombone soloists can play an octave higher than that, but it is simply not required for ensemble bass trombone playing in a school jazz band. With some effort, the first embodiment Tu-Bone performing range may be extended downward to CCC, and upward to the $2^{nd}$ B-flat above the bass clef staff (high B-flat), but this is not required for school ensemble playing, and most student players will settle for the range from FF (pedal F) to the first F above the bass clef staff which is easy to perform on the invention Tu-Bone, since this is the limit of what is written in the vast majority of student level jazz ensemble music. A detailed survey of all music in the bass trombone folder of the jazz band at Millard South High School in Omaha, Nebr., USA revealed no notes written for bass trombone outside of this range (FF to the $1^{st}$ F above the bass clef staff.)

In the first embodiment, air may proceed sequentially through valves V1–V4 (46–49), beginning with V1 (46) as in "early placement" configurations of FIGS. 15–17, or it may alternatively proceed in reverse sequence from V4 (49) to V1 (46), prior to exiting to the bell section as in the "late placement" of valves illustrated by FIG. 18. Directionality and placement of the valve section within the cylindrical section of the invention Tu-Bone is not critical and any directionality or placement may be within the scope of the invention. Early placement is however one distinguishing option with the first embodiment invention Tu-Bone since it allows use of smaller, lighter, lower friction, lower spring tension valves for nimbler musical performance. Tubing routing is otherwise not important and any tubing routing that meets the progressive mid-section bore criteria and BB-flat main path key of the first embodiment requirements is within the scope of the invention.

The first embodiment invention Tu-bone is distinguished from prior art BB-flat contrabass valve trombone and prior art BB-flat cimbassos in that the invention Tu-Bone employs amplifying progressive cylindrical mid-section bores or amplifying gradual conical mid-section bore expansion, or a combination of the two which makes the invention Tu-Bone significantly more responsive and easier to play throughout the performance range of notes and volumes. The invention progressive mid-section bores also provide further distinction in that they allow "early" valve section placement which facilitates use of smaller, lighter, lower friction, shorter throw, lower spring tension valves which enable "nimbler" musical performance. Prior art BB-flat contrabass trombones and BB-flat cimbassos all have a constant large cylindrical mid-section bore with "late" placement of the valve section, which requires a larger bore valve with greater mass, greater internal friction, longer throw, and stiffer spring tension, all of which make the prior art BB-flat instruments more difficult to blow, less responsive, more "lethargic" in their response, and less nimble in their overall musical performance.

The first embodiment BB-flat Tu-Bone is distinguished from prior art F and E-flat cimbassos in that only three or four valves are needed in the first embodiment invention musical key of BB-flat and the BB-flat valve fingering patterns to produce the entire chromatic scale of musical tones are already known and familiar to student tuba players, whereas prior art F and E-flat cimbasso valve fingerings are generally not known and not familiar to the vast majority of student tuba players, and are significantly more difficult from the trombone pedal B-flat to pedal G-flat.

The invention BB-flat Tu-Bone is distinguished from prior art BB-flat tubas in that a majority of the invention main path tubing length exhibits bore expansions limited to a maximum of 0.850 inch bore within the first 65% of the approximate 216 inch main BB-flat path, and the invention uses a trombone shaped bell. These two distinctions cause the invention to maintain a bass trombone tone quality, whereas the BB-flat prior art tubas have a majority of tubing length exhibiting a rapid conically expanding bore and they have a much larger bell throat. The combination of more aggressive conical bore expansion over the first 65% of tubing length and larger throat bell give the BB-flat tuba a significantly more "tubby" tone quality which does not blend acceptably with jazz trombone sections.

A second preferred embodiment is similar to the first preferred embodiment in all respects and distinguished from prior art in all the same respects, except overall length of main path tubing, which may be approximately 192 inches in the second preferred embodiment, yielding an preferred embodiment. All examples in FIGS. 15–18 may also apply to a second embodiment Tu-Bone with shortening of the main path tubing in each figure to approximately 192 inches instead of 216 inches, and a corresponding shortening of all valve tubing loops. This may be simply accomplished by shortening tubing sections 6, 10 and 12 in all FIGS. 15A–H without affecting overall mouthpiece height above the player's lap or bell height above the player's shoulder, and by correspondingly shortening each of the valve tubing loops by about 12%. An example of a shorter (approximately 192 inch main path) second embodiment CC Tu-Bone with progressive bores and early rotary valve placement is given in FIG. 19, with the valve tubing, rotary keypad actuators, and rotary valve linkages removed for simplified inspection of the main CC path, in which it may be seen that tubing sections 6, 10 and 12 have been shortened in the 192 inch invention CC Tu-Bone of FIG. 19, relative to the 216 inch BB-flat invention Tu-Bone of FIGS. 15A–H. FIG. 19 illustrates a four rotary valve embodiment, but by now the reader may easily envision three valve and or piston valve embodiments of a CC Tu-Bone and early or late placement of three valves, piston valves, or rotary valves without need of additional illustrative figures, and all of these are within the scope of the invention. The invention Tu-Bones FIGS. 16A–C may be converted from BB-flat to CC by shortening tubing sections 8, 10, 12, and 14 but leaving cane 71 at the same length, thereby maintaining the same mouthpiece (1)

height above floor, and the same bell (24) height above floor, so the player need not adjust position to play the CC Tu-Bone, and by a corresponding approximate 12% shortening of the valve tubing loops.

FIG. 17 C, D BB-flat Tu-Bones may be converted to CC by eliminating the bell section loop 130–133 in favor of a straight pipe (18) as in FIG. 17B, with a total overall main path length of approximately 192 inches instead of 216 inches, and a corresponding approximate 12% shortening of all four valve tubing loops.

The second embodiment CC Tu-Bone is distinguished from prior art CC-cimbassos in the use of invention amplifying progressive cylindrical mid-section bores or gradual conical mid-section bore expansions, or a combination of the two not to exceed 0.85 inch bore within the first 65% of the approximate 192 inch CC main path tubing length, yielding more performance responsivity and easier blowing, and also in an invention option for "early" placement of a smaller bore, more compact, lighter weight valve section with reduced internal valve friction, shorter valve throw, lighter spring tension, and more nimble musical performance as described in the aforementioned first embodiment summary. The second preferred embodiment Tu-Bone is further distinguished from prior art CC cimbassos in that an invention bell throat diameter measured 10 inches from the end of the bell flare may be less than 3 inches in diameter and preferably less than 2.5 inches diameter as in FIG. 19, whereas prior art CC cimbassos have this particular bell throat diameter larger than 3 inches, and typically 3.75 inches in diameter, such that the invention CC Tu-Bone sounds like a powerful bass slide trombone and blends well with jazz or operatic trombone sections, and prior art CC cimbassos sound like a bad baritone, a poor euphonium, or a small cheap tuba and do not blend well tonally with jazz or operatic trombone sections.

A third preferred embodiment is similar to the first preferred embodiment in all respects and distinguished from prior art in all respects, except overall length of main path tubing, which may be approximately 144 inches, yielding an invention Tu-Bone pitched in the musical key of F in a nonlimiting third preferred embodiment. A nonlimiting late placement 5 rotary valve invention F Tu-Bone is shown in the nonlimiting example of FIG. 20. An early placement piston valve embodiment may also be envisioned for V1–V4, but V5 would ideally remain as a rotary valve in this case since it is typically thumb operated.

The third embodiment is distinguished from prior art F-cimbassos in the use of invention amplifying progressive cylindrical mid-section bores or gradual conically expanding mid-section bores, or a combination of the two, yielding more performance responsivity and easier blowing, and also in an invention option for early placement of a smaller bore, more compact, lighter weight valve section with reduced internal valve friction, shorter valve throw, lighter spring tension, and more nimble musical performance as described in the aforementioned first embodiment description. For a lap-held embodiment, FIGS. 15A–H may also be converted from BB-flat to F, simply by shortening tubing sections 6, and eliminating loop 10, 11, 12 and routing directly from tube 9 to tube 13 such that an overall main path of 144 inches is reached instead of 216 inches, and by making correspondingly approximately 33.3% shorter valve tubing loops. Similar main path tube shortenings may be achieved to convert the BB-flat Tu-Bones of FIGS. 16 and 17 to F, simply by eliminating one loop in the region 10, 11, 12, and 13, and connecting instead from segment 9 to segment 14 to form a single U-tube leading from 8 to 9 to 14, 15, 16 and on out to the bell (24) as in FIG. 20. Segments 8 and 14 of FIGS. 16 and 17 may also be shortened to bring the overall path down to 144 inches corresponding to the key of F instead of a 216 inch BB-flat path. Loop 130–133 in FIGS. 17C,D may also be eliminated to keep the total path at 144 inches. Finally, valve tubing must also be shortened correspondingly by about 33.3% in all these figures to properly tune the instrument for a fundamental key of F. A fifth valve and fifth valve tubing loop is also often desirable for the key of F, in order to play the range low B-flat–low G-flat in tune, and also the range low BB-flat to low GG-flat, and this too is within the scope of the third embodiment invention. A late placement 5 rotary valve third embodiment F Tu-Bone is shown in the nonlimiting example of FIG. 20. An early placement four piston valve (V1–V4) third embodiment F Tu-Bone may also be envisioned, but in that case V5 is still needed and should remain as a rotary valve since it is thumb operated.

A fourth preferred embodiment is similar to the first preferred embodiment in all respects and distinguished from prior art in all respects, except overall length of main path tubing, which may be approximately 162 inches, yielding an invention Tu-Bone pitched in the musical key of E-flat in a nonlimiting fourth preferred embodiment, as seen in FIG. 21. The fourth embodiment is distinguished from prior art E-flat cimbassos in the use of invention amplifying progressive cylindrical mid-section bores or gradual conically expanding mid-section bores, or a combination of the two, yielding more performance responsivity and easier blowing, and also in an invention option for early placement of a smaller bore, more compact, lighter weight valve section with reduced internal valve friction, shorter valve throw, lighter spring tension, and more nimble musical performance as described in the aforementioned first embodiment description. FIGS. 15A–H may be converted from BB-flat to E-flat, simply by shortening tubing sections 6, and eliminating loop 10, 11, 12 and routing directly from tube 9 to tube 13 such that an overall main path of 162 inches is reached instead of 216 inches, and by making correspondingly shorter valve tubing loops. Similar main path tube shortenings may be achieved to convert the BB-flat Tu-Bones of FIGS. 16 and 17 to E-flat, simply by eliminating one loop in the region 10, 11, 12, and 13, and connecting instead from segment 9 to segment 14 to form a single U-tube leading from 8 to 9 to 14, 15; 16 and on out to the bell (24), such that the total main path tubing length is 162 inches. Loop 130–133 in FIGS. 17C–D may also be eliminated to keep the total path at approximately 162 inches. Finally, valve tubing must also be shortened correspondingly by approximately 25% in all these Figures to properly tune the instrument for a fundamental key of E-flat. A fifth valve and fifth valve tubing loop is also often desirable for the key of E-flat, in order to play the range low A-flat–low F in tune, and also the range low AA-flat to low FF, and this too is within the scope of the third embodiment invention.

A fifth preferred embodiment is similar to the first preferred embodiment in all respects including the aforementioned use of amplifying progressive cylindrical mid-section bores or gradual conically expanding mid-section bores, or a combination of the two, to yield responsive playing, and including the aforementioned option for early placement of a smaller bore valve section with lower internal friction, shorter throw and lighter spring tension, except that the mid-section may commence immediately following the first approximately 10% of total main air path length, and at least four valves and four length extension tubing loops are employed in the fifth preferred embodiment Tu-Bone, and also except for overall length of main path fifth embodiment invention tubing, which may be approximately 108 inches, yielding an invention Tu-Bone pitched in the musical key of B-flat in a nonlimiting fifth preferred embodiment. The fifth preferred embodiment B-flat Tu-Bone is pitched exactly one musical octave higher than the first embodiment BB-flat Tu-Bone.

In the fifth embodiment, air may proceed sequentially through valves V1–V4 (46–49), beginning with V1 (46) in a nonlimiting example, and this is preferred for "early" placement of the valve section in a nonlimiting example as seen in FIG. 22A. Alternatively, air may proceed in reverse sequence from V4 (49) to V1 (46), prior to exiting to the bell section in a nonlimiting example, and this is preferred for "late" placement of the valve section in a nonlimiting example, as seen in FIG. 22B. Either of these placements and directionalities, and even their less preferred vice-versa combinations (V1–V4 progression in late placement and V4–V1 progression in early placement, neither of which are shown in figures) are all within the scope of the invention.

With no valves engaged, the fifth embodiment path length is 108 inches and the fundamental musical pitch (key) is B-flat. Referring to FIGS. 22A–B, engaging valve 2 (V2, 47) alone adds loop 34–36 to the path which lengthens the instrument by approximately 6.4 inches for a total of approximately 114.4 inches and a new fundamental pitch of A. Engaging V1 (46) alone adds loop 31–33 which is approximately 13.2 inches long, lengthening the instrument path to approximately 121.2 inches and corresponding to a new fundamental pitch of A-flat. Engaging V3 (48) alone adds loop 37–40 which is approximately 20.4 inches long, lengthening the instrument to approximately 128.4 inches and corresponding to a new fundamental pitch of G. Engaging V2 and V3 simultaneously adds both loops 34–36 and 37–40 in series to the main path, lengthening the instrument to about 135 inches and corresponding to a new fundamental pitch of G-flat. Engaging V4 alone adds loop 41–45 which is approximately 36 inches long, lengthening the instrument to approximately 144 inches and corresponding to a new fundamental pitch of F. Using combinations of these four valves and also the possibility of not engaging any valve, together with variations in performer lip vibrational frequency input, a full range of chromatic scale pitches may be produced ranging from approximately CC to the $2^{nd}$ F above the bass clef staff, or even as high as double high B-flat ($3^{rd}$ B-flat above the bass clef staff) by a gifted performer. Most student performers will however achieve a range of FF to high B-flat (the $2^{nd}$ B-flat above the bass clef staff), and this is more than sufficient for bass trombone playing in school jazz bands.

Fifth embodiment pitches will be excessively "sharp" from low E-flat to low C, but these may be corrected with alternate valve fingerings which are applied one half step lower than written in the music for this range. The fifth embodiment will not readily yield a low B-natural, but this note is rarely performed in school jazz ensemble trombone section playing. On the very rare occasions that a low B-natural is required, it may simply be "ghosted" (not played), or played an octave higher than written, or the student may ask the band director to suggest another note that will still "fit" within the chord being performed by the ensemble, for a fifth embodiment sectional performance. It must be remembered that, "in jazz there are no 'wrong notes'; only poor choices", so it is not considered a significant disadvantage to substitute another well-chosen note from the chord, or even to "ghost" the note or to play it an octave higher, especially considering how very rarely the low B is performed in ensemble jazz works. Any of these alternatives will sound "just fine" for a student jazz performance using a fifth embodiment invention B-flat Tu-Bone.

Fifth embodiment valves may be rotary valves of any design, as shown in FIGS. 20A–B, or they may be piston valves of any type (not shown in the figures). The fifth embodiment B-flat Tu-Bone bell may be any bell with a throat smaller than 3 inches diameter, measured 10 inches from the end of the bell flare, and may include any bell flare diameter, but a preferred fifth embodiment Tu-Bone bell would have a bell throat approximately 1.75 inch in diameter measured 10 inches from the end of the bell flare in a nonlimiting example as shown in FIGS. 20A–B, and a preferred fifth embodiment would also have a bell flare between 9.3 inch and 11 inch diameter with an especially preferred fifth embodiment bell being approximately 10 inch to 10.5 inch in diameter, in nonlimiting examples, as shown in FIGS. 22A–B.

As in the first embodiment, the fifth embodiment B-flat Tu-Bone may optionally have an amplifying progressive cylindrical mid-section bore not to exceed 0.85 inch within the first 65% of the approximate 108 inch B-flat main path, in a nonlimiting example. In an optional additional fifth embodiment feature which goes beyond the scope of the first embodiment claims, the fifth embodiment B-flat Tu-Bone may alternatively have a constant single valued cylindrical bore over the mid-section so long as it does not exceed 0.85 inch within the first 65% of the approximate 108 inch B-flat main path, in another nonlimiting example. Finally, as in the first embodiment, the fifth embodiment B-flat Tu-Bone may alternatively have any gradually expanding conical mid-section bore so long as it doesn't exceed 0.85 inch within the first 65% of the approximate 108 inch B-flat main path, in a third nonlimiting example. In all four nonlimiting bore options, the progressive cylindrical mid-section bore, the constant cylindrical mid-section bore, the gradual conical mid-section bore expansion, or a combination, the fifth embodiment tubing expansion rate is significantly less than that of baritones, euphoniums, and tubas, and is such that a bore of 0.850 inch is not exceeded within the first 65% of the 108 inch main B-flat tubing path length. It should be noted that any combination of conical and cylindrical mid-section bores may be employed within the limit of 0.850 inch bore not being exceeded within the first 65% of total path length, and still be within the scope of the fifth embodiment invention.

The fifth embodiment B-flat Tu-Bone is distinguished from all prior art B-flat trombones in that it is a valved bass trombone or cimbasso pitched in the musical key of 108 inch B-flat. No prior art valved instrument exists or has been described which is of cylindrical mid-section bore, gradual conical mid-section bore expansion, or a combination of the two not exceeding 0.850 inch bore within the first 65% of total main path length, sounding like a bass trombone and covering the bass trombone range of performance notes, and also being pitched in the musical key of 108 inch B-flat. The fifth embodiment B-flat Tu-Bone is further distinguished from all prior art B-flat bass trombones in that the invention has at least four valves and has no telescoping hand slide.

The fifth embodiment B-flat Tu-bone is distinguished from all prior art cimbassos and contrabass valve trombones in that the fifth embodiment invention Tu-Bone musical key is B-flat, whereas prior art cimbassos and contrabass valve trombones have only been produced and described in the musical keys of F, E-flat, CC, and BB-flat.

The fifth embodiment B-flat Tu-Bone is distinguished from prior art B-flat baritones and euphoniums in that the invention main path tubing exhibits a cylindrical mid-section bore or cylindrical mid-section bore progression or only a gradual conical mid-section bore expansion, or a combination of cylindrical and gradually expanding conical mid-section bores, such that a bore of 0.850 inch is not exceeded within the first 65% of tubing length, and in that the invention bell throat diameters are preferably significantly smaller than those of euphoniums and baritones, in a nonlimiting example, in that baritones and euphoniums have more rapidly expanding conical bores and larger bell throats leading to "tubbier" tone qualities which are undesirable in applications where the Tu-Bone must exhibit tone qualities that blend appropriately with jazz or operatic trombone sections. The fifth embodiment Tu-Bone is further distinguished from prior art baritones in that at least four valves are employed by the fifth embodiment Tu-Bone in order to access the musical range from low E-flat to low B, whereas baritones have only three valves and cannot access the important bass trombone range from low E-flat to low B.

A sixth preferred embodiment is identical to the fifth embodiment except that the at least four valves are more complex valves in the sixth embodiment and the at least four valves are designed to accommodate an "inverted full double Tu-Bone" sixth embodiment approach to eliminate tuning errors and eliminate the need for alternative valve fingerings in the range low E-flat to low B-natural, and to provide a well tuned low B-natural available for performance at any time by engaging all four valves simultaneously.

In the sixth preferred embodiment Tu-Bone, which is partially illustrated in the nonlimiting example of a valve section and first approximately 65% of a 108 inch main path section in FIG. 23A, valves V1–V3 (46–48) are actually each double valves, or "two story" valves as shown in the nonlimiting example of FIG. 23B, each valve having an upper "story" (348, 349) which may divert air from the main path to an upper length extension tubing loop associated with a main B-flat air path and altering pitch chromatically from the main B-flat Tu-Bone key, and each of valves V1–V3 also having a lower "story" (148, 149) which may divert air from the main path to a lower length extension tubing loop associated with a main F air path and altering pitch chromatically from the main F Tu-Bone key. V4 (49, in FIG. 23A, and further illustrated as an exploded view in FIG. 23C) simply selects whether the main B-flat air path (7, 50, 52) is active in Figure whether the main F air path (54–57) is active with the valve V4 (49) engaged in a second of two operating positions. With V4 (49) disengaged, the main B-flat path (7, 50–52) is active and in this case engaging V1–V3 (46–48) activates only the "upper story" V1–V3 length extension tubing loops (32, 35, 37, one loop associated with the upper story of each of three valves V1–V3 (46–48)), either singly or in combination to produce chromatic pitch alterations to the main B-flat key. With V4 (49) engaged, the main F path (54–57) is active, and in this case simultaneously engaging V1–V3 (46–48) causes only the "lower story" V1–V3 length extension tubing loops (32, 35, 37, one loop associated with the lower story of each of three valves V1–V3 (46–48)) to be selected or bypassed by V1–V3 (46–48), either singly or in combination to produce chromatic pitch alterations to the main F key. The sixth embodiment is called a "full double" Tu-Bone because each of the two paths (B-flat and F) comprises a complete Tu-bone. The sixth embodiment is further qualified to be called an "inverted" full double Tu-Bone, because the main path is B-flat, and V4 (49) engagement changes the fundamental pitch "downward" to F, instead of "upward". (In a normal "double" French Horn, which is the only prior art "full double" brass instrument, engaging V4 changes the pitch "upward" from a main path F key to an engaged V4 B-flat key.)

In the sixth embodiment, the B-flat inverted double Tu-Bone may have the change of "story" occurring via tubing routing external to the valves as in FIG. 23A with V4 (49) designed as in FIG. 23B, such that external B-flat tubing (7, 50–52), which is active without V4 (49) being engaged, directs air from a lower level V4 (49) valve exit port (7A) to an upper level entry port of another valve V1 (7B) and ultimately from an upper level V3 exit port (52) returning to an upper level V4 entry port (52) prior to upper level V4 exit (53) in the B-flat disengaged first of two V4 (49) operating positions, and such that the external F tubing (54–57), which is active whenever V4 (49) is engaged, moves diverts air from a second lower level V4 valve port (54A) to a lower port of V1 (54B) and ultimately from a lower level V3 exit port (57A) returning to a second upper level V4 entry port (57B) in the F engaged first of two V4 (49) operating positions.

Alternatively, V4 may have an air passage internal to the valve which changes between lower and upper levels, and still be within the scope of the invention. Essentially any valve design and any tubing routing which achieves the "inverted full double" Tu-Bone implementation is claimed, such that either the B-flat V1–V3 tubing loops (32, 35, 37) are accessed by engaging valves V1–V3 without V4, or the F V1–V3 tubing loops (32F, 35F, 37F) are accessed by engaging valves V1–V3 simultaneously with V4, but no B-flat V1–V3 loops (32, 35, 37) are ever used simultaneously with any F V1–V3 tubing loops (32F, 35F, 37F). So the horn is either a "pure" B-flat Tu-Bone or a "pure" F Tu-Bone, depending on whether V4 (49) is in a disengaged first or an engaged second of two operating positions, respectively.

In a first nonlimiting example of a sixth preferred embodiment B-flat inverted double Tu-Bone, the at least four valves may be two-story rotary valves with each story having rotor passages of conventional rotary valve design as in FIG. 23B, or each story may alternatively have a rotor segment according to the designs of Greenhoe, Shires, Hagmann, Lindbergh, Willson Rotax, or any other rotary valve design. In a second nonlimiting example of a sixth preferred embodiment B-flat double Tu-Bone, the at least four valves may be piston valves facilitating selection of either upper story (B-flat path) or lower story (F path) length extension tubing loops for valves V1–V3, with upper story B-flat path length extension tubing loops being selected or bypassed by V1–V3 whenever V4 is disengaged, and with lower story F path length extension tubing loops being selected or bypassed by valves V1–V3 whenever V4 is simultaneously engaged.

The sequence of valves which is encountered by vibrating air in one nonlimiting example of a sixth preferred embodiment begins with the bottom story (6, 6A) of V4 (49) illustrated in FIGS. 23A, 23D, and 23E where air enters from the mouthpiece (1), lead pipe (5) and initial section (6) of Tu-Bone tubing. Air exiting the bottom story (7A) of V4, when V4 is in the disengaged first of two operating positions, is then routed by external tubing (7) to the top of V1 (7B), and from there to the top of V2 (50), the top of V3 (51), and finally to top story of V4 (52) prior to exiting (53, 17) to the bell section (18, 20, 21, 23, 24) with the Tu-Bone in the fundamental B-flat musical key. In this case, engaging V1–V3 (46–48) in various combinations without engaging V4 (49), simply adds corresponding combinations of loops (32, 35, and 37) to the main B-flat path creating a variety of chromatic pitch alterations to the fundamental B-flat key.

Air exiting the bottom story of V4 (54A), when V4 (49) is in the engaged second of two operating positions, is routed by external tubing (54) to the bottom of V1 (54B), and from there to the bottom of V2 (55), the bottom of V3 (56), and finally by external tubing (57A, 57) to the top of V4 (57B) prior to exiting (53, 17) to the bell section (18, 20, 21, 23, 24) in the fundamental F musical key. In this case, engaging V1–V3 (46–48) in various combinations while simultaneously engaging V4 (49), simply adds corresponding combinations of loops (32F, 35F, and 37F) to the main F path creating a variety of chromatic pitch alterations to the fundamental F key.

To facilitate familiarity of fingerings for tuba players V4 (49) may be located below V1, V2, and V3 (46–48) as shown in the nonlimiting example sixth embodiment of the invention of FIG. 23A, D, E and may be engaged with the little finger of the right hand, in a nonlimiting example, rather than being located as a left-handed "sidewinder" euphonium valve, or a French Horn "thumb" valve, neither of which are familiar to tuba players. Alternatively or optionally, a second rotary linkage attachment may be added to V4, such that the first rotary linkage is half-nested within the second linkage, and such that either the first linkage alone may operate V4, and in doing so the first linkage operates independently (and disengaged from) of the second linkage, by the first linkage simply moving out away from it's half-nested location proximal to the second linkage whenever a right handed little finger keypad is depressed. In this example, the second linkage only operates when a second left handed keypad is depressed, and in this case the second linkage engages the nested first linkage, which is the linkage actually connected to and operates the valve V4. Thus, V4 may be engaged either by the right hand, using only the first linkage, or it may be operated by the left hand which uses both the second linkage and the nested first linkage to operate the valve. Right handed operation will be the norm for tuba players playing the sixth embodiment B-flat Tu-Bone. Left handed operation will be preferred by euphonium players playing the sixth embodiment B-flat Tu-Bone. The valve V4 may be operated with either the right hand or the left, depending on personal preference. Right handed operation in this case will be with lighter spring tension and somewhat smoother, since only the first linkage is active. Left handed operation will be some what "stiffer", since two linkages with two return springs are involved, but with left handed operation, stronger fingers such as the middle left or ever two left fingers together may be used to engage V4 if a large enough keypad or bar is provided to simultaneously engage both the second and the nested first of two V4 linkages. It should be noted that to facilitate drawing simplicity and clarity of viewing of tubing paths, no linkages or actuators have been illustrated in sixth embodiment drawings. They are however within the scope of the invention sixth embodiment.

The foregoing discussion is for a four rotary valved sixth embodiment B-flat Tu-Bone. A four piston valved sixth embodiment may also be envisioned, with either right or left handed V4 operation, but is not detailed in any drawing, and yet either of these options are within the scope of the sixth embodiment inverted double Tu-Bone in the key of 108 inch B-flat.

In yet another example of a sixth preferred embodiment, V4 may be designed to change the level of air between two of the stories internally with a vertically diagonal air passage within the valve rotor or piston, rather than by external tubing routing.

The sixth preferred embodiment B-flat inverted full double Tu-Bone is distinguished from all prior art in that it is the only 108 inch B-flat bass brass instrument in existence or in history which is accurately tuned from low E-flat to low B-natural without incurring "stuffiness" in blowing within that range and while offering a well tuned low B-natural. Prior art compensated B-flat euphoniums are well tuned in the range low E-flat to low B-natural, but they simultaneously activate both upper and lower story length extension tubing loops whenever V1–V3 are engaged simultaneously with V4. The prior art compensated euphonium thus uses every tubing loop of the instrument to perform a low B-natural with all four valves engaged. This means a great many tubing bends (loops), and a total of fourteen events occur where air must traverse through constricted or tortuous internal piston or rotary valve air passages for a prior art B-flat compensated euphonium. With 14 trips through a valve piston or rotor, back-pressure always builds and an unresponsive stuffy playing characteristic inevitably results from low E-flat to low B. The sixth embodiment B-flat inverted full double Tu-Bone is distinguished in that only one (upper story or lower story, but never both at the same time) of the valve "stories" is activated for V1–V3 at a time, regardless of whether V4 is engaged or disengaged. For a low B, all four valves are engaged, but the sixth embodiment B-flat inverted full double Tu-Bone will then have only 8 trips through a valve piston or rotor for this low B, and back-pressure will not be nearly as severe, leaving the sixth embodiment Tu-Bone playing responsively and without stuffiness and also playing accurately in tune throughout its range.

The important distinguishing feature of the sixth embodiment Tu-Bone is use of the "inverted full double horn" approach, which has never before been implemented or described in any prior art B-flat bass brass instrument, and certainly not for any prior art valve trombone, valve bass trombone, valve contrabass trombone, cimbasso, or in any instrument that sounds even remotely like a trombone or bass trombone.

A seventh invention B-flat Tu-Bone embodiment illustrated in FIGS. 24A–C is identical to the sixth embodiment, except that a "compensated" Tu-Bone is envisioned in the key of 108 inch B-flat rather than an inverted full double Tu-Bone in B-flat. For a seventh embodiment compensated B-flat Tu-Bone, the same two story valve arrangement applies, except that in this case engaging V1 (46) simultaneously with V4 (49) activates a B-flat/F interconnect tube (60) which interconnects and essentially activates both the upper and the lower V1 (46) length extension tubing loops (32, 32F), placing them both in series with the main F path of the instrument which actually comprises the sum of the B-flat and F paths, and engaging V2 (47) simultaneously with V4 (49) activates both the upper and the lower V2 length extension tubing loops (35, 35F), placing them both in series with the main F path (and main B-flat path) of the instrument, and engaging V3 (48) simultaneously with V4 (49) activates both the upper and the lower V3 length extension tubing loops (37, 37F), placing them both in series with the main F path (and main B-flat path) of the instrument. A rotary valved seventh embodiment is illustrated in the nonlimiting examples of FIGS. 24A–B and a piston valve seventh embodiment is illustrated in the nonlimiting example of FIG. 24C. The seventh embodiment is not, in fact, preferred to the sixth embodiment, owing to seventh embodiment "stuffiness" issues in the range low E-flat to low B arising from the entire B-flat path and the entire F path being simultaneously activated and adding together in series with too many length extension loops and piston or rotor air passages being simultaneously activated in this range whenever V4 (49) is engaged, but the seventh embodiment is still within the scope of the invention B-flat Tu-Bone, and it may be improved by increasing the bores.

An eighth preferred embodiment involves the B-flat inverted full double Tu-Bone of the sixth embodiment and FIGS. 23A, D, and E in a nonlimiting example, in which mid-section cylindrical tubing bores are progressively increased in one or two steps but not to exceed 0.85 inch within the first 65% of total path length, in a nonlimiting example, or in which a gradual conical mid-section bore expansion is employed not to exceed 0.85 inch within the first 65% of total path length in a nonlimiting example, or in which a combination of the two is employed, rather than being a constant and single valued bore in the mid-section section, prior to the final radical conical expansion of the bell section. In a first nonlimiting example of an eighth embodiment B-flat inverted full double Tu-Bone, main B-flat path cylindrical tubing bores may be approximately 0.578 inch for the first approximately 20.5 inches, followed by an approximate 14.5 inch section at approximately 0.594 inch bore leading through the bottom of V4, followed by approximately 39 inches of cylindrical tubing at 0.625 inch bore prior to the final conical expansion in the bell section which includes the last 34 inches of the 108 inch B-flat total in a nonlimiting example. In this case, V4 (49 in FIG. 23A, and see also FIGS. 23C–E) is a hybrid bore two story rotary valve with the bottom story rotor passage (148, 303) bored at approximately 0.594 inch and the top story rotor passage (350) bored at approximately 0.625 inch in a nonlimiting example. V1–V3 (46–48) would all be bored at 0.625 inch for both stories (148, 149, 348, 349) in FIG. 23B in this nonlimiting example. Alternatively, the preferred B-flat stepped cylindrical bore progression of 0.578 inches, 0.594 inches, and 0.625 inches prior to the conically expanding bell section may proceed over lengths of approximately 20.5 inch, 22.5 inch, and 31 inches, respectively in a second nonlimiting example. In this case, all four valves would be hybrid valves with 0.594 inch rotor bores in the top (348, 349) of V1–V3 (46–48) and 0.625 inch rotor bores in the bottom (148, 149) of V1–V3 (46–48). V4 (49, and also FIG. 23C) would be inverted with 0.594 inch bore in its bottom half (148, 303) and 0.625 inch bore in its top half (350). Finally, the preferred B-flat stepped cylindrical bore progression of 0.578 inches, 0.594 inches, and 0.625 inches, may also proceed over lengths of approximately 11.5 inches, 11.5, inches, and 51 inches, respectively, in a third nonlimiting example. In this case, all valves would be bored at 0.625 inch bore, in both top and bottom halves (stories).

The eighth preferred Tu-Bone embodiment is distinguished in that it's progressive cylindrical mid-section bores or its gradually expanding conical mid-section bores, or combination of the two, are unusually large bore for a B-flat bass trombone, and they will be strongly amplifying due to the progressive mid-section bore effect, and will yield an unusually responsive and loud playing bass trombone, especially for a valve trombone.

An ninth invention embodiment illustrated in FIG. 25 is not a Tu-bone, but is a euphonium, much like prior art compensated euphoniums except that the prior art compensation is eliminated in favor of the inverted full double horn approach of the sixth embodiment Tu-Bone. In FIG. 25, the valve section plumbing and function is identical to the sixth embodiment Tu-Bone of FIGS. 23A–E. The entrance tubing (5, 6) is simply curved around the euphonium bell throat (23) in the ninth embodiment euphonium of FIG. 25. The only other difference is that exit tube (53) is coiled to meet bell throat (23) and the exit tube (53) begins radical conical expansion as soon as it leaves V4 (49) in the ninth embodiment euphonium of FIG. 25. Ninth embodiment bores will be rapidly conically expanding beginning right after the valve section, as seen in FIG. 25. The distinguishing feature of the ninth embodiment euphonium is that a "full double horn" approach to resolving tuning issues in the range low E-flat to low B is employed, and it will not be "stuffy" in this range like prior art compensated euphoniums. A piston valve model of ninth embodiment euphonium may also be envisioned and is within the scope of the invention, but not shown in a drawing.

Figure 1A:
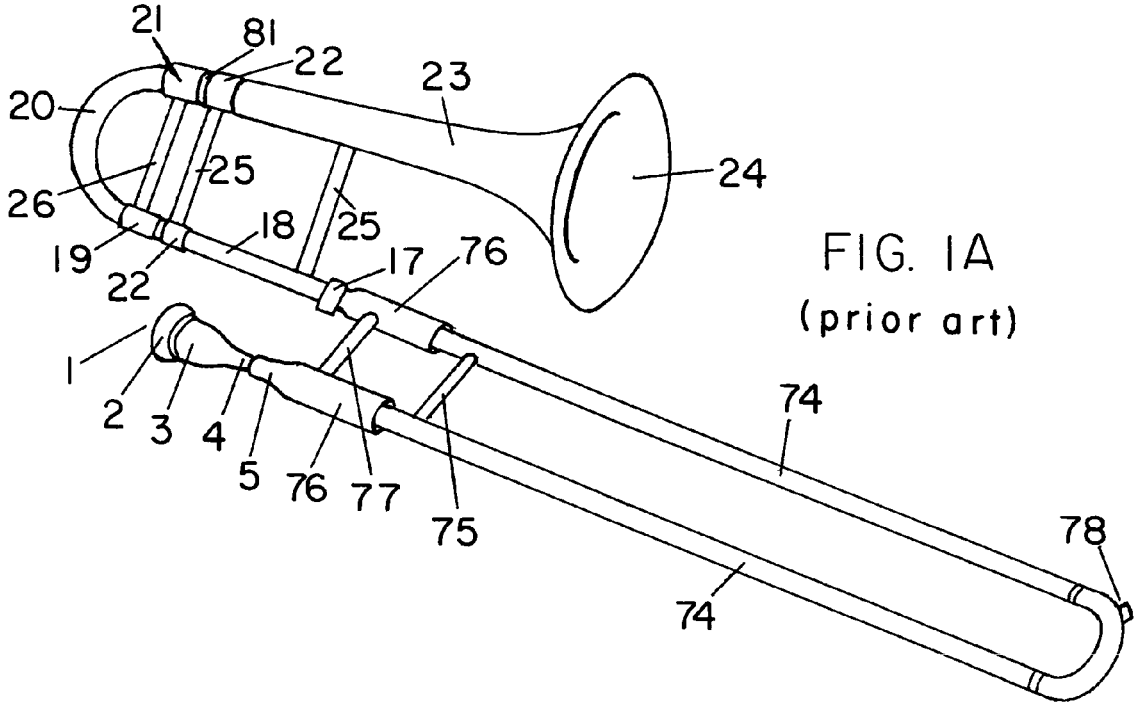
FIG. 1A (prior art)
FIG. 1A is an isometric perspective view at about 45 degrees above horizontal of a prior art B-flat tenor slide trombone.
Figure 1B:
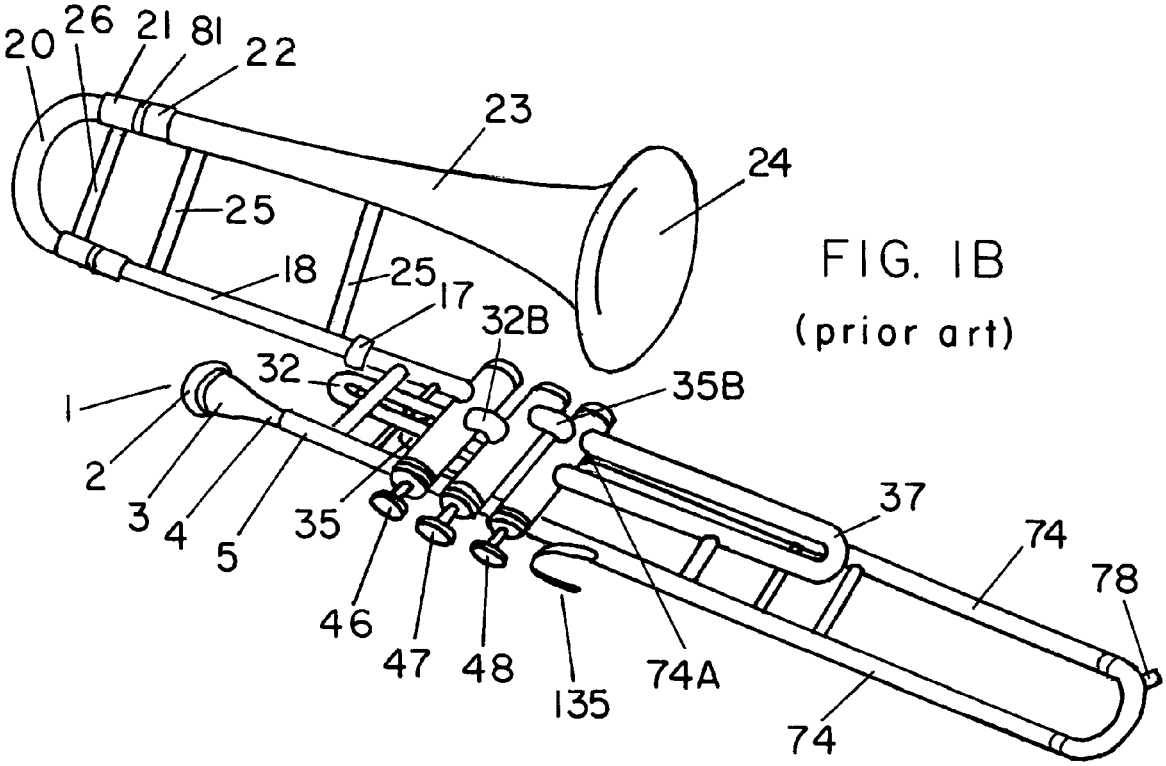
FIG. 1B (prior art)
FIG. 1B is an isometric perspective view at about 45 degrees above horizontal of a prior art B-flat tenor valve trombone.
Figure 1C:
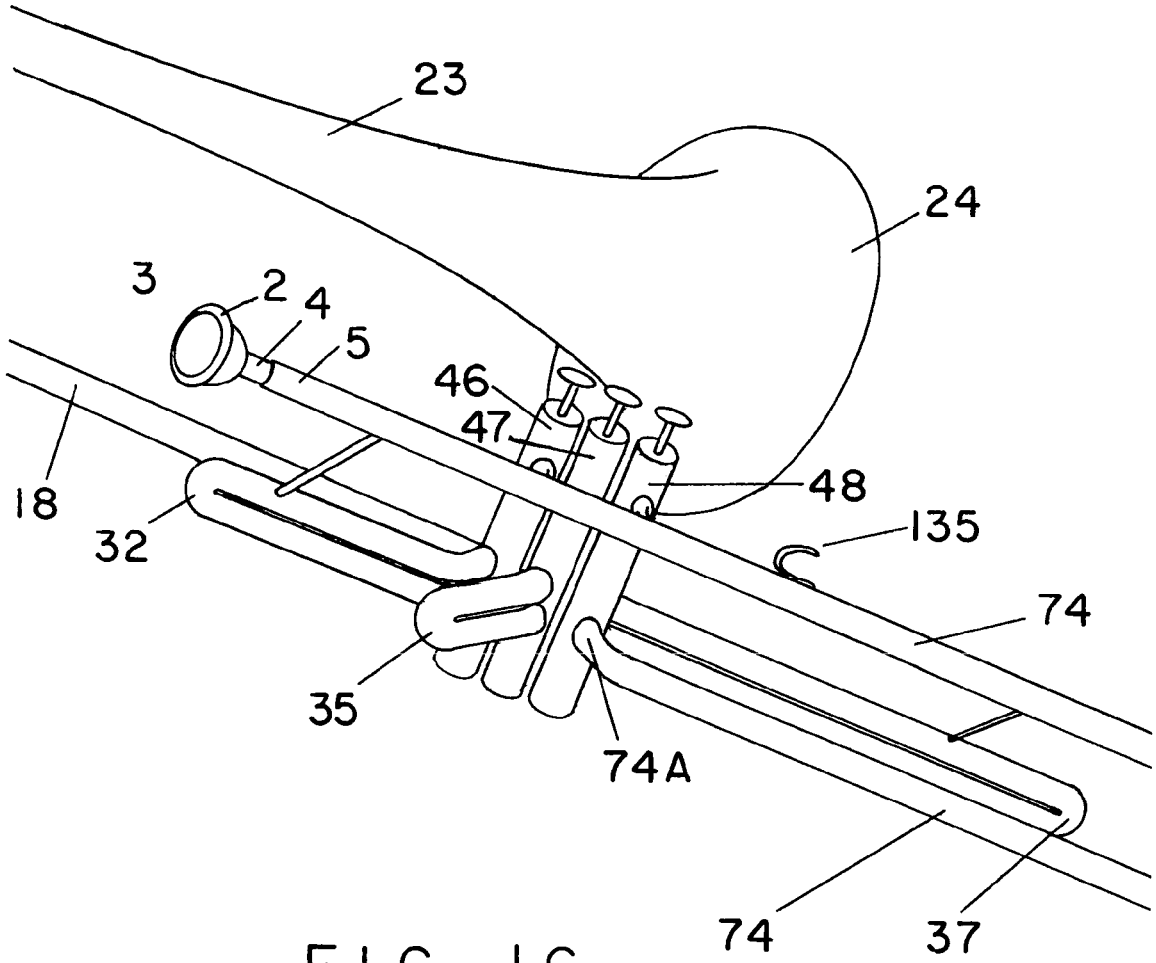
FIG. 1C (prior art)
FIG. 1C is an enlarged and partly truncated isometric perspective side view at about 15 degrees above horizontal, and slightly behind the mouthpiece, of the prior art B-flat tenor valve trombone of FIG. 1B with the valve section in normal playing position with the valve keys (46–48) angling about 45 degrees upward, facilitating a view of the front side of the valves and the first two valve tubing loops (32, 35).

A tenth invention embodiment is also not a Tu-Bone, but is a 3 valve B-flat tenor trombone such as in FIG. 1C with a valve bore of at least 0.500 inch. It may exhibit constant cylindrical midsection bore immediately following the first encountered 10% of instrument length, or it may have progressive mid-section bore as described earlier in the fifth embodiment section.

Figure 1D:
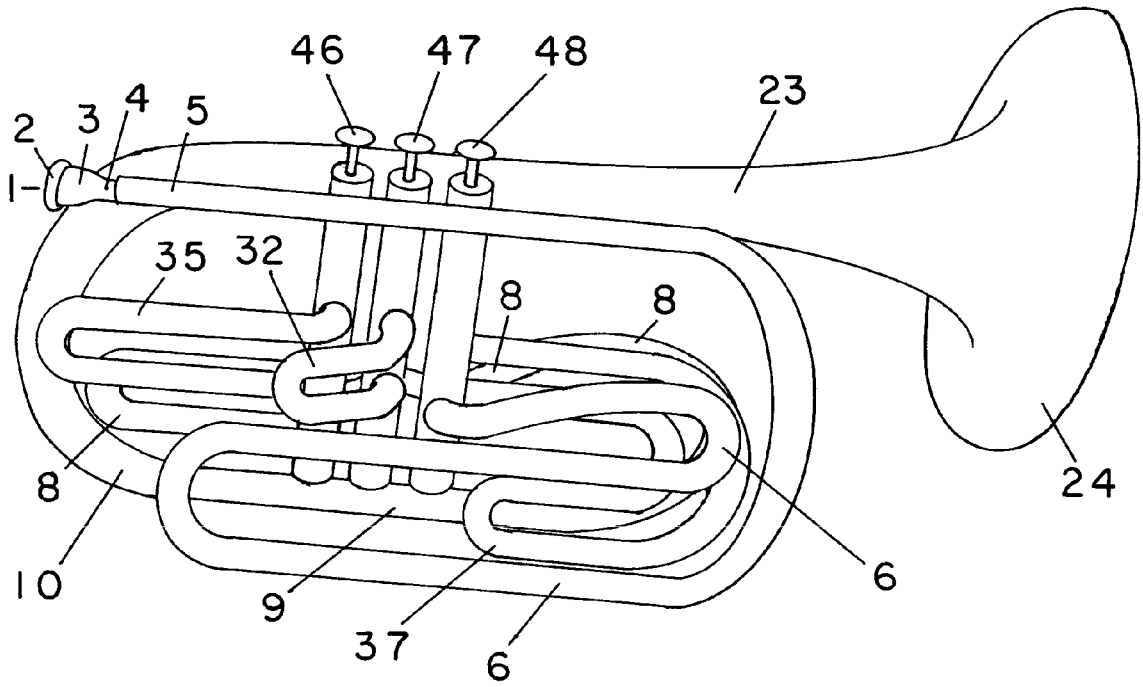
FIG. 1D (prior art)
FIG. 1D is an isometric perspective side view at about 20 degrees above horizontal of a prior art B-flat tenor marching (valve) trombone. Though it resembles a large trumpet or cornet, its 108 inch main path tubing length, 0.500 inch valve and tubing bore, mouthpiece dimensions, 2.3 inch diameter bell throat (measured 4 inches back from the bell), and 8.5 inch diameter bell collectively give it a trombone tone quality and distinguish it as a B-flat tenor valve trombone.
Figure 3C:
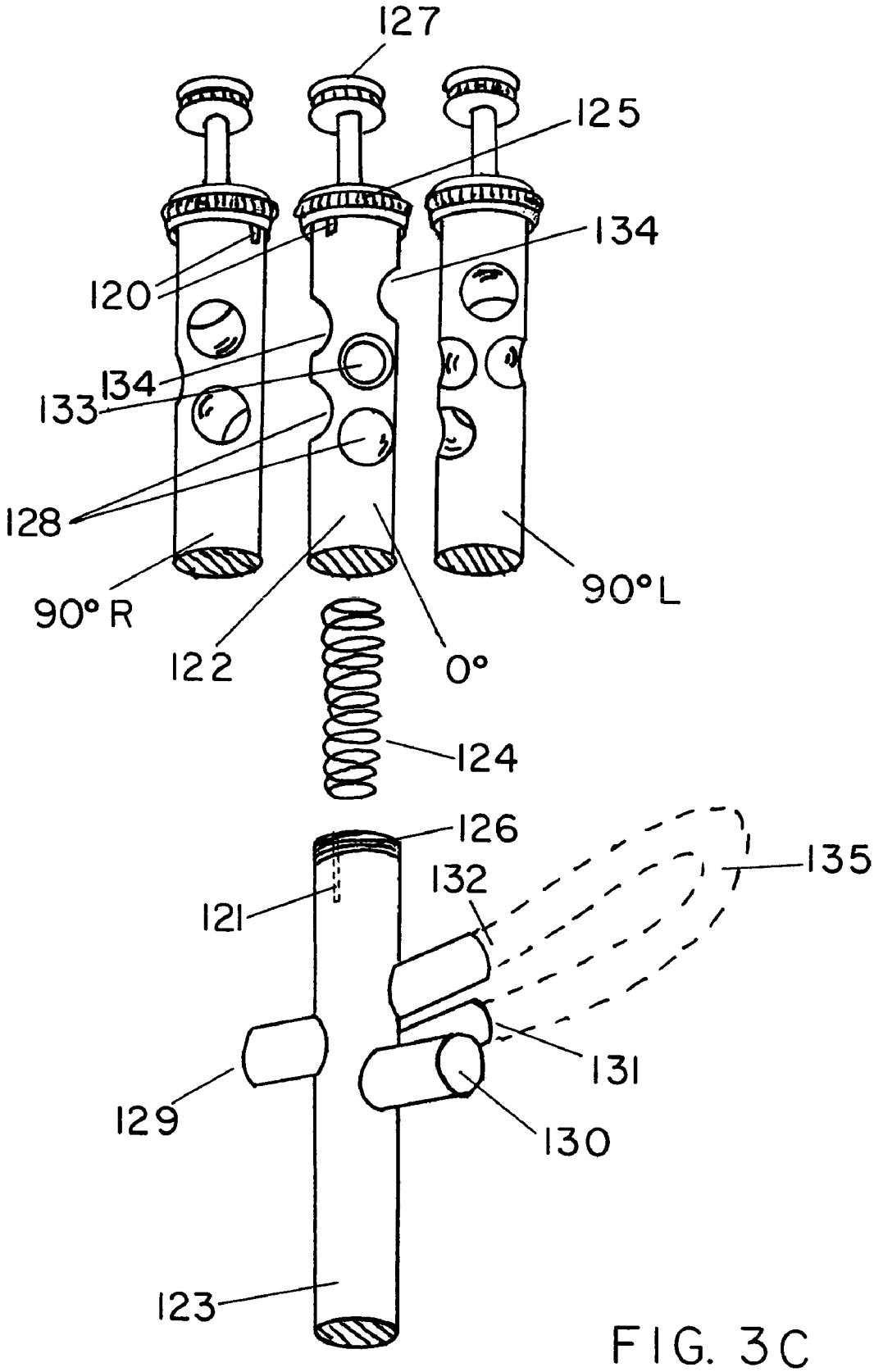
FIG. 3C (prior art)
FIG. 3C is an isometric side exploded view from slightly below horizontal of a piston valve. The piston shown directly above the valve spring 124 is at a zero degree rotational orientation in which alignment key 120 mates with slot 121, allowing piston 122 to be fully inserted into valve casing 123. Other non-operational views of the piston are shown on its left, in which the piston has been rotated 90 degrees rightward, and also on its right, in which the piston has been rotated 90 degrees leftward. In these three views, all sides, directions, and aspects of the piston internal air passages (128, 133, 134) may be seen.
Figure 4A:
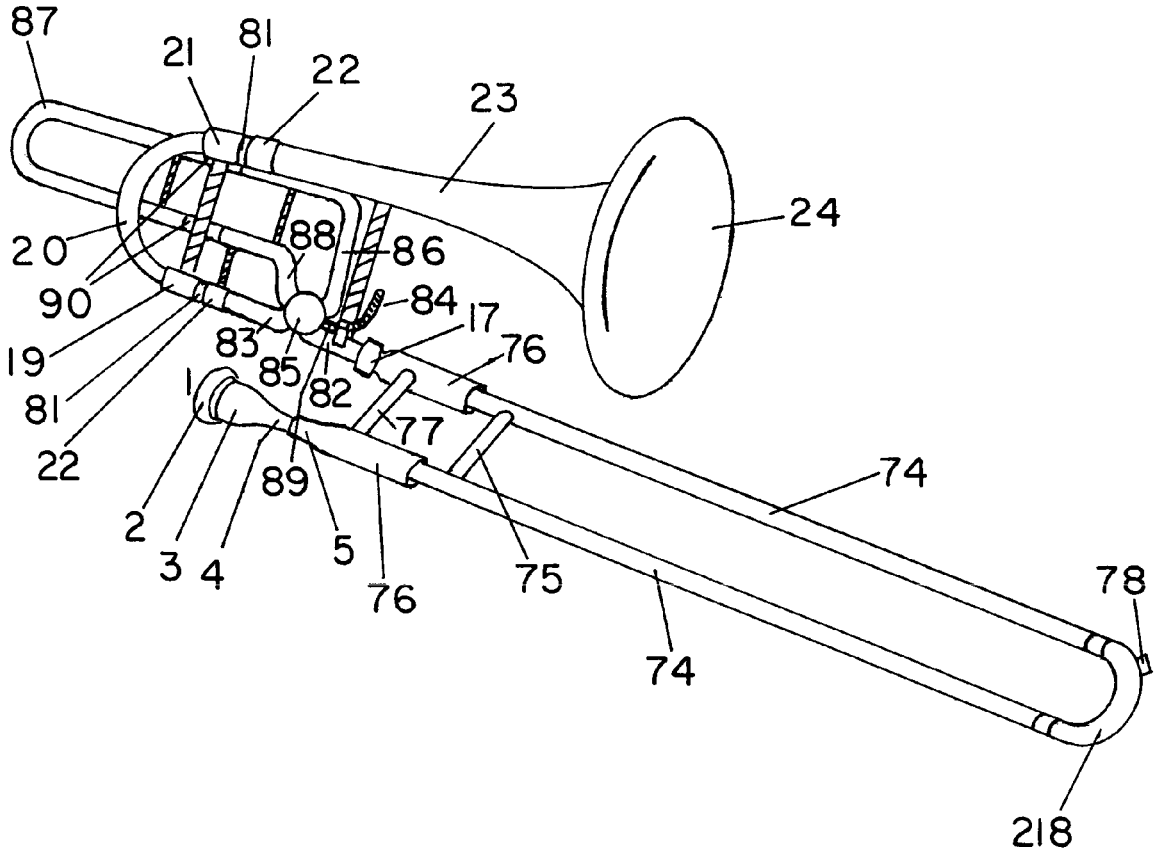
FIG. 4A (prior art)
FIG. 4A is an isometric perspective view at about 45 degrees above horizontal of a prior art single-valve B-flat/F bass slide trombone with an F-attachment secondary length extension tubing loop and a rotary valve, viewed from the same side the bell throat (23) as the player's head.
Figure 4B:
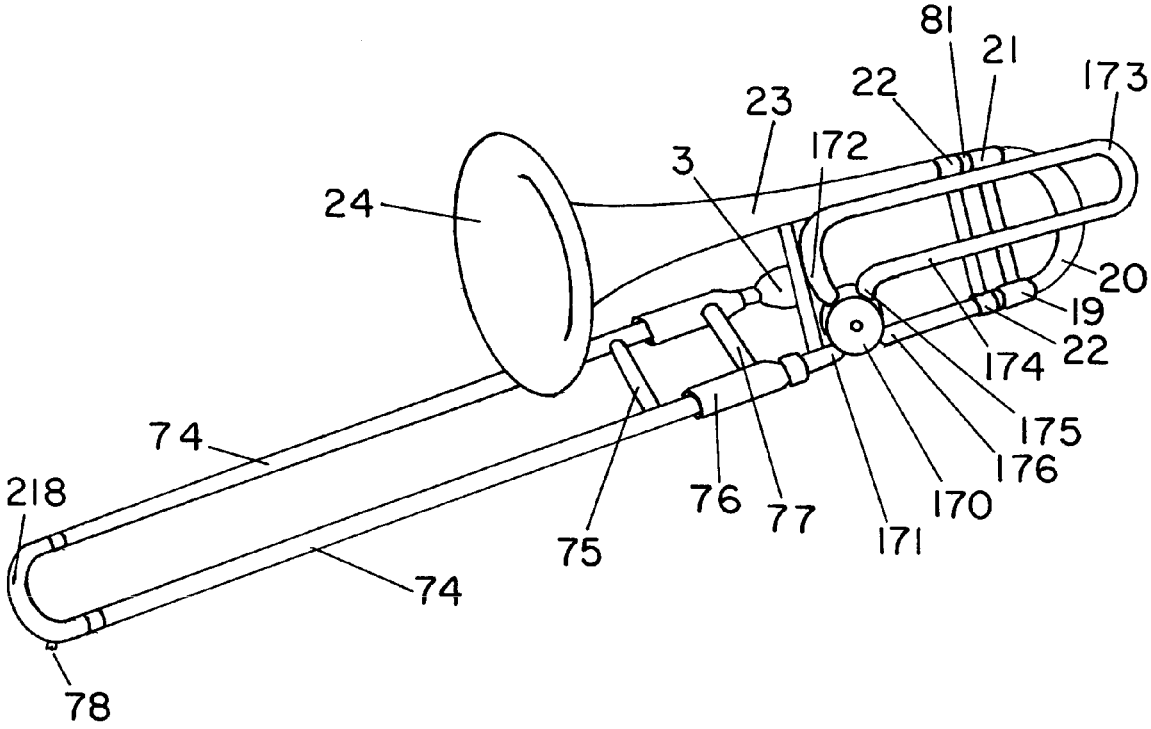
FIG. 4B (prior art)
FIG. 4B is an isometric perspective view from about 45 degrees above horizontal of an assembled prior art bass B-flat/F trombone from the other side of the bell throat (23), away from the player's head. The figure illustrates a mouthpiece (1–4), mouthpiece receiver (5), variable length telescoping hand slide (76, 75, 74, 78), a rotary valve (170) being any rotary valve or a valve of FIGS. 6A–C, with the rotary valve (170) turned sideways from its FIGS. 6A–C orientation, and further illustrating an approximately 36 inch secondary length extension musical key of F tubing loop (172–175) attached to the valve (170), tubular tuning slide bow (20), and flared tubular bell (23, 24). Rotary linkage and actuators have been omitted from the valve (170) of FIG. 4B. The perspective view is from the trombone side opposite the player's head and looking back from a viewing position somewhat forward of the left side of the player's head and somewhat above player's lips which are pressed against (1) mouthpiece rim (2).
Figure 4C:
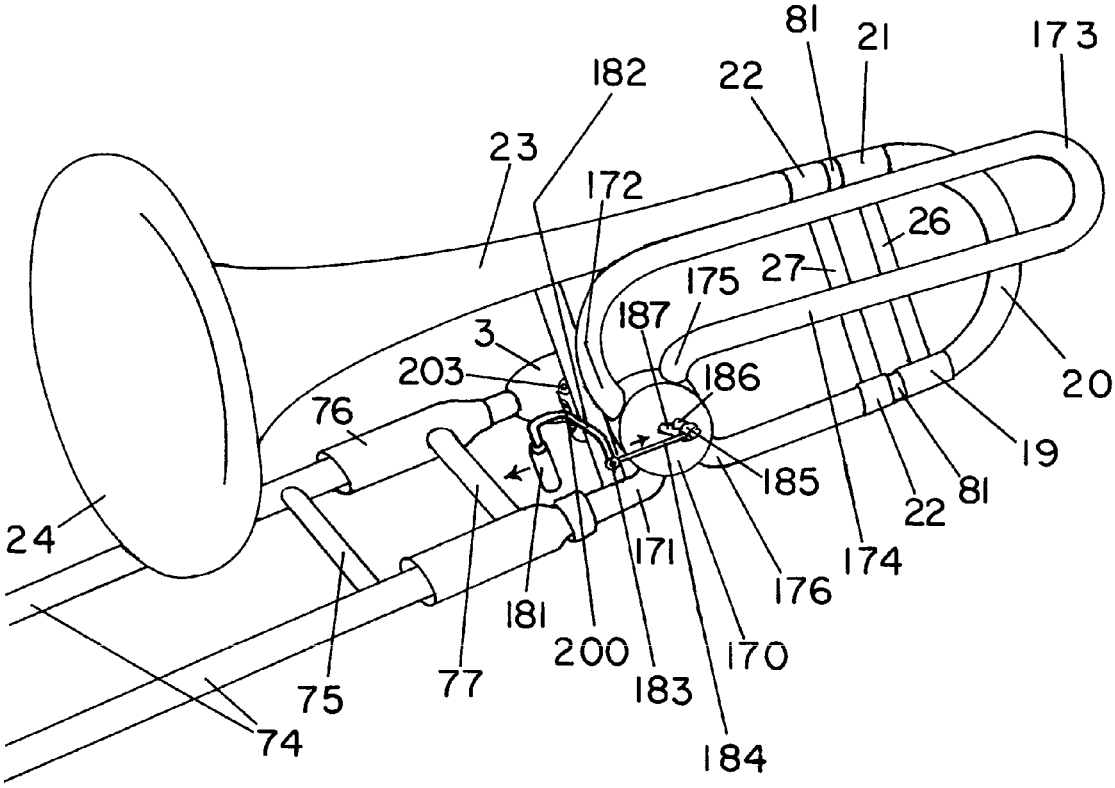
FIG. 4C (prior art)
FIG. 4C is an enlarged and partly truncated view of a portion of FIG. 4B, with FIG. 4C showing addition of an F-valve (170) spring loaded, levered left thumb actuator (181) and rotary linkage (182–187), linking the levered left thumb actuator (181) to the offset swivel spindle (186) which is connected to the rotor spindle (187).
Figure 4D:
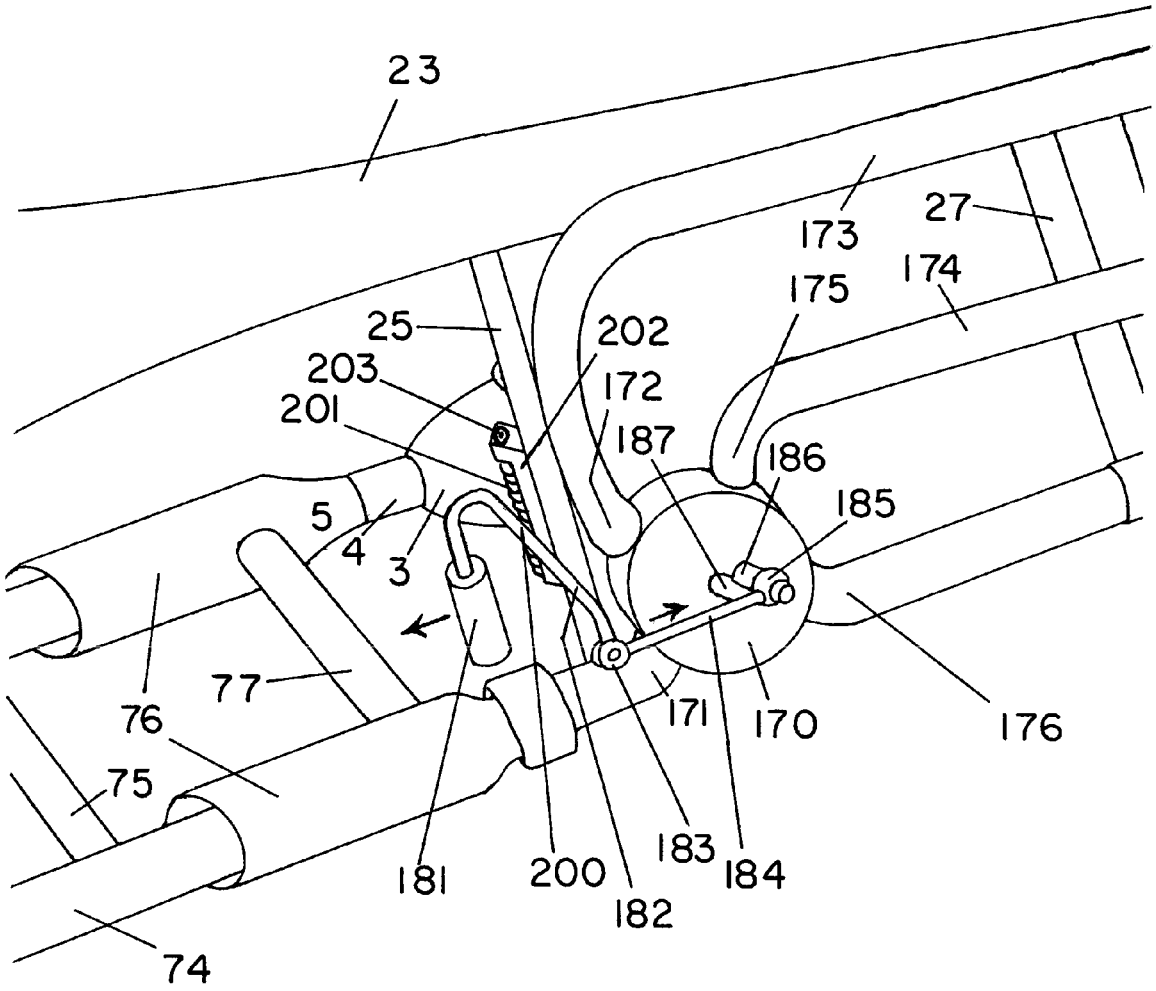
FIG. 4D (prior art)
FIG. 4D is a further enlarged and further truncated view of a part of FIG. 4C showing greater detail of F-valve (170) spring loaded, levered left thumb actuator (181), lever fulcrum (200), spring (201), fulcrum axle (203), axle mount (202), and rotary linkage (182–187), linking the levered left thumb actuator (181) to the offset swivel spindle (186, 300) which is connected as in FIGS. 6A–C to the rotor spindle (187, 227).
Figure 5A:
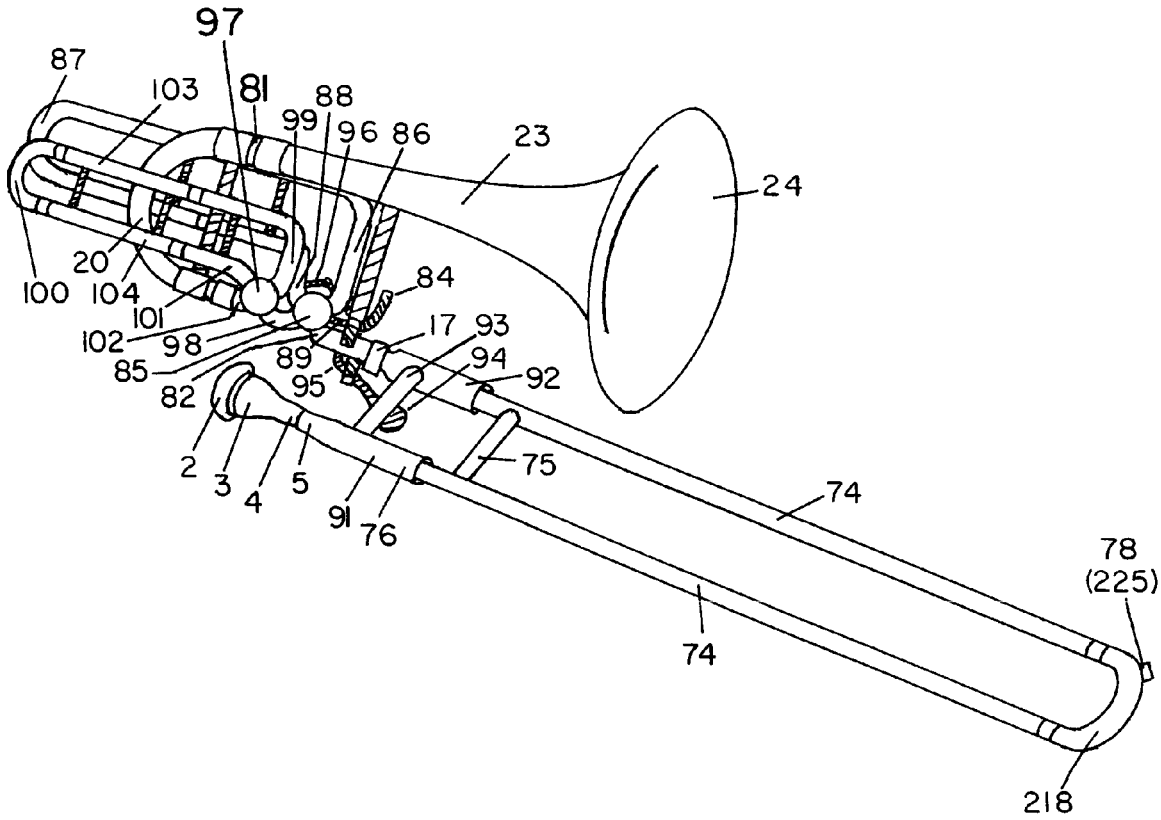
FIG. 5A (prior art)
FIG. 5A is an isometric perspective view at about 45 degrees above horizontal and from the same side of bell throat (23) as the players head, of a prior art independent double-valve B-flat/F/G-flat or B-flat/F/G bass slide trombone with F and G-flat or F and G-attachment secondary length extension tubing loops and rotary valves.
Figure 5B:
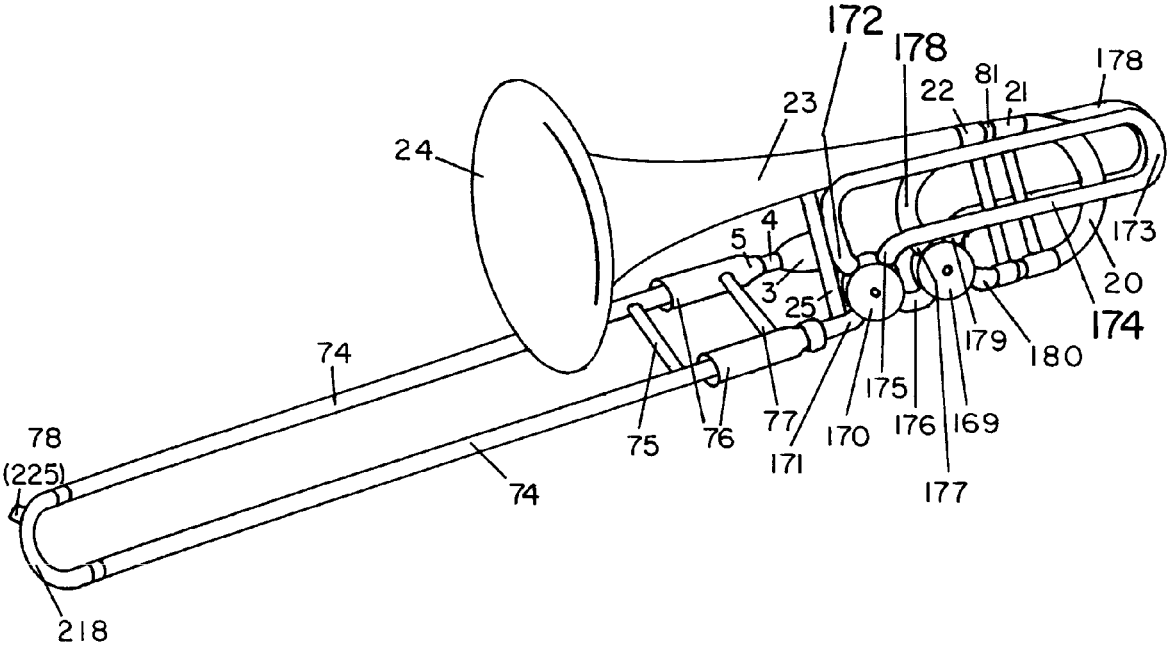
FIG. 5B (prior art)
FIG. 5B is an isometric perspective view from about 45 degrees above horizontal from the other side of bell throat (23), away from the performer's head, of an assembled prior art independent double valve bass B-flat/F/G-flat or B-flat/F/G trombone illustrating a mouthpiece (1–4), mouthpiece receiver (5), variable length telescoping hand slide (76, 75, 74, 78), two rotary valves (170, 169), with the two rotary valves (169, 170) turned sideways from their FIG. 6 orientation, further illustrating an approximately 36 inch secondary length extension musical key of F tubing loop (172–175) attached to the first valve (170), additional tertiary approximately 28 inch tertiary length extension musical key of G-flat tubing loop (177–179) or alternative tertiary approximately 20 inch tertiary length extension musical key of G tubing loop (177–179) attached to the second valve (169), tubular tuning slide bow (20), and flared tubular bell (23, 24). Rotary linkages and actuators have been omitted from the FIG. 5B. The perspective view is from the trombone side opposite the player's head and looking back from a viewing position somewhat forward of the left side of the player's head and somewhat above player's lips which are pressed against (1) mouthpiece rim (2).
Figure 5C:
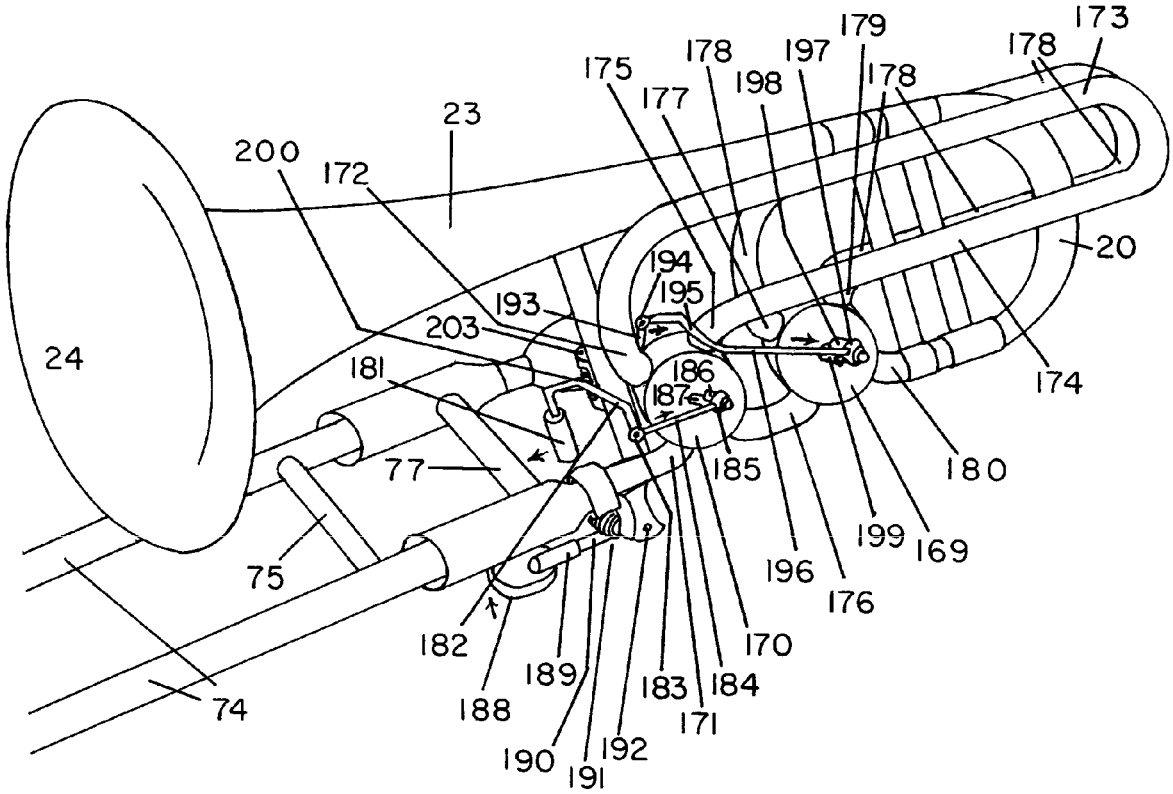
FIG. 5C (prior art)
FIG. 5C is an enlarged and partly truncated view of part of FIG. 5B showing F-valve (170) rotary linkage (182–187) and left thumb F-valve actuator (181), as well as G-flat valve (169) embodiment or alternative G-valve (169) rotary linkage (193–199) and left middle finger G-flat or alternative G valve actuator (188–192) connected to the G-flat or G linkage 193–199).
Figure 5D:
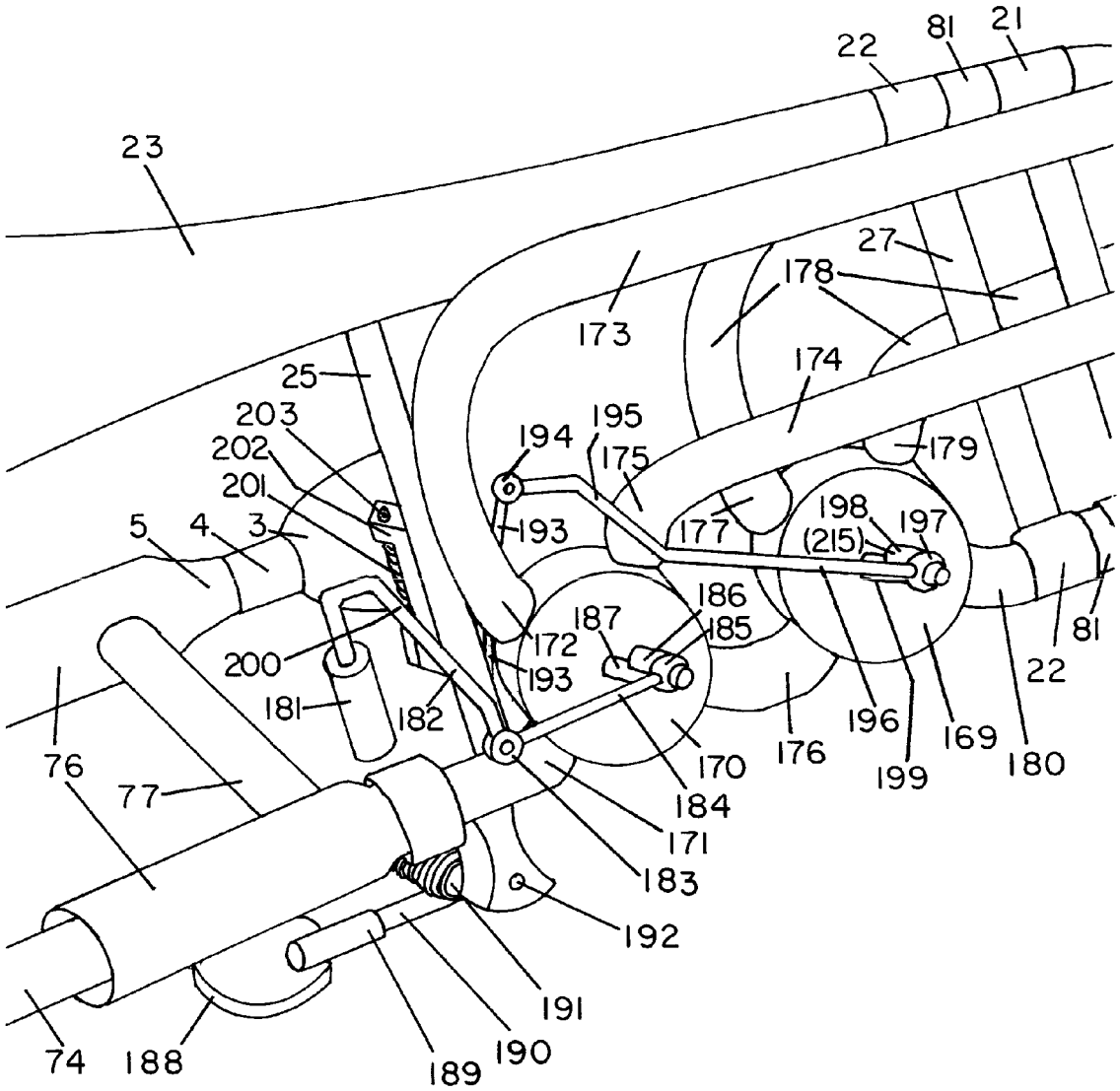
FIG. 5D (prior art)
FIG. 5D is a further enlarged view of a part of FIG. 5C showing greater detail in F-valve (170) rotary linkage (182–187) and left thumb F-valve actuator (181), as well as G-flat valve (169) or alternative G-valve (169) rotary linkage (193–199) and left middle finger G-flat or alternative G valve actuator (188–192) connected to the G-flat or G linkage (193–199).
Figure 6A:
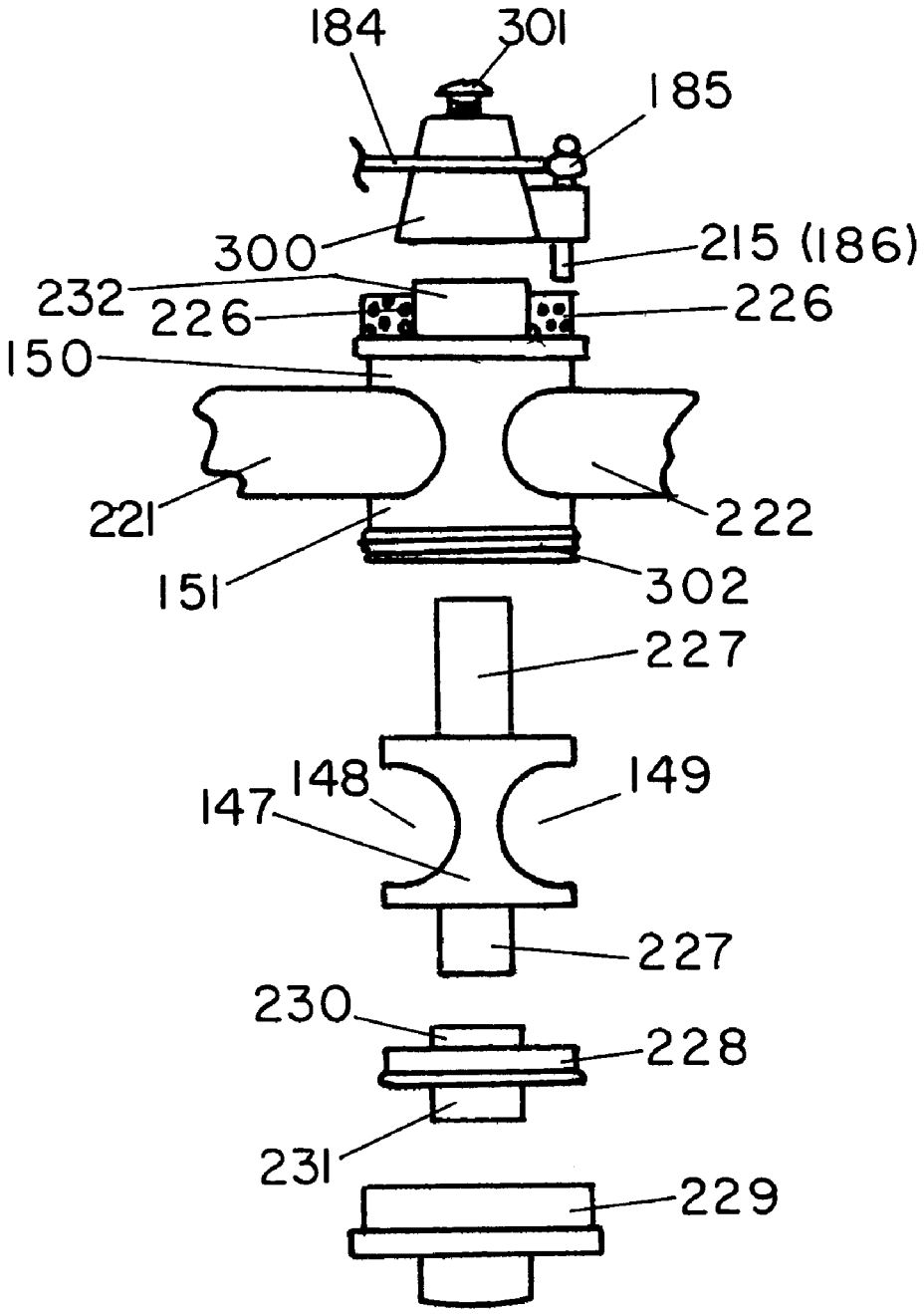
FIG. 6A (prior art)
FIG. 6A is a bottom exploded view of prior art valve 170 from FIGS. 4B–4D, shown in its engaged second of two operating positions.
Figure 6B:
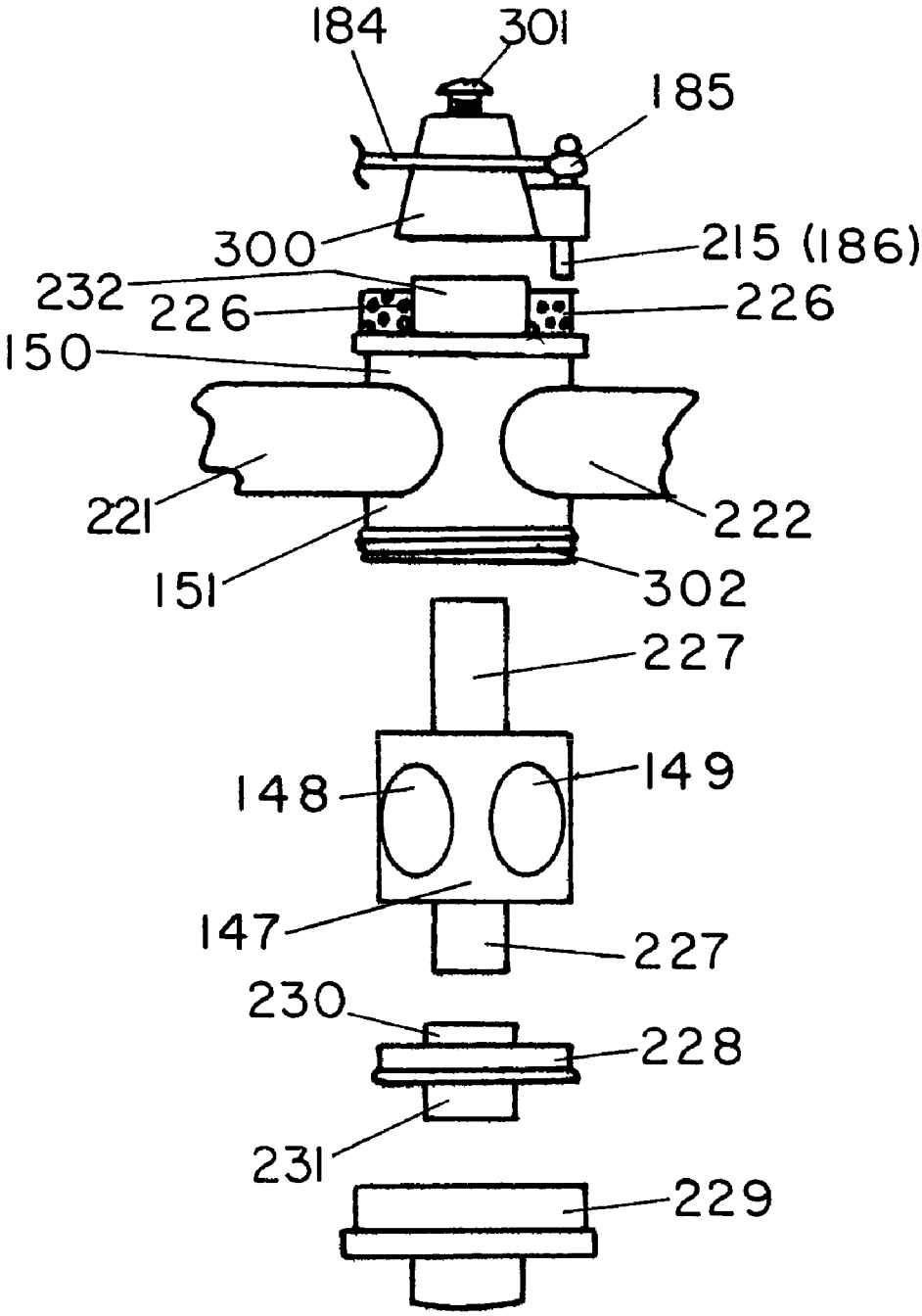
FIG. 6B (prior art)
FIG. 6B is a bottom exploded view of another type of prior art rotary valve which may be used at 170 in FIGS. 4B–4D.
Figure 6C:
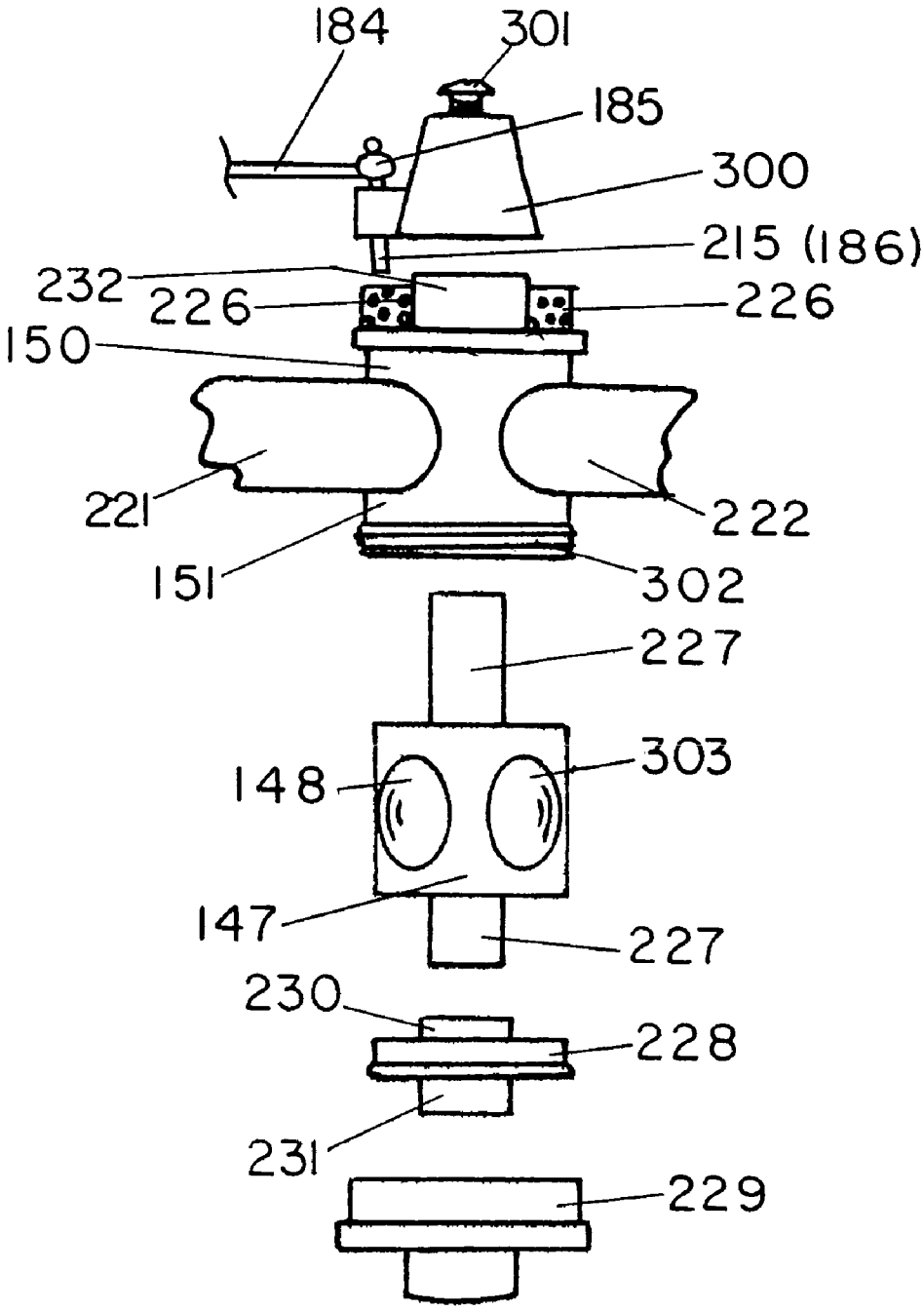
FIG. 6C (prior art)
FIG. 6C is the same as 6B, except that the rotor (147) has been rotated 90 degrees about spindle axis 227, such that the valve is now in its disengaged first of two rotary operating positions. In this disengaged condition, air passage 149 is shown on the left side the rotor, and opening 303 is just the other end (exit end in fact) of air passage 149, which is a single curved tunnel. In this disengaged first of two rotary operating positions, air enters the valve at port 221 and then enters rotor passage 149, proceeding directly through the curved tunnel (149) to the tunnel exit (303) without ever leaving the valve. The air thus passes directly from valve entry port 221 to valve exit port 222, and is not diverted out of the plane of the drawing in this disengaged first of two valve operating positions.
Figure 7A:
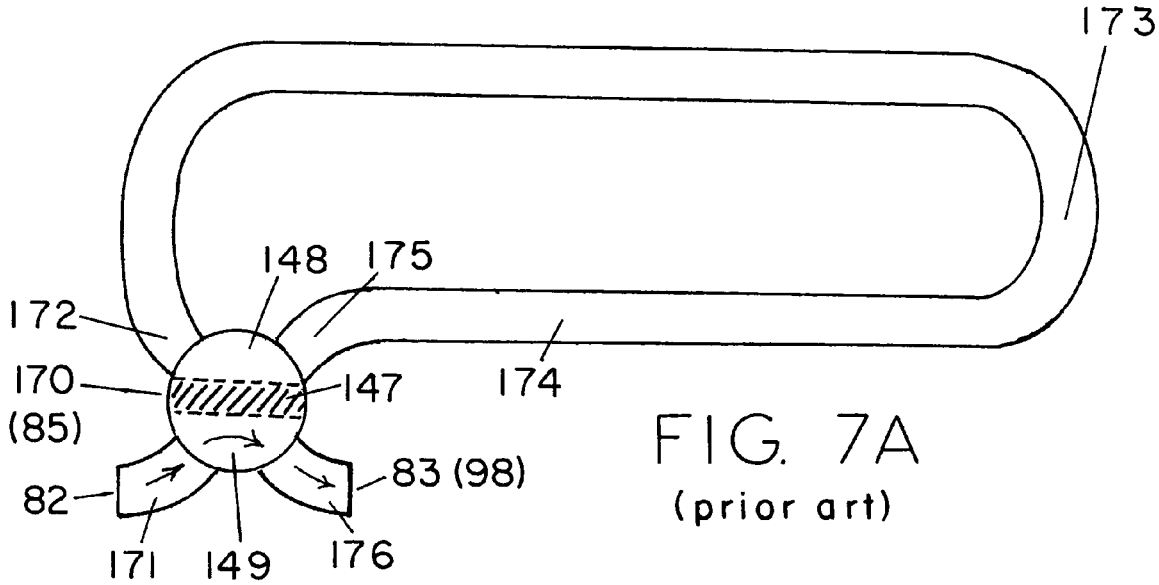
FIG. 7A (prior art)
FIG. 7A is a cutaway side view of a prior art single F-valve section from FIGS. 4A–D. (See entry port 171, valve 170, exit port 176, and external length extension tubing loop 172–175 in FIGS. 4B–D, which were external perspective views of the valve section represented in the cutaway side view of FIG. 7A.) The rotor (147) of FIG. 7A valve 170 is the type of rotor shown earlier in FIG. 6A.
Figure 7B:
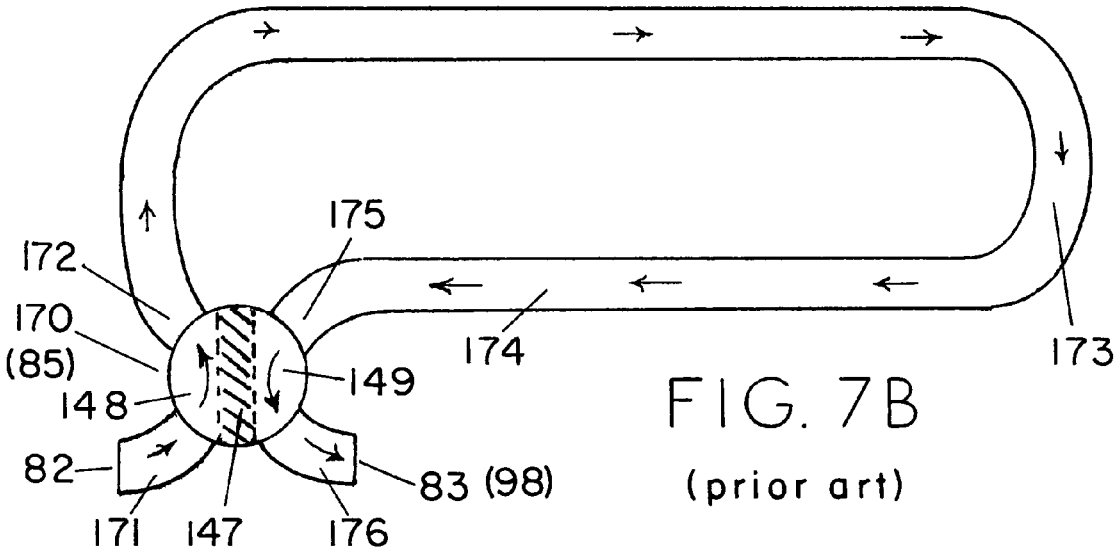
FIG. 7B (prior art)
FIG. 7B is the same as FIG. 7A, except that the prior art valve has been "engaged" by rotating rotor 147 by 90 degrees counter clockwise in this non-limiting example. (Actually a clockwise rotation is common, but not required, and a counterclockwise rotation is illustrative in this case, solely for the purpose of maintaining the same air passage numbers which were utilized in FIG. 6A, however a clockwise 90 degree rotation would serve the same air flow effect and is commonly used in practice—this is not an important point). With the valve rotor (147) in the FIG. 7B illustrated in an engaged second of two rotary operating positions, main path air entering at 81 and 171 is diverted by rotor passage 148 to secondary length extension tubing loop 172–175. Air traversing this loop in the directions indicated by the FIG. 7B arrows re-enters the valve rotor at 175 and rotor passage 149 restores it to the main path flow at 176, 83, and 98.
Figure 8A:
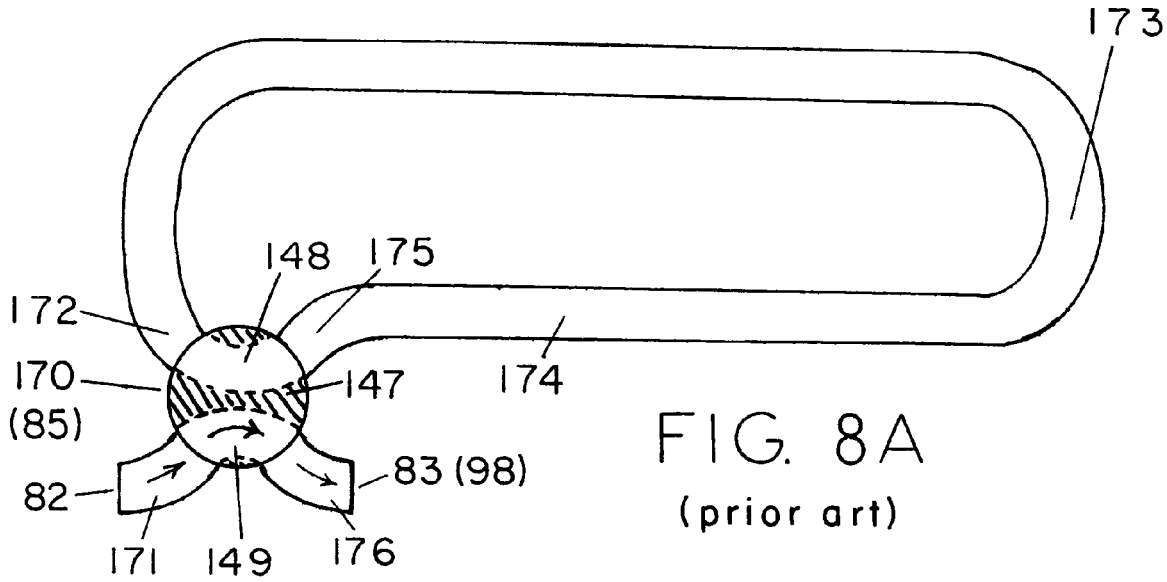
FIG. 8A (prior art)
FIG. 8A is the same as FIG. 7A, except that the FIG. 8A prior art rotor (147) is an improved prior art rotor of the type illustrated in FIG. 6C. Rotor internal air passages 148 and 149 are more clearly seen as curved tunnels in FIG. 8A.
Figure 8B:
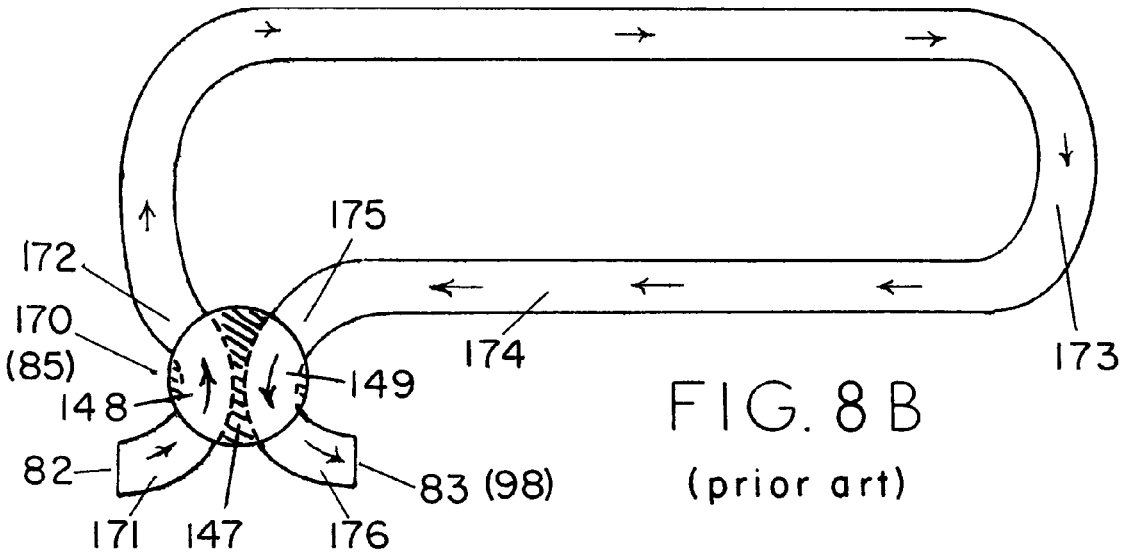
FIG. 8B (prior art)
FIG. 8B is the same as FIG. 7B, except that FIG. 8B prior art rotor (147) is an improved prior art rotor of the type illustrated in FIG. 6B. Rotor internal air passages 148 and 149 are seen as curved tunnels in FIG. 8B.
Figure 9A:
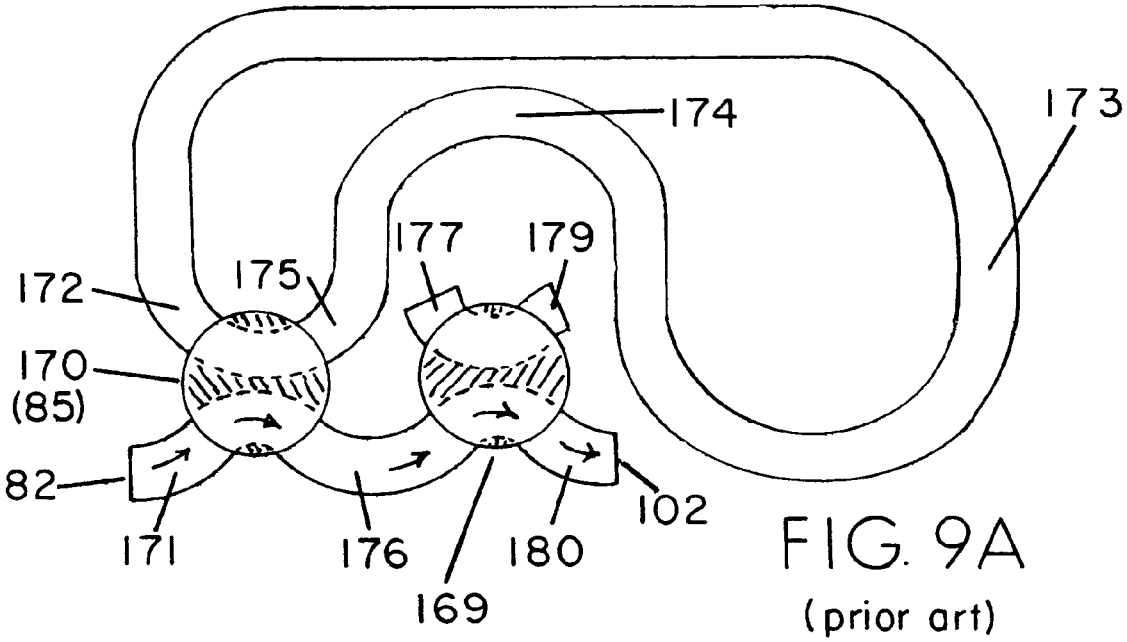
FIG. 9A (prior art)
FIG. 9A is the same as FIG. 8A, except that prior art external secondary length extension tubing loop 172–175 is routed differently. It is connected the same, but the loop is simply bent in a different curve, which has no impact on musical key or pitch, especially considering that there is no air in the loop with the FIGS. 9A and 8A valves bypassing this loop altogether and air proceeding directly from 171 to 176. Also shown in FIG. 8A is a second prior art valve (169) such as would be employed in FIGS. 5A–D, however the secondary length extension tubing loop (172–175) routing has been altered in FIG. 8A to relieve mechanical interference between this loop and the second valve (169). The secondary length extension loop in FIG. 9A is bypassed and receives no air with valve 170 in its illustrated disengaged first of two rotary operating positions, as illustrated by the air flow arrows in the figure. Secondary length extension tubing connections (177, 179) to the second valve (169) have been omitted from the figure for simplicity of inspection of the rest of the figure.
Figure 9B:
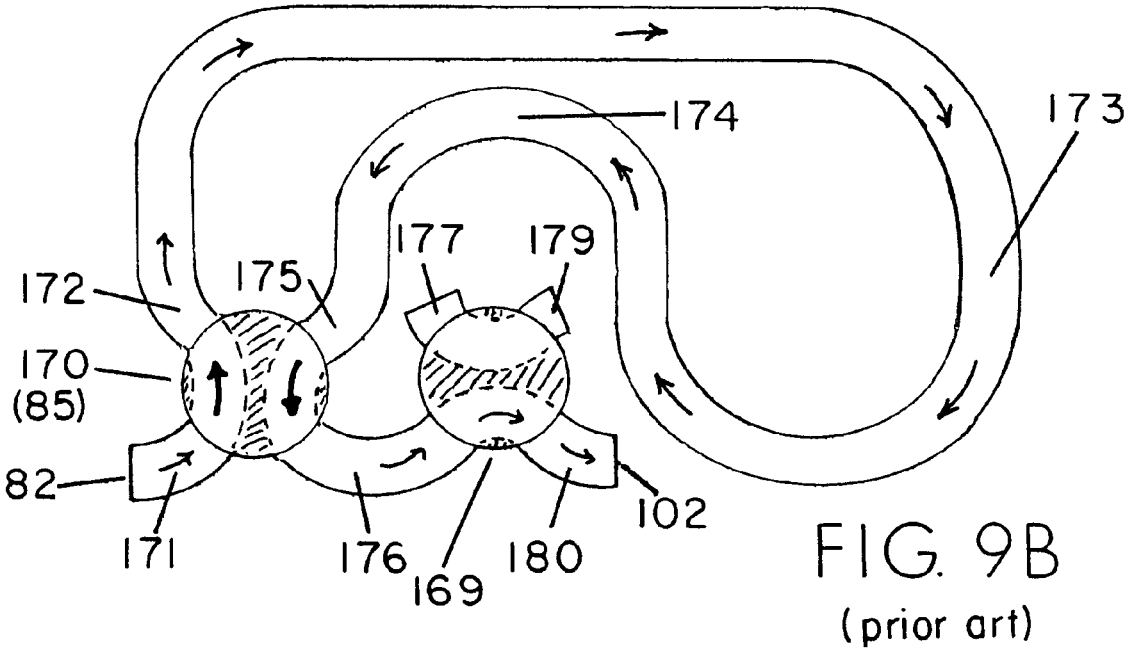
FIG. 9B (prior art)
FIG. 9B is the same as FIG. 9A, except that the prior art valve rotor (147) has been rotated 90 degrees to divert air into and through the prior art secondary extension tubing loop (172–175) with the valve in its engaged second of two rotary operating positions, as indicated by the air flow arrows in the figure. Such was also the valve operating and air flow condition in FIGS. 7B and 8B. Secondary length extension tubing connections (177, 179) to the second valve (169) have been omitted from the figure for simplicity of inspection of the rest of the figure.
Figure 10A:
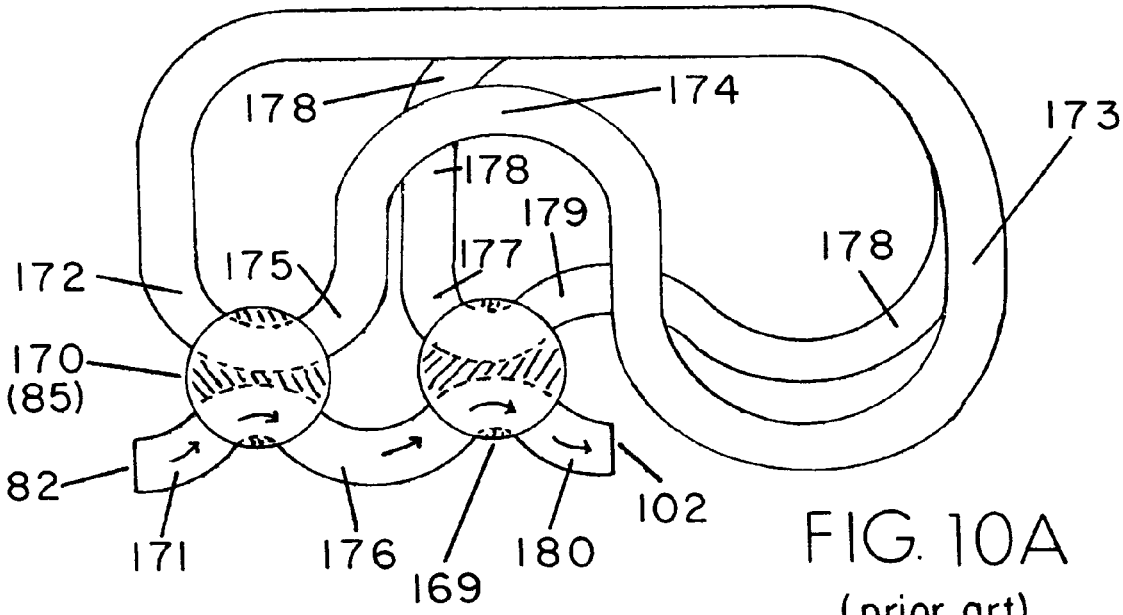
FIG. 10A (prior art)
FIG. 10A is the same as FIG. 9A, with addition of a prior art second external secondary length extension tubing loop (177–179) attached to valve 169. Note that both prior art valves (170, 169) are in their disengaged first of two rotary operating positions, such that air enters at 82 and skips directly through from 171 to 176 to 180 and bypasses both secondary length extension loops entirely, as indicated by the air flow directional arrows in the Figure. In this case, both valves are disengaged, both length extension tubing loops are bypassed, and the fundamental prior art bass slide trombone key remains B-flat.
Figure 10B:
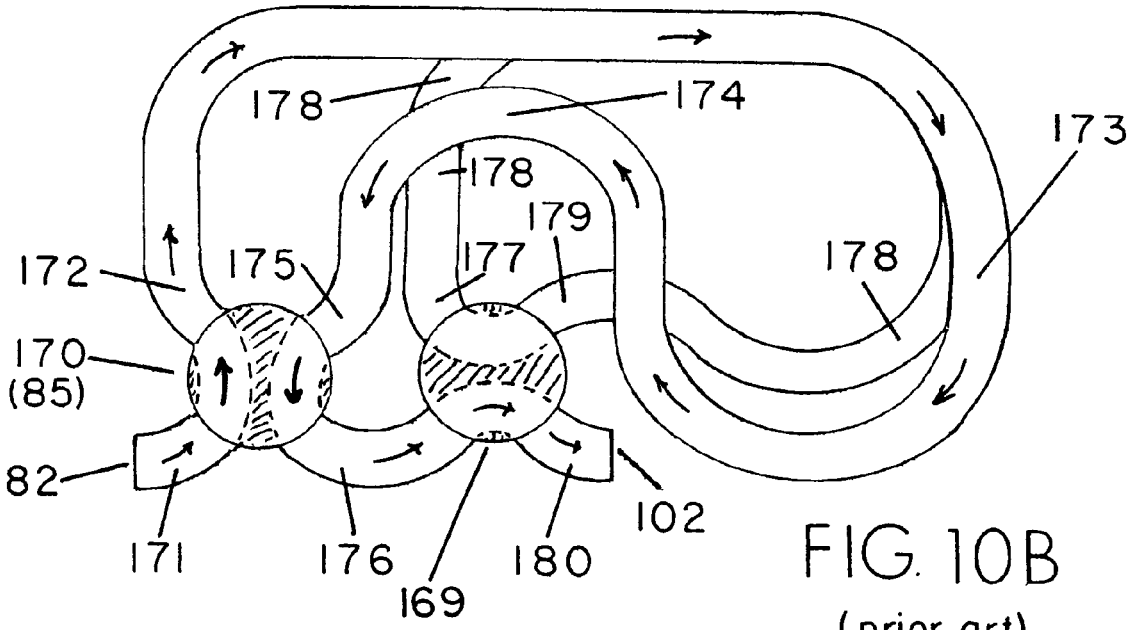
FIG. 10B (prior art)
FIG. 10B is the same as 10A, except that the prior art first valve 170 (only) has been rotated 90 degrees to its engaged second of two rotary operating positions. The prior art second valve (169) remains in its disengaged first rotary operating condition. In this configuration the air flow direction arrows indicate that air is diverted from the entering main path (82, 171) through the first length extension tubing loop (172–175), which is typically approximately 36 inches long and is called the F loop, but air leaving the first valve (170) at 176 is not diverted by the second (disengaged) valve (169), so it bypasses the second length extension tubing loop (177–179—called the G-flat loop for loop lengths of approximately 28 inches, or alternatively it is called the G loop for lengths of approximately 20 inches) in this case and simply skips directly from 176 to 180 and exits the valve to the main path continuation at 102. In this configuration, the prior art bass slide trombone has been converted to the fundamental musical key of F.
Figure 10C:
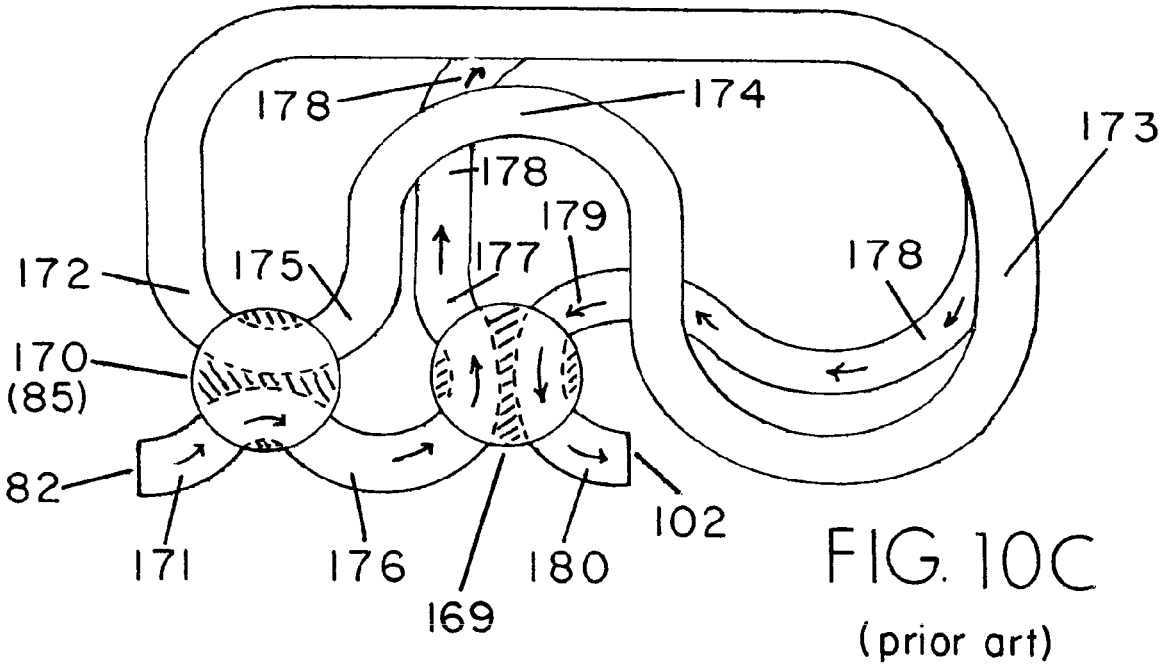
FIG. 10C (prior art)
FIG. 10C is the same as 10A, except that the prior art second valve (169) has been engaged (second operating position) to divert main path air through the second external secondary length extension tubing loop (G-flat or G-loop, 177–179) as indicated by the air flow direction arrows. In this case the F-loop has been bypassed, but the G-flat (or G) loop has been activated, and the prior art bass slide trombone has been converted to the fundamental musical key of G-flat or G (depending on loop 177–179 length).
Figure 10D:
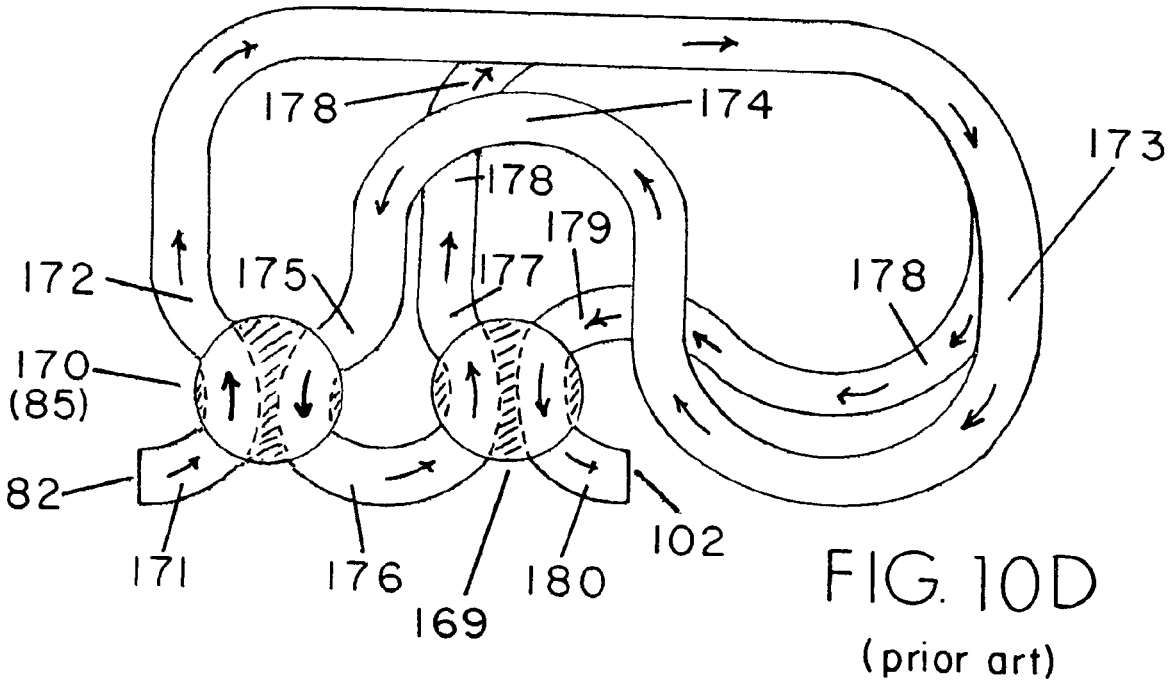
FIG. 10D (prior art)
FIG. 10D is the same as 10C, except that prior art both valves (170, 169) are engaged (both in second rotary operating position) such that air is diverted through both the F loop and the G-flat (or G) loop, combining the two loop lengths and converting the prior art bass slide trombone to the musical key of D or E-flat (depending on loop 177–179 length being either approximately 28 inches, or approximately 20 inches, respectively)

An eleventh invention embodiment is also not a Tu-Bone, but is a 3 valved B-flat tenor marching trombone such as in FIG. 1D with a mid-section progressive bore as described earlier in the fifth embodiment section.

The Figures and descriptions are of nonlimiting examples, and the Tu-Bone invention may be envisioned beyond the scope of specific embodiments described herein, such as many variations including many other valve designs, use of additional valves, tuning slides incorporated for fine tuning purposes within the three or more secondary length extension tubing loops, and secondary extension tubing loops of different shape and a variety tubing routings may all be included in the scope of the invention, and tuning slide extender mechanisms, and the scope of the invention must therefore be considered to be limited only by the claims.

While the invention has been described in terms of its preferred embodiments, those skilled in the art will recognize that the invention can be practiced with modification within the spirit and scope of the appended claims. For example, different valve designs, tubing routes, mirror image embodiments, right and left handed versions, variations in tubing material, and additional valves and tuning slides may be employed.

What is claimed is:

1. A musical wind instrument comprising, a tubular main air path, at least three tubular length extension detour air paths, and at least three air valves, in which the at least three air valves are connected in series with one another and in series within the tubular main air path, a first entry port of each of the at least three air valves sequentially receiving air from a segment of the tubular main air path, and a first exit port of each of the at least three air valves returning air to a continuation of the tubular main air path, each of the at least three air valves containing at least two internal air passages and having an associated external valve actuator, and each of the at least three air valves having two valve operating positions for selecting between immediate continuation of an air flow in the tubular main air path and diversion of the air flow into one of the at least three tubular length extension detour air paths prior to continuation in the tubular main air path, in which a disengaged first of the two valve operating positions occurs with a specified valve selected from among the at least three air valves whenever an associated actuator of the specified valve remains inactive, and in which the disengaged first of the two valve operating positions causes the specified valve to select immediate continuation of the air flow in the tubular main air path via a primary internal air passage selected from among the at least two internal air passages within the specified valve, the primary internal air passage leading directly from the first entry port of the specified valve to the first exit port of the specified valve whenever the specified valve is in the disengaged first of the two valve operating positions, the first exit port exiting to the continuation of the tubular main air path, and in which an engaged second of the two valve operating positions occurs with the associated actuator of the specified valve being activated, and in which the engaged second of the two valve operating positions causes the specified valve to select diversion of the air flow to a second exit port on the specified valve, the second exit port exiting to an entry end of a specified valve associated one of the at least three tubular length extension detour air paths external to the specified valve, and an exit end of the specified valve associated one of the at least three tubular length extension detour air paths being connected to a second entry port on the specified valve causing the diverted detoured air to return to the specified valve via the second entry port and an aligned return internal air passage selected from among the at least two internal air passages within the specified valve, the return internal air passage being further aligned with the first exit port of the specified valve, causing the returned detoured air to exit the specified valve to a continuation of the tubular main air path whenever the specified valve is in the disengaged first of the two valve operating positions, the tubular main air path further comprising a mouthpiece receiver to receive air from an inserted cupped mouthpiece, and a tubular entry air path with an entry end of the tubular entry air path connected to an exit end of the mouthpiece receiver and an exit end of the tubular entry air path being connected to the first entry port of a first encountered of the at least three air valves, the tubular main air path further comprising at least two valve interconnect tubular passages with an entry end of a first of the at least two valve interconnect tubular passages being connected to the first exit port of the first encountered of the at least three air valves, and an exit end of the first of the at least two valve interconnect tubular passages being connected to the first entry port of a second encountered of the at least three air valves, and with an entry end of a second of the at least two valve interconnect tubular passages being connected to the first exit port of the second encountered of the at least three air valves, and an exit end of the second of the at least two valve interconnect tubular passages being connected to the first entry port of a third encountered of the at least three air valves, the tubular main air path further comprising the primary internal air passages of the at least three air valves, a tubular exit air path, a tubular bell throat of progressively expanding bore, and a tubular bell flare, in which an entry end of the tubular air exit path is connected to the first exit port of a last encountered of the at least three air valves and an exit end of the tubular air exit path is connected to an entry end of the tubular bell throat, and an exit end of the tubular bell throat is connected to the entry end of a tubular bell flare, and an exit end of the tubular bell flare projects musical sound waves to a surrounding external atmosphere, and in which a total primary air path length approximately equals a summation of the length of the tubular main air path and the additional path length occurring within a portion of a cupped mouthpiece and between an entry end of the invention mouthpiece receiver and an exit aperture formed within a performing musician's vibrating lip embouchure, and the total primary air path length being selected from a group consisting of approximately 216 inches, approximately 192 inches, approximately 162 inches, approximately 144 inches, and approximately 108 inches, a total primary air path of approximately 216 inches corresponding to the musical key of BB-flat, a total primary air path of approximately 192 inches corresponding to the musical key of CC, a total primary air path of approximately 162 inches corresponding to the musical key of E-flat, a total primary air path of 144 inches corresponding to the musical key of F, and a total primary air path of 108 inches corresponding to the musical key of B-flat, and in which a first encountered section of the tubular main air path exhibits a length of approximately 20 percent of the total primary air path length, and in which a second encountered section of the tubular main air path immediately follows the first encountered section, in which the second encountered section exhibits a length of at least 10 percent of the total primary air path length, and in which the second encountered section has a bore of at least 0.495 inch and includes at least two sub-sections of air path in which a second encountered of the at least two sub-sections has a bore at least 0.007 inch larger than a first encountered of the at least two sub-sections of air path, and in which the bore of the tubular main air path does not exceed 0.850 inch within the first 65% of the total primary air path length, and does not exceed 0.790 inch within the first 65% of the total primary air path length, and in which the progressive bore of tubing within the second encountered section is a bore progression selected from among a group consisting of progressively increasing cylindrical bores, a gradually expanding conical bore, and a combination of cylindrical and conical bores, and in which the interface between the at least two sub-sections of differing bore within the second encountered section is an interface selected from among a group consisting of a sudden stepped increase in cylindrical bore, a brief rapid conically expanding increase in bore, a gradual conically expanding increase in bore, and a combination of stepped cylindrical and conical expansions in bore, the invention progressive bore design of the second encountered section and the invention limited maximum bore size of 0.85 inch within the first approximately 65 percent of total primary air path being distinguished in that the progressive bore design imparts an amplifying musical effect which makes the invention easier to blow, easier to blow loudly when desired, and musically more responsive to play, while the limited maximum bore size within approximately the first 65 percent of total primary air path maintains tone qualities characteristic of and desirable in a bass trombone, contrabass trombone, or cimbasso.

2. A musical wind instrument according to claim 1, in which the bell throat diameter measured 10 inches from the exit end of the bell flare is between 1.2 inches and 2.5 inches in diameter.

3. A musical wind instrument according to claim 1, in which the bore progression allows early placement of the at least three air valves within a section of reduced bore tubing selected from among a group consisting of the first encountered section of tubing and the first encountered sub-section of the second encountered section of tubing, and in which the early placement of the at least three air valves allows use of smaller bores within the internal air passages of the at least three air valves without inducement of a mismatch in bore size between the bore of internal air passages of the at least three air valves and a proximal section of reduced bore tubing in which the at least three air valves are located, such that the at least three valves is more compact, less massive, and exhibit lower friction, shorter throw, and lower spring tension valves in a nonlimiting example, providing for smoother operation and more nimble musical performance, and facilitating easier execution of technically difficult musical passages.

4. The musical wind instrument according to claim 1, in which a first combination path length is approximately the summation of a tubular path length of a second of the at least three tubular length extension detour air paths connected to a second encountered of the at least three air valves in series within the main tubular path and an air path length of the return internal air passage within the second encountered air valve, the first combination path length being approximately 5.946 percent of a first total path length, in which the first total path length is a summation of the tubular main path length, the primary internal air passage length of each of the at least three air valves, the tubular bell throat air path length and the tubular bell flare air path length, and in which a second combination path length is approximately the summation of a tubular path length of a first of the at least three tubular length extension detour air paths connected to a first encountered of the at least three air valves in series with the main tubular air path and an air path length of the return internal air passage within the first encountered air valve, the second combination path length being approximately 5.946 percent of a second total path length, in which the second total path length is a summation of the first total path length and the first combination path length, and in which a third combination path length is approximately the summation of a tubular path length of a third of the at least three tubular length extension detour air paths connected to a third encountered of the at least three air valves in series with the main tubular air path and an air path length of the return internal air passage within the third encountered air valve, the third combination path length being approximately 5.946 percent of a third total path length, in which the third total path length is a summation of the first total path length and the second combination path length.

5. The musical wind instrument according to claim 1, in which the at least three air valves are selected from a group consisting of piston valves and rotary valves, in which the rotary valves are further selected from a group comprising conventional rotary valves, S.E. Shires rotary valves, O. E. Thayer rotary valves, R. Hagmann rotary valves, Greenhoe rotary valves, Willson Rotax rotary valves, C. Lindbergh rotary valves, or any known rotary valve.

6. The musical wind instrument according to claim 1, in which the main air path length is approximately 108 inches, corresponding to the musical key of B-flat, and at least four valves and at least four tubular length extension detour air paths are employed, with one of the at least four tubular length extension detour air paths being associated with each of the at least four valves, and in which the second encountered section of air path commences after approximately the first ten percent of tubular main path length, the second encountered section comprising at least ten percent of the main air path, and in which the second encountered section exhibits a bore selected from a group consisting of an essentially single valued, essentially constant cylindrical bore and the progressive bore options described in claim 1.

7. The musical wind instrument according to claim 6 with three air valves and three tubular length extension detour air paths, and in which air passages within the valves are at least 0.500 inch bore whereby the musical wind instrument having an overall physical length greater than 36 inches.

8. A musical wind instrument according to claim 1, in which the approximately 216 inch tubular main air path BB-flat wind instrument and the approximately 192 inch tubular main air path CC wind instrument each have at least four air valves, and in which the approximately 162 inch tubular main air path E-flat wind instrument and the approximately 144 inch tubular main air path F wind instrument each have at least five air valves.

9. A B-flat "full double" musical wind instrument comprising, an introductory tubular air path, a primary tubular B-flat main air path, an alternate tubular F main air path, at least six length extension tubular detour air paths, at least four rotary air valves, an exit tubular air path, a tubular bell throat of progressively expanding bore, and a tubular bell flare, in which each of the valves has two operating positions including a disengaged first operating position and an engaged second operating position, and in which a total primary B-flat air path comprises in series and in connected sequence, a space within a cupped mouthpiece and situated between an exit aperture formed within a performer's lip embouchure and an entrance to the introductory tubular air path, the introductory tubular air path, a first internal air passage within a first encountered of the at least four air valves, the primary tubular B-flat main air path, a first internal air passage within each of three remaining air valves of the at least four air valves, the first internal air passages within each of the three remaining air valves being sequentially encountered in series with one another and contained in series within the primary tubular B-flat main air path, a second internal air passage within the first encountered air valve, the exit tubular air path, the tubular bell throat, and the tubular bell flare, wherein the total primary B-flat air path is approximately 108 inches in total path length, corresponding to the musical key of B-flat, when each of the at least four valves is in the disengaged first of the two valve operating positions, and in which a total alternate F air path comprises in series and in connected sequence, the space within the cupped mouthpiece and situated between the exit aperture formed within the performer's lip embouchure and the entrance to the introductory tubular air path, the introductory tubular air path, the first internal air passage within the first encountered of the at least four air valves, the alternate tubular F main air path, a second internal air passage within each of three remaining air valves of the at least four air valves, the second internal air passages within each of the three remaining air valves being sequentially encountered in series with one another and contained in series within the alternate tubular F main air path, the second internal air passage within the first encountered air valve, the exit tubular air path, the tubular bell throat, and the tubular bell flare, wherein the total alternate F air path is approximately 144 inches in total path length, corresponding to the musical key of F, when the first encountered of the at least four air valves is in the engaged second of the two valve operating positions, and when each of the remaining three air valves of the at least four air valves is also in the disengaged first of the two valve operating positions, and in which the primary tubular B-flat main air path and the alternate tubular F main air path are separate, distinct, and mutually exclusive air paths which are selected by the operating position of the first encountered air valve, in which the primary tubular B-flat main air path is selected whenever the first encountered air valve is in the disengaged first of the two valve operating positions, the alternate tubular main F air path being completely bypassed when the first encountered air valve is in the disengaged first of the two valve operating positions, and in which the alternate tubular F main air path is selected whenever the first encountered air valve is in the engaged second of two valve operating positions, the primary tubular main B-flat air path being completely bypassed when the first encountered air valve is in the engaged second of the two valve operating positions, and in which the first internal air passages of the remaining three of the at least four air valves are connected in series with one another and in series with the primary tubular B-flat main air path, a first entry port of each of the remaining three of the at least four air valves sequentially receiving air from a segment of the primary tubular B-flat main air path and a first exit port of each of the remaining three of the at least four air valves returning received air to a continuation of the primary tubular B-flat main air path whenever the first encountered air valve is in the disengaged first of the two valve operating positions, each of the three remaining air valves of the at least four air valves containing at least four internal air passages and having an associated external valve actuator, and the two valve operating positions of each of the three remaining air valves of the at least four air valves selecting between immediate continuation of an air flow in the primary tubular B-flat main air path and a diversion of the air flow into a specified valve associated one of the first three of the at least six tubular length extension detour air paths whenever the first encountered air valve is in the disengaged first of the two valve operating positions, in which the immediate continuation of the air flow in the primary tubular B-flat main air path is selected whenever the associated valve actuator of the specified valve selected from among the three remaining valves remains inactive causing a disengaged first of the two specified valve operating positions to be selected and whenever the first encountered valve is also in the disengaged first of the two first encountered valve operating positions, whereas the diversion of the air flow into the specified valve associated one of the first three of the at least six tubular length extension detour air paths is selected whenever the associated valve actuator of the specified valve selected from among the three remaining valves is activated causing the engaged second of the two specified valve operating positions to be selected with the first encountered valve being in the disengaged first of the two first encountered valve operating positions, the diversion of air flow received from the first entry port of the specified valve selected from among the three remaining valves proceeding via diversion to a second exit port on the specified valve, the second exit port exiting to an entry end of a specified valve associated one of the first three of the at least six tubular length extension detour air paths external to the specified valve, and an exit end of the specified valve associated one of the first three of the at least six tubular length extension detour air paths being connected to a second entry port on the specified valve, causing diverted air to return to the specified valve via the second entry port and an aligned third internal air passage selected from among the at least four internal air passages within the specified valve, the third internal air passage being further aligned with the first exit port of the specified valve, causing the returned detoured air to exit the specified valve to a continuation of the primary tubular B-flat air path when the specified valve is in the engaged second of the two specified valve operating positions and the first encountered valve is also in the disengaged first of the two first encountered valve operating positions, and in which the second internal air passages of each of the remaining three of the at least four air valves are connected in series with one another and in series with the alternate tubular F main air path, a third entry port of each of the remaining three of the at least four air valves sequentially receiving air from a segment of the alternate tubular F main air path and a third exit port of each of the remaining three of the at least four air valves returning air to a continuation of the alternate tubular F main air path whenever the first encountered air valve is in the engaged second of the two valve operating positions, and the two valve operating positions of each of the three remaining air valves of the at least four air valves alternatively selecting between immediate continuation of an air flow in the alternate tubular F main air path and diversion of the air flow into a specified valve associated one of the remaining three of the at least six tubular length extension detour air paths whenever the first encountered air valve is in the engaged second of the two valve operating positions, in which the immediate continuation of the air flow in the alternate tubular F main air path is selected whenever the associated valve actuator of the specified valve selected from among the three remaining valves remains inactive causing a disengaged first of the two specified valve operating positions to be selected and whenever the first encountered valve is also in the engaged second of the two first encountered valve operating positions, whereas the diversion of the air flow into the specified valve associated one of the remaining three of the at least six tubular length extension detour air paths is selected whenever the associated valve actuator of the specified valve selected from among the three remaining valves is activated causing the engaged second of the two specified valve operating positions to be selected with the first encountered valve being in the engaged second of the two first encountered valve operating positions, the diversion of the air flow received from the third entry port of the specified valve selected from among the three remaining valves proceeding via diversion to a fourth exit port on the specified valve, the fourth exit port exiting to an entry end of the specified valve associated one of the remaining three of the at least six tubular length extension detour air paths external to the specified valve, and an exit end of the specified valve associated one of the second three of the at least six tubular length extension detour air paths being connected to a fourth entry port on the specified valve, causing the diverted air to return to the specified valve via the fourth entry port and an aligned fourth internal air passage selected from among the at least four internal air passages within the specified valve, the fourth internal air passage being further aligned with the third exit port of the specified valve, causing the returned detoured air to exit the specified valve to a continuation of the alternate tubular F main air path when the specified valve is in the engaged second of the two specified valve operating conditions and the first encountered valve is also in the engaged second of the two first encountered valve operating positions, and in which the internal air passages of the at least four valves exhibit bores of at least 0.490 inch, and in which bores of the first encountered approximately 65 percent of the total primary B-flat air path do not exceed 0.850 inch in diameter.

10. A B-flat full double musical wind instrument according to claim 9, in which the valve actuator of the first encountered of the four air valves is positioned in a location selected from among a group consisting of a location proximal to the little finger of a performer's hand at the same time the index finger of the performer's same hand is positioned on the actuator of the first encountered of the remaining three of the four air valves and a location proximal to the performer's opposite hand.

11. A B-flat full double musical wind instrument according to claim 9, in which the valve actuator of the first encountered of the four air valves is positioned in a location proximal to the little finger of a performer's hand at the same time the index finger of the performer's same hand is positioned on the actuator of the first encountered of the remaining three of the four air valves, and in which the actuator of the first encountered of the four air valves is a first of two actuators, the first of the two actuators being the actuator which directly actuates the valve, and the first of the two actuators being operable in a mode selected from a group of modes consisting of a completely independently operable mode in which the first of the two actuators is directly operated by the little finger of the performer's hand in which the index finger of the performer's same hand is positioned on the actuator of the first encountered of the remaining three of the four air valves and a dependently operable mode, in which the first of the two actuators is engaged by a second of the two actuators, the second of the two actuators being operated by the performer's opposite hand, wherein the first encountered of the four air valves is conveniently actuated by either of the performer's two hands.

12. A B-flat full double musical wind instrument according to claim 9, in which a first encountered section total primary B-flat air path air path exhibits a length approximately ten percent of the total primary B-flat air path length, and in which a second encountered section of the total primary B-flat air path immediately follows the first encountered section, and in which the second encountered section exhibits a length of at least 10 percent of the total primary B-flat air path length, and in which the second encountered section has a bore of at least 0.495 inch and exhibits a progressive bore in which at least two sub-sections of air path occur within the second encountered section, and in which a second encountered of the at least two sub-sections has a bore at least 0.007 inch larger than a first encountered of the at least two sub-sections of tubing, and in which the bore of the tubular main B-flat air path does not exceed 0.850 inch within the first 65% of the total primary B-flat air path length, and preferably does not exceed 0.790 inch within the first 65% of the total primary B-flat air path length, and in which the progressive bore of tubing within the second encountered section is a bore progression selected from among a group consisting of progressively increasing cylindrical bores, a gradually expanding conical bore, and a combination of cylindrical and conical bores, and in which the interface between the at least two sub-sections of differing bore within the second encountered section is an interface selected from among a group consisting of a sudden stepped increase in cylindrical bore, a brief rapid conically expanding increase in bore, a gradual conically expanding increase in bore, and a combination of stepped cylindrical and conical expansions in bore.

13. A B-flat full double musical wind instrument according to claim 9, in which the bell throat diameter measured 10 inches from the exit end of the bell flare is between 1.2 inches and 2.5 inches in diameter.

14. The B-flat full double musical wind instrument according to claim 9, in which a first B-flat combination path length is approximately the summation of a tubular path length of a second of the at least three B-flat path associated tubular length extension detour air paths connected to a second encountered of the three remaining air valves in series within the tubular B-flat main air path and an air path length of the third internal air passage within the second encountered of the three remaining air valves, the first B-flat combination path length being approximately 5.946 percent of the total primary B-flat air path length, and in which a second B-flat combination path length is approximately the summation of a tubular path length of a first of the at least three B-flat path associated tubular length extension detour air paths connected to a first encountered of the three remaining air valves in series with the tubular B-flat main air path and an air path length of the third internal air passage within the first encountered of the three remaining air valves, the second B-flat combination path length being approximately 5.946 percent of a second B-flat total path length, in which the second B-flat total path length is a summation of the total primary B-flat path length and the first B-flat combination path length, and in which a third B-flat combination path length is approximately the summation of a tubular path length of a third of the at least three B-flat path associated tubular length extension detour air paths connected to a third encountered of the three remaining air valves in series with the tubular B-flat main air path and an air path length of the third internal air passage within the third encountered of the three remaining air valves, the third B-flat combination path length being approximately 5.946 percent of a third B-flat total path length, in which the third B-flat total path length is a summation of the total primary B-flat path length and the second B-flat combination path length, and in which a first F combination path length is approximately the summation of a tubular path length of a second of the at least three F path associated tubular length extension detour air paths connected to a second encountered of the three remaining air valves in series within the tubular F main air path and an air path length of the fourth internal air passage within the second encountered of the three remaining air valves, the first F combination path length being approximately 5.946 percent of the total primary F air path length, and in which a second F combination path length is approximately the summation of a tubular path length of a first of the at least three F path associated tubular length extension detour air paths connected to a first encountered of the three remaining air valves in series with the tubular F main air path and an air path length of the fourth internal air passage within the first encountered of the three remaining air valves, the second F combination path length being approximately 5.946 percent of a second F total path length, in which the second F total path length is a summation of the total primary F path length and the first F combination path length, and in which a third F combination path length is approximately the summation of a tubular path length of a third of the at least three F path associated tubular length extension detour air paths connected to a third encountered of the three remaining air valves in series with the tubular F main air path and an air path length of the fourth internal air passage within the third encountered of the three remaining air valves, the third F combination path length being approximately 5.946 percent of a third F total path length, in which the third F total path length is a summation of the total primary F path length and the second F combination path length.

15. The B-flat full double musical wind instrument according to claim 9, in which the at least four air valves are selected from a group consisting of piston valves and rotary valves, in which the first encountered rotary valve is further selected from a group comprising conventional rotary valves, S.E. Shires rotary valves, O. E. Thayer rotary valves, R. Hagmann rotary valves, Greenhoe rotary valves, Willson Rotax rotary valves, C. Lindbergh rotary valves, or any rotary valve, and in which the remaining three rotary valves are further selected from a group comprising doubled conventional rotary valves, doubled S.E. Shires rotary valves, doubled O. E. Thayer rotary valves, doubled R. Hagmann rotary valves, doubled Greenhoe rotary valves, doubled Willson Rotax rotary valves, doubled C. Lindbergh rotary valves, or a doubled of any rotary valve.

16. A B-flat full double musical wind instrument according to claim 9 in which the first encountered valve has an internal rotor passage that slants diagonally from a lower rotor level to an upper rotor level.

17. A B-flat full double wind instrument according to claim 9, in which the claim restrictions on bore and bell throat diameter are removed to create a double euphonium.

18. A B-flat "compensating" musical wind instrument comprising, an introductory tubular air path, a primary tubular B-flat main air path, an alternate tubular F main air path, a B-flat/F path interconnect tube, at least six length extension tubular detour air paths, at least four rotary air valves, an exit tubular air path, a tubular bell throat of progressively expanding bore, and a tubular bell flare, in which each of the valves has two operating positions including a disengaged first operating position and an engaged second operating position, and in which a total primary B-flat air path comprises in series and in connected sequence, a space within a cupped mouthpiece and situated between an exit aperture formed within a performer's lip embouchure and an entrance to the introductory tubular air path, the introductory tubular air path, the primary tubular B-flat main air path, a first internal air passage within each of the at least four air valves, the first internal air passages within each of the at least four air valves being sequentially encountered in series with one another and contained in series within the primary tubular B-flat main air path, the exit tubular air path, the tubular bell throat, and the tubular bell flare, wherein the total primary B-flat air path is approximately 108 inches in total path length, corresponding to the musical key of B-flat, when each of the at least four valves is in the disengaged first of the two valve operating positions, and in which a total primary F air path comprises in series and in connected sequence, the space within the cupped mouthpiece and situated between the exit aperture formed within the performer's lip embouchure and the entrance to the introductory tubular air path, the introductory tubular air path, the primary tubular B-flat main air path, the first internal air passage within each of the at least four air valves and sequentially encountered in series with one another and contained in series within the primary tubular B-flat main air path, the B-flat/F path interconnect tube, the alternate tubular F main air path, a second internal air passage within each of the at least four air valves, the second internal air passages within each of the four air valves being sequentially encountered in series with one another and contained in series within the alternate tubular F main air path, the exit tubular air path, the tubular bell throat, and the tubular bell flare, wherein the total primary F air path is approximately 144 inches in total path length, corresponding to the musical key of F, when the fourth encountered of the at least four air valves is in the engaged second of the two valve operating positions, and when each of the first three encountered air valves of the at least four air valves are also in the disengaged first of the two valve operating positions, and in which the primary tubular B-flat main air path is selected as a separate and distinct air path and the alternate tubular F path is bypassed when the fourth encountered valve is in the disengaged first of the two valve operating positions, and in which the primary tubular B-flat and the alternate tubular F main air path are both selected, becoming sequentially shared air paths in series when the fourth encountered valve is in the engaged second of the two valve operating positions, and in which the first internal air passages of the first three encountered of the at least four air valves are connected in series with one another and in series with the primary tubular B-flat main air path, a first entry port of each of the first three encountered of the at least four air valves sequentially receiving air from a segment of the primary tubular B-flat main air path and a first exit port of each of the first three encountered of the at least four air valves returning air to a continuation of the primary tubular B-flat main air path, each of the first three encountered air valves of the at least four air valves containing at least four internal air passages and having an associated external valve actuator, and the two valve operating positions of each of the first three encountered air valves of the at least four air valves selecting between immediate an continuation of an air flow in the primary tubular B-flat main air path and a diversion of the air flow into a specified valve associated one of the first three of the at least six tubular length extension detour air paths, in which the immediate continuation of the air flow in the primary tubular B-flat main air path is selected whenever the associated valve actuator of the specified valve selected from among the first three encountered air valves remains inactive causing a disengaged first of the two specified valve operating positions to be selected, whereas the diversion of the air flow into the specified valve associated one of the first three of the at least six tubular length extension detour air paths is selected whenever the associated valve actuator of the specified valve selected from among the first three encountered air valves is activated causing the engaged second of the two specified valve operating positions to be selected, the diversion of air flow received from the first entry port of the specified valve selected from among the first three encountered valves proceeding via diversion to a second exit port on the specified valve, the second exit port exiting to an entry end of a specified valve associated one of the first three of the at least six tubular length extension detour air paths external to the specified valve, and an exit end of the specified valve associated one of the first three of the at least six tubular length extension detour air paths being connected to a second entry port on the specified valve, causing the diverted air to return to the specified valve via the second entry port and an aligned third internal air passage selected from among the at least four internal air passages within the specified valve, the third internal air passage being further aligned with the first exit port of the specified valve, causing returned detoured air to exit the specified valve to a continuation of the primary tubular B-flat air path when the specified valve is in the engaged second of the two specified valve operating positions, and in which the second internal air passages of each of the first three encountered of the at least four air valves are connected in series with one another and in series with the alternate tubular F main air path, a third entry port of each of the first three encountered of the at least four air valves sequentially receiving air from a segment of the alternate tubular F main air path and a third exit port of each of the first three encountered of the at least four air valves returning air to a continuation of the alternate tubular F main air path whenever the fourth encountered air valve is in the engaged second of the two fourth encountered valve operating positions, and the two valve operating positions of each of the first three encountered air valves of the at least four air valves alternatively selecting between immediate continuation of an air flow in the alternate tubular F main air path and diversion of the air flow into a specified valve associated one of the remaining three of the at least six tubular length extension detour air paths whenever the fourth encountered air valve is in the engaged second of the two fourth encountered valve operating positions, in which the immediate continuation of the air flow in the alternate tubular F main air path is selected whenever the associated valve actuator of the specified valve selected from among the first three encountered valves remains inactive causing a disengaged first of the two specified valve operating positions to be selected and whenever the fourth encountered valve is also in the engaged second of the two fourth encountered valve operating positions, whereas the diversion of the air flow into the specified valve associated one of the remaining three of the at least six tubular length extension detour air paths is selected whenever the associated valve actuator of the specified valve selected from among the first three encountered valves is activated causing the engaged second of the two specified valve operating positions to be selected with the fourth encountered valve being in the engaged second of the two fourth encountered valve operating positions, the diversion of the air flow received from the third entry port of the specified valve selected from among the first three encountered valves proceeding via diversion to a fourth exit port on the specified valve, the fourth exit port exiting to an entry end of the specified valve associated one of the remaining three of the at least six tubular length extension detour air paths external to the specified valve, and an exit end of the specified valve associated one of the second three of the at least six tubular length extension detour air paths being connected to a fourth entry port on the specified valve, causing diverted air to return to the specified valve via the fourth entry port and an aligned fourth internal air passage selected from among the at least four internal air passages within the specified valve, the fourth internal air passage being further aligned with the third exit port of the specified valve, causing the returned detoured air to exit the specified valve to a continuation of the alternate tubular F main air path when the specified valve is in the engaged second of the two specified valve operating conditions and the fourth encountered valve is also in the engaged second of the two fourth encountered valve operating positions, and in which the internal air passages of the at least four valves exhibit bores of at least 0.490 inch, and in which bores of the first encountered approximately 65 percent of the total primary B-flat air path do not exceed 0.850 inch in diameter.

* * * * *